US007462444B2

(12) United States Patent
Oka et al.

(10) Patent No.: US 7,462,444 B2
(45) **Date of Patent: *Dec. 9, 2008**

(54) IMAGE FORMING METHOD FOR THE PHOTOTHERMOGRAPHIC MATERIAL

(75) Inventors: Yutaka Oka, Kanagawa (JP); Tomoyuki Ohzeki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/267,199

(22) Filed: Nov. 7, 2005

(65) Prior Publication Data

US 2006/0110692 A1 May 25, 2006

Related U.S. Application Data

(63) Continuation-in-part of application No. 10/686,463, filed on Oct. 16, 2003, now abandoned.

(30) Foreign Application Priority Data

Oct. 18, 2002 (JP) ..... 2002-303809
Feb. 4, 2003 (JP) ..... 2003-026786

(51) Int. Cl.
*G03C 5/16* (2006.01)
*G03C 1/498* (2006.01)

(52) U.S. Cl. ..... 430/350; 430/503; 430/568; 430/601; 430/607; 430/610; 430/619

(58) Field of Classification Search ..... 430/619, 430/567, 607, 613, 531, 601, 350, 610, 503, 430/568

See application file for complete search history.

(56) References Cited

U.S. PATENT DOCUMENTS

| | | | | |
|---|---|---|---|---|
| 4,332,889 | A | 6/1982 | Siga et al. | |
| 5,041,369 | A | 8/1991 | Fukui et al. | |
| 5,747,236 | A | 5/1998 | Farid et al. | |
| 6,054,260 | A | 4/2000 | Adin et al. | |
| 6,143,488 | A | 11/2000 | Uytterhoeven et al. | |
| 6,171,767 | B1 | 1/2001 | Kong et al. | |
| 6,288,370 | B1 | 9/2001 | Ogawa et al. | |
| 6,376,166 | B1 | 4/2002 | Oya et al. | |
| 6,420,102 | B1 | 7/2002 | Bauer et al. | |
| 6,468,720 | B1 | 10/2002 | Hirabayashi et al. | |
| 6,514,678 | B1 * | 2/2003 | Burgmaier et al. | 430/353 |
| 6,524,781 | B2 | 2/2003 | Wada | |
| 6,649,338 | B2 | 11/2003 | Mitsuhashi | |
| 6,800,427 | B2 * | 10/2004 | Yamane | 430/350 |
| 6,814,506 | B2 | 11/2004 | Nanami | |
| 7,179,585 | B2 * | 2/2007 | Okutsu et al. | 430/350 |
| 2003/0215756 | A1 | 11/2003 | Morita et al. | |
| 2004/0005521 | A1 | 1/2004 | Kudo | |
| 2004/0038156 | A1 * | 2/2004 | Oyamada et al. | 430/619 |
| 2004/0058281 | A1 | 3/2004 | Yamane et al. | |

FOREIGN PATENT DOCUMENTS

| | | |
|---|---|---|
| EP | 1 096 310 | 5/2001 |
| EP | 1 310 825 | 5/2003 |
| JP | A 11-249250 | 9/1999 |

* cited by examiner

*Primary Examiner*—Thorl Chea
(74) *Attorney, Agent, or Firm*—Margaret A. Burke; Sheldon J. Moss

(57) ABSTRACT

An image forming method comprising: imagewise exposing and thermal developing a photothermographic material using an image recording apparatus, wherein a part of the sheet is exposed and, in parallel with the exposure, development is started on a part of the sheet having been already exposed:

wherein the photothermographic material comprises a reducing agent represented by formula (R), and wherein the photosensitive silver halide contains at least two preformed photosensitive silver halides having respective sensitivities different from each other for a light with the same exposure wavelength and a silver iodide content of the photosensitive silver halide is 40% by mole or more.

15 Claims, 2 Drawing Sheets

IMAGE FORMING METHOD FOR THE PHOTOTHERMOGRAPHIC MATERIAL

CROSS-REFERENCE TO RELATED APPLICATION

This application claims priority under 35 USC 119 from Japanese Patent Application Nos. 2002-303809 and 2003-26786, the disclosures of which are incorporated by reference herein. This application is a continuation-in-part of U.S. application Ser. No. 10/686,463, filed on Oct. 16, 2003 now abandoned, the disclosure of which is incorporated by reference herein.

BACKGROUND OF THE INVENTION

1. Field of the Invention

The invention relates to a photothermographic material, and more particularly, to a photothermographic material revealing a soft gradation and stable in output image and an image forming method thereof.

2. Description of the Related Art

In the medical imaging field and the graphic arts field, there has been, in recent years, a strong desire for a dry photographic process from the viewpoints of environmental conservation and space-saving. Further the development of digitization has resulted in the rapid development of systems in which image information is captured and stored into a computer. If necessary, the image information is processed by the computer which outputs the image information through communication to a needed location; at the site, the image information is further output onto a photosensitive material using a laser-image setter or a laser-imager, followed by development thereof to form an image on the photosensitive material. It is required that the photosensitive material be able to record an image under exposure to a laser with a high illuminance and that a clear black-tone image with a high resolution and sharpness can be formed. While various kinds of hard copy systems using a pigment and a dye such as an ink-jet printer or electrophotography have been distributed as a general image forming system using such a digital recording imaging material, images in the digital recording imaging material obtained by such a general image forming system are insufficient in terms of image qualities required for medical images. To facilitate diagnosis, image qualities such as sharpness, granularity, gradation, tone and high recording speed (sensitivity) are required. However, digital recording imaging material has not reached a level at which it can replace medical silver salt film processed by conventional wet development.

A thermographic system using an organic silver salt is described in, for example, U.S. Pat. Nos. 3,152,904 and 3,457,075; and D. Klosterboer, "Thermally Processed Silver Systems"; J. Sturge, V. Walworth and A. Shepp (coedited), "Imaging Processes and Materials" Neblette 8$^{th}$ Ed., Chapter 9, pp. 279-291, 1989, the disclosure of which is incorporated by reference herein. Generally, a photothermographic material, in particular, comprises an image forming layer in which a photosensitive silver halide, a reducing agent, a reducible silver salt (for example, an organic silver salt) and if necessary, a toner controlling a color tone of diveloped silver are dispersed in a binder matrix.

A photothermographic material forms a black-toned silver image by heating a photothermographic material to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by a catalytic action of a latent image generated on the silver halide by exposure. As a result, a black-toned silver image is formed in an exposed region. A photothermographic material is disclosed in many literatures including for examples U.S. Pat. No. 2,910,377 and Japanese Patent Application Publication (JP-B) No. 43-4924; Fuji medical dry imager FM-DP L is an example of a practical medical image forming system that has been marketed.

Since such a thermographic system using an organic silver salt has no fixing step and the photosensitive material contains all chemicals necessary for image forming, there has been an intrinsic problem in raw preservability, that is "increase in fog", that an unexposed portion is blackened during storage from manufacture of a photosensitive material till the material is actually put into use, and another internal problem of "print-out". In "print-out" an image after thermal development is exposed to illumination of weak light such as room light. An unexposed portion is gradually blackened.

As means for reducing fogging and print-out, a method in which silver iodide formed through conversion of an organic silver salt is disclosed in U.S. Pat. No. 6,143,488, EP No. 0922995, the disclosures of which are incorporated herein by reference. As to other photosensitive materials using silver iodide, disclosures thereof are given in WO (Laid-Open) Nos. 97-48014 and 97-48015; U.S. Pat. No. 6,165,705; Japanese Patent Application Laid-Open (JP-A) No. 8-297345; and Japanese Patent No. 2785129.

While a silver halide emulsion with a high silver iodide content is generally low in sensitivity, it has been found that a problem of a low sensitivity is solved by writing with a high illuminance light source such as a laser beam and image recording is enabled with less energy. In recent years, development has been made particularly on a light source module with an SHG (a second harmonic generator) and a laser diode integrated into a single piece whereby a laser output apparatus in a short wavelength region has come into the limelight. A blue laser diode enables high definition image recording and makes it possible to obtain an increase in recording density and a stable output over a long lifetime, which results in expectation of an expanded demand in the future for silver halide emulsions with a high silver iodide content: A silver halide emulsion with a high silver iodide content is photosensitive to wavelengths of the blue laser diode without adding a sensitizing dye, which is a feature that other silver halides lack.

However the use of a silver halide with a high silver iodide composition has created a problem in that gradation is harder.

Thus there is a need in the art for an improved photothermographic material including a silver halide emulsion rich in silver iodide content; such an improved material could be effectively used to fulfill the demand for stable photothermographic materials capable of producing high-quality images.

SUMMARY OF THE INVENTION

The present invention intends to solve the above problems in the prior art by providing a photothermographic material revealing a soft gradation and stable in output image and an image forming method therof.

An aspect of the invention provides an image forming method comprising: imagewise exposing and thermal developing a sheet-like photothermographic material using an image recording apparatus, wherein a part of the sheet is exposed and, in parallel with the exposure, development is started on a part of the sheet having been already exposed:

wherein the photothermographic material comprises at least a photosensitive silver halide, a non-photosensitive organic silver salt, a reducing agent represented by following formula (R) and a binder on at least one surface of a support;

formula (R):

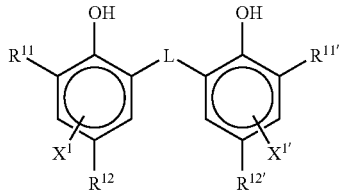

wherein $R^{11}$ and $R^{11'}$ each independently represents an alkyl group having 1 to 20 carbon atoms, $R^{12}$ and $R^{12'}$ each independently represents a hydrogen atom or a group capable of substituting for a hydrogen atom on a benzene ring, L represents a —S— group or a —$CHR^{13}$— group, $R^{13}$ represents a hydrogen atom or an alkyl group having 1 to 20 carbon atoms, and X and $X^1$ each independently represents a hydrogen atom or a group capable of substituting for a hydrogen atom on a benzene ring; and wherein the photosensitive silver halide contains at least two preformed photosensitive silver halides having respective sensitivities different from each other for a light with the same exposure wavelength and a silver iodide content of the photosensitive silver halide is 40% by mole or more.

DETAILED DESCRIPTION OF THE INVENTION

Figure 1:
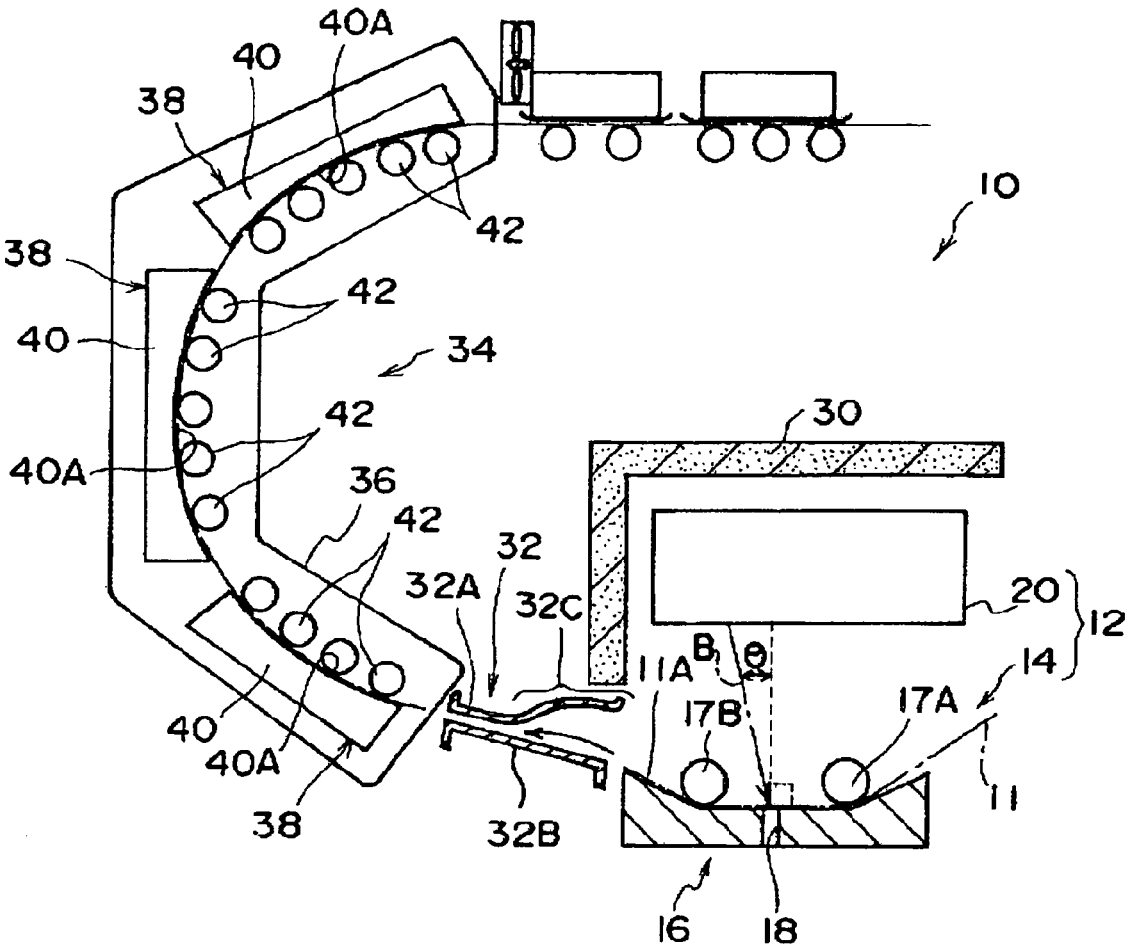
FIG. 1 is a schematic view of an image recording apparatus according to the present invention.

In order to obtain a photothermographic material, containing a silver halide with a high silver iodide content, and showing a soft gradation, it is important that the silver halide includes at least two kinds of silver halides having sensitivities differing from each other for the same exposure wavelength.

In order to alter a sensitivity of a silver halide in the invention, many methods may be used such as, altering an amount of silver halide addition, altering an average grain size, altering a manner of chemical sensitization or a degree of ripening, or altering a kind or an addition amount of a spectral sensitizing dye adsorbed to a silver halide.

As a method employing two or more kinds of silver halides having respective sensitivities differing from each other, examples thereof include: 1) a method in which a grain size distribution of a silver halide is altered, 2) a method using silver halides having respective grain sizes differing from each other, 3) a method in which a way of chemical sensitization of a silver halide is altered, 4) a method in which an amount of a heavy metal added to a silver halide is adjusted, 5) a method in which a kind or an amount of addition of a spectral sensitizing dye is altered and 6) a method in which a halogen composition (halogen species and a ratio) of a silver halide is altered.

The grain size distribution of the silver halide can be changed by, for example, employing at least two types of silver halides having different grain sizes mixed together, or employing silver halide having wide range of grain size distribution. It is also preferable to apply at least two types of silver halides having different grain sizes onto two different image forming layers.

The silver halide can be sensitized by, for example, employing a chemically sensitized silver halide, or changing the type of chemical sensitizer or the degree of sensitization. It is also preferable to employ at least two types of silver halides with different types of chemical sensitizing agent or sensitized to different degrees, that are mixed together or applied onto two different image forming layers.

It is also preferable to mix at least two types of silver halides with different types of spectral sensitizing dyes or to apply the silver halides onto two different image forming layers.

In the invention, it is important to prepare silver halides having different sensitivities and that the photothermographic material includes at least two types of silver halides, as described above.

The difference of sensitivities between at least two types of aforementioned photosensitive silver halides is 0.3 to 1.0 in terms of log E. The "log E" represents the common logarithm of exposure value.

Now, a composition of the photothermographic material will be described in detail, along with the effects of these compounds on the characteristic curve.

2. Photosensitive Silver Halide

1) Halogen Composition

It is important that the photosensitive silver halide in the present invention has a silver iodide content of at least 5 mol % or more. Other components are not particularly limited and can be selected from silver chloride and silver bromide and organic silver salts such as silver thiocyanate, silver phosphate and the like, and particularly, silver bromide and silver chloride are preferable. By using such a silver halide having a high silver iodide content, a preferable photothermographic material having excellent image preservability after development treatment, particularly showing remarkably small increase in fogging in irradiation with light can be designed.

Further, it is more preferable that the silver iodide content is 40 mol % or more, and it is extremely preferable from the standpoint of image preservability against irradiation with light after treatment particularly when the silver iodide content is 80 mol % or more.

The distribution of the halogen composition in a grain may be uniform or the halogen composition may be changed stepwise, or it may be changed continuously. Further, a silver halide grain having a core/shell structure can be preferably used. Preferred structure is a twofold to fivefold structure and, more preferably, core/shell grain having a twofold to fourfold structure can be used. A core-high-silver iodide-structure which has a high content of silver iodide in the core part, and a shell-high-silver iodide-structure which has a high content of silver iodide in the shell part can also be preferably used. Further, a technique of localizing silver bromide or silver iodide on the surface of a grain as form epitaxial parts can also be preferably used.

2) Grain Size

The grain size of silver halide of the high silver iodide used in the invention is particularly important. When the size of a silver halide is relatively large, the application amount of a silver halide necessary for attaining required maximum image density increases and consequently transparency of the film decreases. In general, therefore, large size of a silver halide is not preferable. The present inventors have found that the silver halide having high silver iodide content of the invention has a specific action in that the greater the application amount, the larger the development is suppressed and sensitivity is lowered, and it may become unstable against the developing time to obtain uniform image density. It has been found, therefore, that at a certain grain size or more, maximum concentration is not obtained in a given development time, and on the other hand, when the application amount thereof is suppressed to a certain level or less, a sufficient image density is obtained in spite of silver iodide.

Thus, when the high silver iodide is used, it is necessary that the size of a silver halide grain is sufficiently smaller as compared with conventional silver bromide and silver iodide bromide having low iodine content for attaining sufficient maximum optical density. The average grain size of silver halide of high iodide content is preferably 5 nm to 100 nm, more preferably 5 nm to 70 nm. It is particularly preferably 5 nm to 55 nm. The grain size referred to here is observed by an electron microscope, and means the average diameter of a converted circle having the same area as the projected area.

Even in a case that silver halides differing in grain size may be blended for use, it is preferred that the grain size is respectively independently in the range mentioned above. Further, it is preferred that in the case that silver halides differing in grain size are used, a difference in average grain size between at least two kinds of silver halides is 20 nm to 95 nm, more preferably, 30 nm to 65 nm. As mentioned above, it is particularly important to control the grain size of silver halide with high content of silver iodide in the present invention, because grain size is a parameter having a big influence.

3) Application Amount

The application total amount of at least two kinds of silver halide grains is 0.5 mol % to 15 mol %, preferably 0.5 mol % to 12 mol %, further preferably 0.5 mol % to 10 mol % per one mol of silver of a non-photosensitive organic silver salt described later. It is more preferably 1 mol % to 9 mol %, particularly preferably 1 mol % to 7 mol %. For preventing remarkable development suppression by the silver halide having high iodide content found by the present inventors, selection of this application amount is extremely important.

4) Grain Formation Method

The method of forming a photosensitive silver halide is well known in the art, and for example, methods described in Research Disclosure No. 170929, June 1978 and U.S. Pat. No. 3,700,458 can be used, and specifically, a method is used in which a photosensitive silver halide is prepared by mixing a silver supplying compound and a halogen supplying compound into a solution of gelatin or other polymers, and then, mixing with an organic silver salt. Further, a method described in JP-A No. 11-119374, paragraph Nos. 0217 to 0224 and a method described in JP-A No. 11-352627 are also preferable.

5) Grain Form

Regarding the form of silver halide grains, listed are cube grains, octahedron grains, tetradecahedron grains, dodecahedron grains, flat plate grains, sphere grains, rod grains, potato grains and the like. Particularly, dodecahedron grains, tetradecahedron grains and flat plate grains are preferable.

The silver halide having high silver iodide content of the invention can take a complicated form, and as the preferable form, there are listed, for example, connecting grains as shown in R. L. JENKINS et al., J. of Phot. Sci. Vol. 28 (1980), p 164, FIG. 1. Flat plate grains as shown in FIG. 1 of the same literature can also be preferably used. Grains obtained by rounding corners of silver halide grains can also be preferably used. The surface index (Mirror index) of the outer surface of a photosensitive silver halide grains is not particularly restricted, and it is preferable that the ratio occupied by the [100] surface is rich, because of showing high spectral sensitization efficiency when a spectral sensitizing dye is adsorbed. The ratio is preferably 50% or more, more preferably 65% or more, further preferably 80% or more. The ratio of the [100] surface, Mirror index, can be determined by a method described in T. Tani; J. Imaging Sci., 29, 165 (1985) utilizing adsorption dependency of the [111] surface and [100] surface in adsorption of a sensitizing dye.

6) Heavy Metal

The photosensitive silver halide grain of the invention can contain metals or complexes of metals belonging to groups 8 to 10 of the periodic table (showing groups 1 to 18). The metal or the center metal of the metal complex from groups 8 to 10 of the periodic table is preferably rhodium, ruthenium or iridium. The metal complex may be used alone, or two or more kinds of complexes comprising identical or different species of metals may be used together. A preferred content is within a range from $1\times10^{-9}$ mol to $1\times10^{-3}$ mol per one mol of silver. The heavy metals, metal complexes and the addition method thereof are described in JP-A No. 7-225449, in paragraph Nos. 0018 to 0024 of JP-A No.11-65021 and in paragraph Nos. 0227 to 0240 of JP-A No. 11-119374.

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra(n-butyl) ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per one mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion forming step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion forming step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, redissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitization method are described in paragraph Nos. 0046 to 0050 of JP-A No.11-84574, in paragraph Nos. 0025 to 0031 of JP-A No.11-65021, and paragraph Nos. 0242 to 0250 of JP-A No.11-119374.

7) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and low molecular weight gelatin having a molecular weight of 500 to 60,000 is preferably used. These low molecular weight gelatins may be used at grain formation or at the time of dispersion after desalting treatment and it is preferably used during grain formation.

8) Chemical Sensitization

The photosensitive silver halide in this invention can be used without chemical sensitization, but is preferably chemically sensitized by at least one of chalcogen sensitization method, gold sensitization method and reduction sensitization method. The chalcogen sensitization method includes sulfur sensitization method, selenium sensitization method and tellurium sensitization method.

In sulfur sensitization, unstable sulfur compounds can be used. Such unstable sulfur compounds are described in P. Grafkides, Chemie et Pysique Photographique (Paul Momtel, 1987, 5th ed.,) and Research Disclosure (vol. 307, Item 307105), and the like.

As typical examples of sulfur sensitizer, known sulfur compounds such as thiosulfates(e.g., hypo), thioureas (e.g., diphenylthiourea, triethylthiourea, N-ethyl-N'-(4-methyl-2-thiazolyl)thiourea and carboxymethyltrimethylthiourea), thioamides (e.g., thioacetamide), rhodanines (e.g., diethylrhodanine, 5-benzylydene-N-ethylrhodanine), phosphinesulfides (e.g., trimethylphosphinesulfide), thiohydantoins, 4-oxo-oxazolidin-2-thione derivatives, disulfides or polysulfides (e.g., dimorphorinedisulfide, cystine, hexathiocanthione), polythionates, sulfur element and active gelatin can be used. Specifically, thiosulfates, thioureas and rhodanines are preferred.

In selenium sensitization, unstable selenium compounds can be used. These unstable selenium compounds are described in JP-B Nos.43-13489 and 44-15748, JP-A Nos.4-25832, 4-109340, 4-271341, 5-40324, and 5-11385 and the like.

As typical examples of selenium sensitizer, colloidal metal selenide, selenoureas (eg., N,N-dimethylselenourea, trifluoromethylcarbonyl-trimethylselenourea and acetyltrimethylselemourea), selenamides (eg., selenamide and N,N-diethylphenylselenamide), phosphineselenides (eg., triphenylphosphineselenide and pentafluorophenyl-triphenylphosphineselenide), selenophosphates (e.g., tri-p-tolylselenophosphate and tri-n-butylselenophosphate), selenoketones (e.g., selenobenzophenone), isoselenocyanates, selenocarbonic acids, selenoesters, diacylselenides can be used. Furthermore, non-unstable selenium compounds such as selenius acid, selenocyanic acid, selenazoles and selenides described in JP-B Nos. 46-4553 and 52-34492 can also be used. Specifically, phosphineselenides, selenoureas and salts of selenocyanic acids are preferred.

In the tellurium sensitization, unstable tellurium compounds are used. Unstable tellurium compounds described in JP-A Nos.4-224595, 4-271341, 4-333043, 5-303157, 6-27573, 6-175,258, 6-180478, 6-208186, 6-208184, 6-317867, 7-140579, 7-301879, 7-301880 and the like, can be used as tellurium sensitizer.

As typical examples of tellurium sensitizer, phosphinetellurides (e.g., butyl-diisopropylphosphinetelluride, tributylphosphinetelluride, tributoxyphosphinetelluride and ethoxy-diphenylphosphinetellride), diacyl(di)tellurides (e.g., bis(diphenylcarbamoyl)ditelluride, bis(N-phenyl-N-methylcarbamoyl)ditelluride, bis(N-phenyl-N-methylcarbamoyl) ditelluride, bis(N-phenyl-N-benzylcarbamoyl)telluride and bis(ethoxycarmonyl)telluride),telluroureas (e.g., N,N'-dimethylethylenetellurourea and N,N'-diphenylethylenetellurourea), telluramides, telluroesters are used. Specifically, diacyl(di)tellurides and phosphinetellurides are preferred. Especially, the compounds described in paragraph No. 0030 of JP-A No.11-65021 and compounds represented by the general formula [II], [III] and [IV] in JP-A No.5-313284 are more preferred.

Selenium sensitization and tellurium sensitization are preferred as chalcogen sensitization and specifically, tellurium sensitization is more preferred.

In gold sensitization, gold sensitizer described in P. Grafkides, Chemie et Pysique Photographique (Paul Momtel, 1987, 5th ed.,) and Research Disclosure (vol. 307, Item 307105) can be used. To speak concretely, chloroauric acid, potassium chloroaurate, potassium aurithiocyanate, gold sulfide, gold selenide and the like can be used. In addition to these, the gold compounds described in U.S. Pat. Nos. 2,642,361, 5,049,484, 5,049,485, 5,169,751, and 5,252,455, Belg. Patent No. 691857, and the like can also be used. And another novel metal salts except gold such as platinum, palladium, iridium and so on described in P. Grafkides, Chemie et Pysique Photographique (Paul Momtel, 1987, 5th ed.,) and Research Disclosure (vol. 307, Item 307,105) can be used.

The gold sensitization can be used independently, but it is preferably used in combination with the above chalcogen sensitization. Specifically, these sensitizations are gold-sulfur sensitization (gold-plus-sulfur sensitization ), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied at any time so long as it is after grain formation and before coating, and it can be applied, after desalting, (1) before spectral sensitization, (2) simultaneously with spectral sensitization, (3) after spectral sensitization and (4) just before coating.

The amount of chalcogen sensitizer used in the invention may vary depending on the silver halide grain used, the chemical ripening condition and the like and it is used by about $10^{-8}$ mol to $10^{-1}$ mol, preferably, $10^{-7}$ mol to $10^{-2}$ mol per one mol of the silver halide.

Similarly, the addition amount of the gold sensitizer used in the invention may vary depending on various conditions and it is generally about $10^{-7}$ mol to $10^{-3}$ mol and, more preferably, $10^{-6}$ mol to $5\times10^{-3}$ mol per one mol of the silver halide. There is no particular restriction on the condition for the chemical sensitization in the invention and, appropriately, pAg is 8 or less, preferably, 7.0 or less, more preferably, 6.5 or less and, particularly preferably, 6.0 or less, and pAg is 1.5 or more, preferably, 2.0 or more, particularly preferable, 2.5 or more, pH is 3 to 10, preferably, 4 to 9, and temperature is at 20° C. to 95° C., preferably, 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide or dimethylamine borane is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 8 or higher and pAg to 4 or lower for the emulsion, and it is also preferred to apply reduction sensitization by introducing a single addition portion of silver ions during grain formation.

The addition amount of the reduction sensitizer may also vary depending on various conditions and it is generally about $10^{-7}$ mol to $10^{-1}$ mol and, more preferably, $10^{-6}$ mol to $5\times10^{-2}$ mol per one mol of the silver halide.

In the silver halide emulsion used in the invention, a thiosulfonic acid compound may be added by the method shown in EP-A No. 293917.

The photosensitive silver halide grain in the invention can be chemically unsensitized, but is preferably chemically sensitized by at least one method of gold sensitization method and chalcogen sensitization method for the purpose of designing a high-photosensitive photothermographic material.

9) Compound that can be One-Electron-Oxidized to Provide a One-Electron Oxidation Product which Releases One or More Electrons The photothermographic material of the invention preferably contains a compound that can be one-electron-oxidized to provide a one-electron oxidation product which releases one or more electrons.

As the compound that can be one-electron-oxidized to provide a one-electron oxidation product which releases one or more electrons is a compound selected from the following types 1 to 5.

(Type 1) a compound that can be one-electron-oxidized to provide a one-electron oxidation product which further releases at least two electrons, due to when subjected to a subsequent bond cleavage reaction;

(Type 2) a compound that has at least two groups adsorbable to the silver halide and can be one-electron-oxidized to provide a one-electron oxidation product which further releases one electron, due to when subjected to a subsequent bond cleavage reaction;

(Type 3) a compound that can be one-electron-oxidized to provide a one-electron oxidation product, which further releases at least one electron after being subjected to a subsequent bond formation;

(Type 4) a compound that can be one-electron-oxidized to provide a one-electron oxidation product which further releases at least one electron after a subsequent ring cleavage reaction in the molecule; and (Type 5) a compound represented by X—Y, in which X represents a reducing group and Y represents a leaving group, and convertable by one-electron-oxidizing the reducing group to a one-electron oxidation product which can be converted into an X radical by eliminating the leaving group in a subsequent X—Y bond cleavage reaction, one electron being released from the X radical.

Each compound of Types 3 to 5 preferably is "a compound having a sensitizing dye moiety" or "a compound having an adsorbable group to the silver halide". More preferred is "a compound having an adsorbable group to the silver halide". More preferably, each compound of Types 1 to 4 is "a compound having a heterocyclic group containing nitrogen atom substituted by more than two mercapto groups".

The compound of Type 1 to 5 will be described below in detail.

In the compound of Type 1, the term "the bond cleavage reaction" specifically means a cleavage reaction of a bond of carbon-carbon, carbon-silicon, carbon-hydrogen, carbon-boron, carbon-tin or carbon-germanium. Cleavage of a carbon-hydrogen bond may be followed after the cleavage reaction. The compound of Type 1 can be one-electron-oxidized to be converted into the one-electron oxidation product, and thereafter can release further two or more electrons, preferably three or more electrons with the bond cleavage reaction.

The compound of Type 1 is preferably represented by any one of general formulae (A), (B), (1), (2) or (3).

General formula (A)

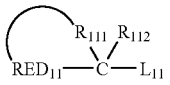

General formula (B)

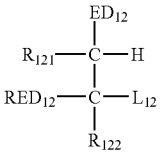

In the general formula (A), $RED_{11}$ represents a reducing group that can be one-electron-oxidized, and $L_{11}$ represents a leaving group. $R_{112}$ represents a hydrogen atom or a substituent. $R_{111}$ represents a nonmetallic atomic group forming a tetrahydro-, hexahydro- or octahydro-derivative of a 5- or 6-membered aromatic ring including aromatic heterocycles.

In the general formula (B), $RED_{12}$ represents a reducing group that can be one-electron-oxidized, and $L_{12}$ represents a leaving group. $R_{121}$ and $R_{122}$ each represent a hydrogen atom or a substituent. $ED_{12}$ represents an electron-donating group. In the general formula (B), $R_{121}$ and RED12, $R_{121}$ and $R_{122}$, and $ED_{12}$ and $RED_{12}$ may bond together to form a ring structure, respectively.

In the compound represented by the general formula (A) or (B), the reducing group of $RED_{11}$ or $RED_{12}$ is one-electron-oxidized, and thereafter the leaving group of $L_{11}$ or $L_{12}$ is spontaneously eliminated in the bond cleavage reaction. Further two or more, preferably three or more electrons can be released with the bond cleavage reaction.

General formula (1)

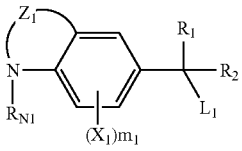

-continued

General formula (2)

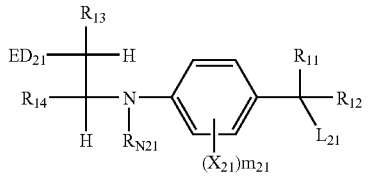

General formula (3)

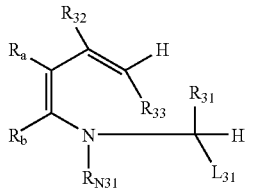

In the general formula (1), $Z_1$ represents an atomic group forming a 6-membered ring with a nitrogen atom and 2 carbon atoms in a benzene ring; $R_1$, $R_2$ and $R_{N1}$ each represent a hydrogen atom or a substituent; $X_1$ represents a substituent capable of substituting for a hydrogen atom on a benzene ring; $m_1$ represents an integer of 0 to 3; and $L_1$ represents a leaving group. In the general formula (2), $ED_{21}$ represents an electron-donating group; $R_{11}$, $R_{12}$, $R_{N21}$, $R_{13}$ and $R_{14}$ each represent a hydrogen atom or a substituent; $X_{21}$ represents a substituent capable of substituting for a hydrogen atom on a benzene ring; $m_{21}$ represents an integer of 0 to 3; and $L_{21}$ represents a leaving group. $R_{N21}$, $R_{13}$, $R_{14}$, $X_{21}$ and $ED_{21}$ may bond to each other to form a ring structure. In the general formula (3), $R_{32}$, $R_{33}$, $R_{31}$, $R_{N31}$, $R_a$ and $R_b$ each represent a hydrogen atom or a substituent; and $L_{31}$ represents a leaving group. Incidentally, $R_a$ and $R_b$ bond together to form an aromatic ring when $R_{N31}$ is not an aryl group.

After the compound is one-electron-oxidized, the leaving group of $L_1$, $L_{21}$ or $L_{31}$ is spontaneously eliminated in the bond cleavage reaction. Further two or more, preferably three or more electrons can be released with the bond cleavage reaction.

First, the compound represented by the general formula (A) will be described in detail below.

In the general formula (A), the reducing group of $RED_{11}$ can be one-electron-oxidized and can bond to after-mentioned $R_{111}$ to form the particular ring structure. Specifically, the reducing group may be a divalent group provided by removing one hydrogen atom from the following monovalent group at a position suitable for ring formation.

The monovalent group may be an alkylamino group; an arylamino group such as an anilino group and a naphthylamino group; a heterocyclic amino group such as a benzthiazolylamino group and a pyrrolylamino group; an alkylthio group; an arylthio group such as a phenylthio group; a heterocyclic thio group; an alkoxy group; an aryloxy group such as a phenoxy group; a heterocyclic oxy group; an aryl group such as a phenyl group, a naphthyl group and an anthranil group; or an aromatic or nonaromatic heterocyclic group, containing at least one heteroatom selected from the group consisting of a nitrogen atom, a sulfur atom, an oxygen atom and a selenium atom, which has a 5- to 7-membered, monocyclic or condensed ring structure such as a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, an imidazole ring, a thiazoline ring, a piperidine ring, a pyrrolidine ring, a morpholine ring, a benzimidazole ring, a benzimidazoline ring, a benzoxazoline ring and a methylenedioxyphenyl ring. $RED_{11}$ is hereinafter described as the monovalent group for convenience. The monovalent groups may have a substituent.

Examples of the substituent include halogen atoms; alkyl groups including aralkyl groups, cycloalkyl groups, active methine groups, etc.; alkenyl groups; alkynyl groups; aryl groups; heterocyclic groups, which may bond at any position; heterocyclic groups containing a quaternary nitrogen atom such as a pyridinio group, an imidazolio group, a quinolinio group and an isoquinolinio group; acyl groups; alkoxycarbonyl groups; aryloxycarbonyl groups; carbamoyl groups; a carboxy group and salts thereof; sulfonylcarbamoyl groups; acylcarbamoyl groups; sulfamoylcarbamoyl groups; carbazoyl groups; oxalyl groups; oxamoyl groups; a cyano group; carbonimidoyl groups; thiocarbamoyl groups; a hydroxy group; alkoxy groups, which may contain a plurality of ethyleneoxy groups or propyleneoxy groups as a repetition unit; aryloxy groups; heterocyclic oxy groups; acyloxy groups; alkoxy or aryloxy carbonyloxy groups; carbamoyloxy groups; sulfonyloxy groups; amino groups; alkyl, aryl or heterocyclic amino groups; acylamino groups; sulfoneamide groups; ureide groups; thioureide groups; imide groups; alkoxy or aryloxy carbonylamino groups; sulfamoylamino groups; semicarbazide groups; thiosemicarbazide groups; hydrazino groups; ammonio groups; oxamoylamino groups; alkyl or aryl sulfonylureide groups; acylureide groups; acylsulfamoylamino groups; a nitro group; a mercapto group; alkyl, aryl or heterocyclic thio groups; alkyl or aryl sulfonyl groups; alkyl or aryl sulfinyl groups; a sulfo group and salts thereof; sulfamoyl groups; acylsulfamoyl groups; sulfonylsulfamoyl groups and salts thereof; groups containing a phosphoric amide or phosphate ester structure; etc. These substituents may be further substituted by these substituents.

$RED_{11}$ is preferably an alkylamino group, an arylamino group, a heterocyclic amino group, an aryl group, an aromatic heterocyclic group, or nonaromatic heterocyclic group. $RED_{11}$ is more preferably an arylamino group (particularly an anilino group), or an aryl group (particularly a phenyl group). When $RED_{11}$ has a substituent, preferred as a substituent include halogen atoms, alkyl groups, alkoxy groups, carbamoyl groups, sulfamoyl groups, acylamino groups, sulfoneamide groups. When $RED_{11}$ is an aryl group, it is preferred that the aryl group has at least one "electron-donating group". The "electron-donating group" is a hydroxy group; an alkoxy group; a mercapto group; a sulfoneamide group; an acylamino group; an alkylamino group; an arylamino group; a heterocyclic amino group; an active methine group; an electron-excess, aromatic, heterocyclic group with a 5-membered monocyclic ring or a condensed-ring including at least one nitrogen atom in the ring such as an indolyl group, a pyrrolyl group, an imidazolyl group, a benzimidazolyl group, a thiazolyl group, a benzthiazolyl group and an indazolyl group; a nitrogen-containing, nonaromatic heterocyclic group that substituts at the nitrogen atom, such as so-called cyclic amino group like pyrrolidinyl group, an indolinyl group, a piperidinyl group, a piperazinyl group and a morpholino group; etc.

The active methine group is a methine group having two "electron-withdrawing groups", and the "electron-withdrawing group" is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The two electron-withdrawing groups may bond together to form a ring structure.

In the general formula (A), specific examples of $L_{11}$ include a carboxy group and salts thereof, silyl groups, a hydrogen atom, triarylboron anions, trialkylstannyl groups, trialkylgermyl groups and a —$CR_{C1}R_{C2}R_{C3}$ group. When $L_{11}$ represents a silyl group, the silyl group is specifically a trialkylsilyl group, an aryldialkylsilyl group, a triarylsilyl group, etc, and they may have a substituent.

When $L_{11}$ represents a salt of a carboxy group, specific examples of a counter ion to form the salt include alkaline metal ions, alkaline earth metal ions, heavy metal ions, ammonium ions, phosphonium ions, etc. Preferred as a counter ion are alkaline metal ions and ammonium ions, most preferred are alkaline metal ions such as $Li^+$, $Na^+$ and $K^+$.

When $L_{11}$ represents a —$CR_{C1}R_{C2}R_{C3}$ group, $R_{C1}$, $R_{C2}$ and $R_{C3}$ independently represent a hydrogen atom, an alkyl group, an aryl group, a heterocyclic group, an alkylthio group, an arylthio group, an alkylamino group, an arylamino group, a heterocyclic amino group, an alkoxy group, an aryloxy group or a hydroxy group. $R_{C1}$, $R_{C2}$ and $R_{C3}$ may bond to each other to form a ring structure, and may have a substituent. Incidentally, when one of $R_{C1}$, $R_{C2}$ and $R_{C3}$ is a hydrogen atom or an alkyl group, there is no case where the other two of them are a hydrogen atom or an alkyl group. $R_{C1}$, $R_{C2}$ and $R_{C3}$ are preferably an alkyl group, an aryl group (particularly a phenyl group), an alkylthio group, an arylthio group, an alkylamino group, an arylamino group, a heterocyclic group, an alkoxy group or a hydroxy group, respectively. Specific examples thereof include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group, a hydroxy group, etc. Examples of the ring structure formed by $R_{C1}$, $R_{C2}$ and $R_{C3}$ include a 1,3-dithiolane-2-yl group, a 1,3-dithiane-2-yl group, an N-methyl-1,3-thiazolidine-2-yl group, an N-benzyl-benzothiazolidine-2-yl group, etc.

It is also preferred that the —$CR_{C1}R_{C2}R_{C3}$ group is the same as a residue provided by removing $L_{11}$ from the general formula (A) as a result of selecting each of $R_{C1}$, $R_{C2}$ and $R_{C3}$ as above.

In the general formula (A), $L_{11}$ is preferably a carboxy group or a salt thereof, or a hydrogen atom, more preferably a carboxy group or a salt thereof.

When $L_{11}$ represents a hydrogen atom, the compound represented by the general formula (A) preferably has a base moiety. After the compound represented by the general formula (A) is oxidized, the base moiety acts to eliminate the hydrogen atom of $L_{11}$ and to release an electron.

The base is specifically a conjugate base of an acid with a pKa value of approximately 1 to 10. For example, the base moiety may contain a structure of a nitrogen-containing heterocycle such as pyridine, imidazole, benzoimidazole and thiazole; aniline; trialkylamine; an amino group; a carbon acid such as an active methylene anion; a thioacetic acid anion; carboxylate (—$COO^-$); sulfate (—$SO_3^-$); amineoxide (>$N^+(O^-)$—); and derivatives thereof. The base is preferably a conjugate base of an acid with a pKa value of approximately 1 to 8, more preferably carboxylate, sulfate or amineoxide, particularly preferably carboxylate. When these bases have an anion, the compound of the general formula (A) may have a counter cation. Examples of the counter cation include alkaline metal ions, alkaline earth metal ions, heavy metal ions, ammonium ions, phosphonium ions, etc. The base moiety may be at an optional position of the compound represented by the general formula (A). The base moiety may be connected to $RED_{11}$, $R_{111}$ or $R_{112}$ in the general formula (A), and to a substituent thereon.

In the general formula (A), $R_{112}$ represents a substituent capable of substituting a hydrogen atom or a carbon atom therewith, provided that $R_{112}$ and $L_{11}$ do not represent the same group.

$R_{112}$ preferably represents a hydrogen atom, an alkyl group, an aryl group (such as a phenyl group), an alkoxy group (such as a methoxy group, a ethoxy group, a benzyloxy group), a hydroxy group, an alkylthio group, (such as a methylthio group, a butylthio group), and amino group, an alkylamino group, an arylamino group, a heterocyclic amino group or the like; and more preferably represents a hydrogen atom, an alkyl group, an alkoxy group, a hydroxy group, a phenyl group and an alkylamino group.

Ring structures formed by $R_{111}$ in the general formula (A) are ring structure corresponding to a tetrahydro structure, a hexahydro structure, or an octahydro structure of a five-membered or six-membered aromatic ring (including an aromatic hetro ring), wherein a hydro structure means a ring structure in which partial hydrogenation is performed on a carbon-carbon double bond (or a carbon-nitrogen double bond) contained in an aromatic ring (an aromatic hetero ring) as a part thereof, wherein the tetrahydro structure is a structure in which 2 carbon-carbon double bonds (or carbon-nitrogen double bonds) are hydrogenated, the hexahydro structure is a structure in which 3 carbon-carbon double bonds (or carbon-nitrogen double bonds) are hydrogenated, and the octahydro structure is a structure in which 4 carbon-carbon double bonds (or carbon-nitrogen double bonds) are hydrogenated. Hydrogenation of an aromatic ring produces a partially hydrogenated non-aromatic ring structure.

Concrete examples include a pyrrolidine ring, an imidazolidine ring, a thiazolidine ring, a pyrazolidine ring, an oxazolidine ring, a piperidine ring, a tetrahydropyridine ring, a tetrahydropyrimidine ring, a piperazine ring, a tetralin ring, a tetrahydroquinoline ring, a tetrahydroisoquinoline ring, a tetrahydroquinazoline ring and a tetrahydroquinoxaline ring, a tetrahydrocarbazole ring, an octahydrophenanthridine ring and the like. The ring structures may have any substituent therein.

More preferable examples of a ring structure forming $R_{111}$ include a pyrrolidine ring, an imidazolidine ring, a piperidine ring, a tetrahydropyridine ring, a tetrahydropyrimidine ring, a piperazine ring, a tetrahydroquinoline ring, a tetrahydroisoquinoline ring, a tetrahydroquinazoline ring, a tetrahydroquinoxaline ring and a tetracarbazole ring. Particularly preferable examples include a pyrrolidine ring, a piperidine ring, a piperazine ring, a tetrahydropyridine ring, a tetrahydroquinoline ring, a tetrahydroisoquinoline ring, a tetrahydroquinazoline ring and a tetrahydroquinoxaline ring; and most preferable examples include a pyrrolidine ring, a piperidine ring, a tetrahydropyridine ring, a tetrahydroquinoline ring and a tetrahydroisoquinoline ring.

In the general formula (B), $RED_{12}$ and $L_{12}$ represent groups having the respective same meanings as $RED_{11}$ and $L_{00}$ in the general formula (A), and have the respective same preferable ranges as $RED_{11}$ and $L_{11}$ in the general formula (A). $RED_{12}$ is a monovalent group except a case where $RED_{12}$ forms the following ring structure and to be concrete, there are exemplified groups each with a name of a monovalent group described as $RED_{11}$. $RED_{121}$ and $L_{122}$ represent groups having the same meaning as $R_{112}$ in the general formula (A), and have the same preferable range as $R_{112}$ in the general formula (A). $ED_{12}$ represents an electron-donating group.

Each pair of $R_{121}$ and $RED_{12}$; $R_{121}$ and $R_{122}$; or $ED_{12}$ and $RED_{12}$ may form a ring structure by bonding with each other.

An electron-donating group represented by $RED_{12}$ in the general formula (B) is the same as an electron-donating group described as a substituent when $RED_{11}$ represents an aryl group. Preferable examples of $RED_{12}$ include a hydroxy group, an alkoxy group, a mercapto group, a sulfonamide group, an alkylamino group, an arylamino group, an active methine group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute, and a phenyl group substituted with an electron donating group described above, and more preferable examples thereof include a non-aromatic nitrogen containing heterocyclic group further substituted with a hydroxy group, a mercapto group, a sulfonamide group, an alkylamino group, an arylamino group, an active methine group, or a nitrogen atom; and a phenyl group substituted with an electron-donating group described above (for example, a p-hydroxyphenyl group, a p-dialkylaminophenyl group, an o- or p-dialkoxyphenyl group and the like).

In the general formula (B), $R_{121}$ and $RED_{12}$; $R_{122}$ and $R_{121}$; or $ED_{12}$ and $RED_{12}$ may bond to each other to form a ring structure. A ring structure formed here is a non-aromatic carbon ring or hetero ring in a 5- to 7-membered single ring or fused ring structure which is substituted or unsubstituted. Concrete examples of a ring structure formed from $R_{121}$ and RED12 include, in addition to the examples of the ring structure formed by $R_{111}$ in the general formula (A), a pyrroline ring, an imidazoline ring, a thiazoline ring, a pyrazoline ring, an oxazoline ring, an indan ring, a morphorine ring, an indoline ring, a tetrahydro-1,4-oxazine ring, 2,3-dihydrobenzo-1,4-oxazine ring, a tetrahydro-1,4-thiazine ring, 2,3-dihydrobenzo-1,4-thiazine ring, 2,3-dihydrobenzofuran ring, 2,3-dihydrobenzothiophene ring and the like. In formation of a ring structure from $ED_{12}$ and $RED_{12}$, $ED_{12}$ is preferably an amino group, an alkylamino group or an arylamino group and concrete examples of the ring structure include a tetrahyropyrazine ring, a piperazine ring, a tetrahydroquinoxaline ring, a tetrahydroisoquinoline ring and the like. Concrete examples of a ring structure formed from $R_{122}$ and $R_{121}$ include a cyclohexane ring, a cyclopentane ring and the like.

Then, description will be given of the general formulae (1) to (3).

In the general formulae (1) to (3), $R_1$, $R_2$, $R_{11}$, $R_{12}$ and $R_{31}$ represent the same meaning as $R_{112}$ of the general formula (A) and have the same preferable range as $R_{112}$ of the general formula (A). $L_1$, $L_{21}$ and $L_{31}$ independently represents the same leaving groups as the groups shown as concrete examples in description of $L_{11}$ of the general formula (A) and also have the same preferable range as $L_{11}$ of the general formula (A). The substituents represented by $X_1$ and $X_{21}$ are the same as the examples of substituents of $RED_{11}$ of the general formula (A) and have the same preferable range as $RED_1$, of the general formula (A). $m_1$ and $m_2$ are preferably integers from 0 to 2 and more preferably integers of 0 or 1.

When $R_{N1}$, $R_{N21}$ and $R_{N31}$ each represents a substituent, preferred as a substituent include an alkyl group, an aryl group or a heterocyclic group, and may further have a substituent. Each of $R_{N1}$, $R_{N21}$ and $R_{N31}$ is preferably a hydrogen atom, an alkyl group or an aryl group, more preferably a hydrogen atom or an alkyl group.

When $R_{13}$, $R_{14}$, $R_{32}$, $R_{33}$, $R_a$ and $R_b$ independently represent a substituent, the substituent is preferably an alkyl group, an aryl group, an acyl group, an alkoxycarbonyl group, a carbamoyl group, a cyano group, an alkoxy group, an acylamino group, a sulfoneamide group, a ureide group, a thioureide group, an alkylthio group, an arylthio group, an alkylsulfonyl group, an arylsulfonyl group, or a sulfamoyl group.

The 6-membered ring formed by $Z_1$ in the general formula (1) is a nonaromatic heterocycle condensed with the benzene ring in the general formula (1). The ring structure containing the nonaromatic heterocycle and the benzene ring to be condensed may be specifically a tetrahydroquinoline ring, a tetrahydroquinoxaline ring, or a tetrahydroquinazoline ring, which may have a substituent.

In the general formula (2), $ED_{21}$ is the same as $ED_{12}$ in the general formula (B) with respect to the meanings and preferred embodiments.

In the general formula (2), any two of $R_{N21}$, $R_{13}$, $R_{14}$, $X_{21}$ and $ED_{21}$ may bond together to form a ring structure. The ring structure formed by $R_{N21}$ and $X_{21}$ is preferably a 5- to 7-membered, carbocyclic or heterocyclic, nonaromatic ring structure condensed with a benzene ring, and specific examples thereof include a tetrahydroquinoline ring, a tetrahydroquinoxaline ring, an indoline ring, a 2,3-dihydro-5,6-benzo-1,4-thiazine ring, etc. Preferred are a tetrahydroquinoline ring, a tetrahydroquinoxaline ring and an indoline ring.

When $R_{N31}$ is a group other than an aryl group in the general formula (3), $R_a$ and $R_b$ bond together to form an aromatic ring. The aromatic ring is an aryl group such as a phenyl group and a naphthyl group, or an aromatic heterocyclic group such as a pyridine ring group, a pyrrole ring group, a quinoline ring group and an indole ring group, preferably an aryl group. The aromatic ring group may have a substituent.

In the general formula (3), $R_a$ and $R_b$ preferably bond together to form an aromatic ring, particularly a phenyl group.

In the general formula (3), $R_{32}$ is preferably a hydrogen atom, an alkyl group, an aryl group, a hydroxy group, an alkoxy group, a mercapto group or an amino group. When $R_{32}$ is a hydroxy group, $R_{33}$ is preferably an "electron-withdrawing group". The "electron-withdrawing group" is the same as mentioned above, and is preferably an acyl group, an alkoxycarbonyl group, a carbamoyl group or a cyano group.

The compound of Type 2 will be described below.

According to the compound of Type 2, "the bond cleavage reaction" is a cleavage reaction of a bond of carbon-carbon, carbon-silicon, carbon-hydrogen, carbon-boron, carbon-tin or carbon-germanium. Cleavage of a carbon-hydrogen bond may be caused with the cleavage reaction.

The compound of Type 2 has two or more, preferably 2 to 6, more preferably 2 to 4, adsorbent groups to the silver halide. The adsorbable group is further preferably a mercapto-substituted, nitrogen-containing, heterocyclic group. The number of the adsorbent groups is preferably 2 to 6, more preferably 2 to 4. The adsorbable group will hereinafter be described.

The compound of Type 2 is preferably represented by the following general formula (C).

General formula (C)

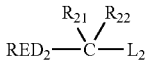

In the compound represented by the general formula (C), the reducing group of $RED_2$ is one-electron-oxidized, and thereafter the leaving group of $L_2$ is spontaneously eliminated, thus a C (carbon atom) -$L_2$ bond is cleaved, in the bond cleavage reaction. Further 1 electron can be released with the bond cleavage reaction.

In the general formula (C), $RED_2$ is the same as $RED_{12}$ in the general formula (B) with respect to the meanings and preferred embodiments. $L_2$ is the same as $L_{11}$ in the general formula (A) with respect to the meanings and preferred embodiments. Incidentally, when $L_2$ is a silyl group, the compound of the general formula (C) has 2 or more mercapto-substituted, nitrogen-containing, heterocyclic groups as the adsorbent groups. $R_{21}$ and $R_{22}$ each represent a hydrogen atom or a substituent, and are the same as $R_{112}$ in the general formula (A) with respect to the meanings and preferred embodiments. $RED_2$ and $R_{21}$ may bond together to form a ring structure.

The ring structure is a 5- to 7-membered, monocyclic or condensed, carbocyclic or heterocyclic, nonaromatic ring, and may have a substituent. Incidentally, there is no case where the ring structure corresponds to a tetrahydro-, hexahydro- or octahydro-derivative of an aromatic ring or an aromatic heterocycle. The ring structure is preferably such that corresponds to a dihydro-derivative of an aromatic ring or an aromatic heterocycle, and specific examples thereof include a 2-pyrroline ring, a 2-imidazoline ring, a 2-thiazoline ring, a 1,2-dihydropyridine ring, a 1,4-dihydropyridine ring, an indoline ring, a benzoimidazoline ring, a benzothiazoline ring, a benzoxazoline ring, a 2,3-dihydrobenzothiophene ring, a 2,3-dihydrobenzofuran ring, a benzo-α-pyran ring, a 1,2-dihydroquinoline ring, a 1,2-dihydroquinazoline ring, a 1,2-dihydroquinoxaline ring, etc. Preferred are a 2-imidazoline ring, a 2-thiazoline ring, an indoline ring, a benzoimidazoline ring, a benzothiazoline ring, a benzoxazoline ring, a 1,2-dihydro pyridine ring, a 1,2-dihydroquinoline ring, a 1,2-dihydroquinazoline ring and a 1,2-dihydroquinoxaline ring, more preferred are an indoline ring, a benzoimidazoline ring, a benzothiazoline ring and a 1,2-dihydroquinoline ring, particularly preferred is an indoline ring.

The compound of Type 3 will be described below.

According to the compound of Type 3, "bond formation" means that a bond of carbon-carbon, carbon-nitrogen, carbon-sulfur, carbon-oxygen, etc. is formed.

It is preferable that the one-electron oxidation product releases one or more electron after an intramolecular bond-forming reaction between the one-electron-oxidized portion and a reactive site in the same molecular such as a carbon-carbon double bond, a carbon-carbon triple bond, an aromatic group and a benzo-condensed, nonaromatic heterocyclic group.

To be more detailed, a one-electron oxidized product (a cation radical species or a neutral radical species generated by elimination of a proton therefrom) formed by one electron oxidizing a compound of type 3 reacts with a reactive group described above coexisting in the same molecule to form a bond and form a radical species having a new ring structure therein. The radical species have a feature to release a second electron directly or in company with elimination of a proton therefrom. One of compounds of type 3 has a chance to further release one or more electrons, in a ordinary case two or more electrons, after formation of a two-electron oxidized product, after receiving a hydrolysis reaction in one case or after causing a tautomerization reaction accompanying direct migration of a proton in another case. Alternatively, compounds of type 3 also include a compound having an ability to further release one or more electron, in an ordinary case two or more electrons directly from a two-electron oxidized product, not by way of a tautomerization reaction.

The compound of Type 3 is preferably represented by the following general formula (D).

General formula (D)

$$RED_3—L_3—Y_3$$

In the general formula (D), $RED_3$ represents a reducing group that can be one-electron-oxidized, and $Y_3$ represents a reactive group that reacts with the one-electron-oxidized $RED_3$, specifically an organic group containing a carbon-carbon double bond, a carbon-carbon triple bond, an aromatic group or a benzo-condensed, nonaromatic heterocyclic group. $L_3$ represents a linking group that connects $RED_3$ and $Y_3$.

In the general formula (D), $RED_3$ has the same meanings as $RED_{12}$ in the general formula (B). In the general formula (D), $RED_3$ is preferably an arylamino group, a heterocyclic amino group, an aryloxy group, an arylthio group, an aryl group, or an aromatic or nonaromatic heterocyclic group that is preferably a nitrogen-containing heterocyclic group. $RED_3$ is more preferably an arylamino group, a heterocyclic amino group, an aryl group, or an aromatic or nonaromatic heterocyclic group. Preferred as the heterocyclic group are a tetrahydroquinoline ring group, a tetrahydroquinoxaline ring group, a tetrahydroquinazoline ring group, an indoline ring group, an indole ring group, a carbazole ring group, a phenoxazine ring group, a phenothiazine ring group, a benzothiazoline ring group, a pyrrole ring group, an imidazole ring group, a thiazole ring group, a benzoimidazole ring group, a benzoimidazoline ring group, a benzothiazoline ring group, a 3,4-methylenedioxyphenyl-1-yl group, etc.

Particularly preferred as $RED_3$ are an arylamino group (particularly an anilino group), an aryl group (particularly a phenyl group), and an aromatic or nonaromatic heterocyclic group.

The aryl group represented by $RED_3$ preferably has at least one electron-donating group. The term "electron-donating group" means the same as above-mentioned electron-donating group.

When $RED_3$ is an aryl group, more preferred as a substituent on the aryl group are an alkylamino group, a hydroxy group, an alkoxy group, a mercapto group, a sulfoneamide group, an active methine group, and a nitrogen-containing, nonaromatic heterocyclic group that substitutes at the nitrogen atom, furthermore preferred are an alkylamino group, a hydroxy group, an active methine group, and a nitrogen-containing, nonaromatic heterocyclic group that substitutes at the nitrogen atom, and the most preferred are an alkylamino group, and a nitrogen-containing, nonaromatic heterocyclic group that substitutes at the nitrogen atom.

When $Y_3$ is an organic group containing carbon-carbon double bond (for example a vinyl group) having a substituent, more preferred as the substituent are an alkyl group, a phenyl group, an acyl group, a cyano group, an alkoxycarbonyl group, a carbamoyl group and an electron-donating group. The electron-donating group is preferably an alkoxy group; a hydroxy group (that may be protected by a silyl group, and examples of the silyl-protected group include a trimethylsilyloxy group, a t-butyldimethylsilyloxy group, a triphenylsilyloxy group, a triethylsilyloxy group, a phenyldimethylsilyloxy group, etc); an amino group; an alkylamino group; an arylamino group; a sulfoneamide group; an active methine group; a mercapto group; an alkylthio group; or a phenyl group having the electron-donating group as a substituent.

Incidentally, when the organic group containing the carbon-carbon double bond has a hydroxy group as a substituent, $Y_3$ contains a moiety of $>C_1{=}C_2(—OH)—$, which may be tautomerized into a moiety of $>C_1H—C_2({=}O)—$. In this case, it is preferred that a substituent on the $C_1$ carbon is an electron-withdrawing group, and as a result, $Y_3$ has a moiety of an "active methylene group" or an "active methine group". The electron-withdrawing group, which can provide such a moiety of an active methylene group or an active methine group, may be the same as above-mentioned electron-withdrawing group on the methine group of "the active methine group".

When $Y_3$ is an organic group containing a carbon-carbon triple bond (for example a ethynyl group) having a substituent, preferred as the substituent are an alkyl group, a phenyl group, an alkoxycarbonyl group, a carbamoyl group, an electron-donating group, etc.

When $Y_3$ is an organic group containing an aromatic group, preferred as the aromatic group is an aryl group, particularly a phenyl group, having an electron-donating group as a substituent, and an indole ring group. The electron-donating group is preferably a hydroxy group, which may be protected by a silyl group; an alkoxy group; an amino group; an alkylamino group; an active methine group; a sulfoneamide group; or a mercapto group.

When $Y_3$ is an organic group containing a benzo-condensed, nonaromatic heterocyclic group, preferred as the benzo-condensed, nonaromatic heterocyclic group are groups having an aniline moiety, such as an indoline ring group, a 1,2,3,4-tetrahydroquinoline ring group, a 1,2,3,4-tetrahydroquinoxaline ring group and a 4-quinolone ring group.

The reactive group of $Y_3$ is more preferably an organic group containing a carbon-carbon double bond, an aromatic group, or a benzo-condensed, nonaromatic heterocyclic group. Furthermore preferred are an organic group containing a carbon-carbon double bond; a phenyl group having an electron-donating group as a substituent; an indole ring group; and a benzo-condensed, nonaromatic heterocyclic group having an aniline moiety. The carbon-carbon double bond more preferably has at least one electron-donating group as a substituent.

It is also preferred that the reactive group represented by $Y_3$ contains a moiety the same as the reducing group represented by $RED_3$ as a result of selecting the reactive group as above.

$L_3$ represents a linking group that connects $RED_3$ and $Y_3$, specifically a single bond, an alkylene group, an arylene group, a heterocyclic group, —O—, —S—, —$NR_N$—, —C(=O)—, —$SO_2$—, —SO—, —P(=O)—, or a combination thereof. $R_N$ represents a hydrogen atom, an alkyl group, an aryl group or a heterocyclic group. The linking group represented by $L_3$ may have a substituent. The linking group represented by $L_3$ may bond to each of $RED_3$ and $Y_3$ at an optional position such that the linking group substitutes optional one hydrogen atom of each $RED_3$ and $Y_3$. Preferred examples of $L_3$ include a single bond; alkylene groups, particularly a methylene group, an ethylene group or a propylene group; arylene groups, particularly a phenylene group; a —C(=O)— group; a —O— group; a —NH— group; —N(alkyl)-groups; and divalent linking groups of combinations thereof.

When a cation radical ($X^{+}$•) provided by oxidizing $RED_3$ or a radical (X•) provided by eliminating a proton therefrom reacts with the reactive group represented by $Y_3$ to form a bond, it is preferable that they form a 3 to 7-membered ring structure containing the linking group represented by $L_3$. Thus, the radical ($X^{+}$• or X•) and the reactive group of Y are preferably connected though 3 to 7 atoms.

Next, the compound of Type 4 will be described below.

The compound of Type 4 has a reducing group-substituted ring structure. After the reducing group is one-electron-oxidized, the compound can release further one or more electron with a ring structure cleavage reaction. The ring cleavage reaction proceeds as follows.

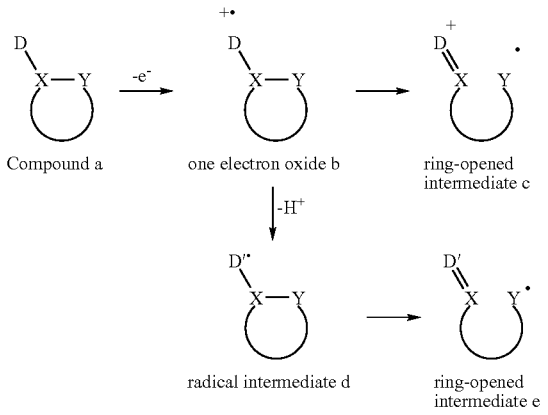

In the formula, compound a is the compound of Type 4. In compound a, D represents a reducing group, and X and Y each represent an atom forming a bond in the ring structure, which is cleaved after the one-electron oxidation. First, compound a is one-electron-oxidized to generate one-electron oxidation product b. Then, the X—Y bond is cleaved with conversion of the D-X single bond into a double bond, whereby ring-opened intermediate c is provided. Alternatively, there is a case where one-electron oxidation product b is converted into radical intermediate d with deprotonation, and ring-opened intermediate e is provided in the same manner. Subsequently, further one or more electrons are released form thus-provided ring-opened intermediate c or e.

The ring structure in the compound of Type 4 is a 3 to 7-membered, carbocyclic or heterocyclic, monocyclic or condensed, saturated or unsaturated, nonaromatic ring. The ring structure is preferably a saturated ring structure, more preferably 3- or 4-membered ring. Preferred examples of the ring structure include a cyclopropane ring, a cyclobutane ring, an oxirane ring, an oxetane ring, an aziridine ring, an azetidine ring, an episulphide ring and a thietane ring. More preferred are a cyclopropane ring, a cyclobutane ring, an oxirane ring, an oxetane ring and an azetidine ring, particularly preferred are a cyclopropane ring, a cyclobutane ring and an azetidine ring. The ring structure may have a substituent.

The compound of Type 4 is preferably represented by the following general formula (E) or (F).

General formula (E)

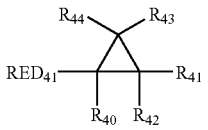

General formula (F)

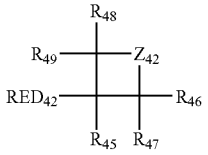

In the general formulae (E) and (F), $RED_{41}$ and $RED_{42}$ are the same as $RED_{12}$ in the general formula (B) with respect to the meanings and preferred embodiments, respectively. $R_{40}$ to $R_{44}$ and $R_{45}$ to $R_{49}$ each represents a hydrogen atom or a substituent. In the general formula (F), $Z_{42}$ represents —$CR_{420}R_{421}$—, —$NR_{423}$—, or —O—. $R_{420}$ and $R_{421}$ each represent a hydrogen atom or a substituent, and $R_{423}$ represents a hydrogen atom, an alkyl group, an aryl group or a heterocyclic group.

In the general formulae (E) and (F), each of $R_{40}$ and $R_{45}$ is preferably a hydrogen atom, an alkyl group or an aryl group, more preferably, a hydrogen atom, an alkyl group or an aryl group. Each of $R_{41}$ to $R_{44}$ and $R_{46}$ to $R_{49}$ is preferably a hydrogen atom, an alkyl group, an alkenyl group, an aryl group, a heterocyclic group, an arylthio group, an alkylthio group, an acylamino group or a sulfoneamide group, more preferably a hydrogen atom, an alkyl group, an aryl group or a heterocyclic group, It is preferred that at least one of $R_{41}$ to $R_{44}$ is a donor group, and it is also preferred that both of $R_{41}$ and $R_{42}$, or both of $R_{43}$ and $R_{44}$ are an electron-withdrawing group. It is more preferred that at least one of $R_{41}$ to $R_{44}$ is a donor group. It is furthermore preferred that at least one of $R_{41}$ to $R_{44}$ is a donor group and $R_{41}$ to $R_{44}$ other than the donor group are selected from a hydrogen atom and an alkyl group.

A donor group referred to here is an "electron-donating group" or an aryl group substituted with at least one "electron-donating group." Preferable examples of donor groups include an alkylamino group, an arylamino group, a heterocyclicamino group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute and a phenyl group substituted with at least one electron-donating group. More preferable examples thereof include an alkylamino group, an aryamino group, an electron excessive aromatic heterocyclic group in a five-membered single ring or fused ring containing at least one nitrogen atom in a ring structure as a part (an indol ring, a pyrrole ring, a carbazole ring and the like), and a phenyl group substituted with an electron-donating group (a phenyl group substituted with three or more alkoxy groups, a phenyl group substituted with a hydroxy group, an alkylamino group, or an arylamino group and the like). Particularly preferable examples thereof include an aryamino group, an electron excessive aromatic heterocyclic group in a five-membered single ring or fused ring containing at least one nitrogen atom in a ring structure as a part (especially, a 3-indolyl group), and a phenyl group substituted with an electron-donating group (especially, a trialkoxyphenyl group and a phenyl group substituted with an alkylamino group or an arylamino group).

$Z_{42}$ is preferably —$CR_{420}R_{421}$— or —$NR_{423}$—, more preferably —$NR_{423}$—. Each of $R_{420}$ and $R_{421}$ is preferably a hydrogen atom, an alkyl group, an aryl group, a heterocyclic group, an acylamino group or a sulfoneamino group, more preferably a hydrogen atom, an alkyl group, an aryl group or a heterocyclic group. $R_{423}$ is preferably a hydrogen atom, an alkyl group, an aryl group or an aromatic heterocyclic group, more preferably a hydrogen atom, an alkyl group or an aryl group.

The substituent represented by each of $R_{40}$ to $R_{49}$, $R_{420}$, $R_{421}$ and $R_{423}$ preferably has 40 or less carbon atoms, more preferably has 30 or less carbon atoms, particularly preferably 15 or less carbon atoms. The substituents of $R_{40}$ to $R_{49}$, $R_{420}$, $R_{421}$ and $R_{423}$ may bond to each other or to the other portion such as $RED_{41}$, $RED_{42}$ and $Z_{42}$, to form a ring.

In the compounds of Types 1 to 4 used in the invention, the adsorbable group to the silver halide is such a group that is directly adsorbed on the silver halide or promotes adsorption of the compound onto the silver halide. Specifically, the adsorbable group is a mercapto group or a salt thereof; a thione group (—C(═S)—); a heterocyclic group containing at least one atom selected from the group consisting of a nitrogen atom, a sulfur atom, a selenium atom and a tellurium atom; a sulfide group; a cationic group; or an ethynyl group. Incidentally, the adsorbable group in the compound of Type 2 is not a sulfide group.

The mercapto group or a salt thereof used as the adsorbable group may be a mercapto group or a salt thereof itself, and is more preferably a heterocyclic group, an aryl group or an alkyl group having a mercapto group or a salt thereof as a substituent. The heterocyclic group is a 5- to 7-membered, monocyclic or condensed, aromatic or nonaromatic, heterocyclic group. EXAMPLEs thereof include an imidazole ring group, a thiazole ring group, an oxazole ring group, a benzimidazole ring group, a benzthiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, etc. The heterocyclic group may contain a quaternary nitrogen atom, and in this case, the mercapto group bonding to the heterocyclic group may be dissociated into a mesoion. Such heterocyclic group may be an imidazolium ring group, a pyrazolium ring group, a thiazolium ring group, a triazolium ring group, a tetrazolium ring group, a thiadiazolium ring group, a pyridinium ring group, a pyrimidinium ring group, a triazinium ring group, etc. Preferred among them is a triazolium ring group such as a 1,2,4-triazolium-3-thiolate ring group. Examples of the aryl group include a phenyl group and a naphthyl group. Examples of the alkyl group include straight, branched or cyclic alkyl groups having 1 to 30 carbon atom. When the mercapto group forms a salt, a counter ion of the salt may be a cation of an alkaline metal, an alkaline earth metal, a heavy metal, etc. such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; etc.

Further, the mercapto group used as the adsorbable group may be tautomerized into a thione group. Specific examples of the thione group include a thioamide group (herein a —C(═S)—NH— group); and groups containing a structure of the thioamide group, such as linear or cyclic thioamide groups, a thiouredide group, a thiourethane group and a dithiocarbamic acid ester group. Examples of the cyclic thioamide group include a thiazolidine-2-thione group, an oxazolidine-2-thione group, a 2-thiohydantoin group, a rhodanine group, an isorhodanine group, a thiobarbituric acid group, a 2-thioxo-oxazolidine-4-one group, etc.

The thione group used as the adsorbent group, as well as the thione group derived from the mercapto group by tautomerization, may be a linear or cyclic, thioamide, thiouredide, thiourethane or dithiocarbamic acid ester group that cannot be tautomerized into the mercapto group or has no hydrogen atom at α-position of the thione group.

The heterocyclic group containing at least one atom selected from the group consisting of a nitrogen atom, a sulfur atom, a selenium atom and tellurium atom, which is used as the adsorbent group, is a nitrogen-containing heterocyclic group having a —NH— group that can form a silver imide (>NAg) as a moiety of the heterocycle; or a heterocyclic group having a —S— group, a —Se— group, a —Te— group or a ═N— group that can form a coordinate bond with a silver ion as a moiety of the heterocycle. EXAMPLEs of the former include a benzotriazole group, a triazole group, an indazole group, a pyrazole group, a tetrazole group, a benzimidazole group, an imidazole group, a purine group, etc. Examples of the latter include a thiophene group, a thiazole group, an oxazole group, a benzothiazole group, a benzoxazole group, a thiadiazole group, an oxadiazole group, a triazine group, a selenazole group, a benzselenazole group, a tellurazole group, a benztellurazole group, etc. The former is preferable.

The sulfide group used as the adsorbable group may be any group with a —S— moiety, and preferably has a moiety of: alkyl or alkylene-S-alkyl or alkylene; aryl or arylene-S-alkyl or alkylene; or aryl or arylene-S-aryl or arylene. The sulfide group may form a ring structure, and may be a —S—S— group. Specific examples of the ring structure include groups with a thiolane ring, a 1,3-dithiolane ring, a 1,2-dithiolane ring, a thiane ring, a dithiane ring, a tetrahydro-1,4-thiazine ring (a thiomorpholine ring), etc. Particularly preferred as the sulfide groups are groups having a moiety of alkyl or alkylene-S-alkyl or alkylene.

The cationic group used as the adsorbable group is a quaternary nitrogen-containing group, specifically a group with an ammonio group or a quaternary nitrogen-containing heterocyclic group. Incidentally, there is no case where the cationic group partly composes an atomic group forming a dye structure, such as a cyanine chromophoric group. The ammonio group may be a trialkylammonio group, a dialkylarylammonio group, an alkyldiarylammonio group, etc., and examples thereof include a benzyldimethylammonio group, a trihexylammonio group, a phenyldiethylammonio group, etc. Examples of the quaternary nitrogen-containing heterocyclic group include a pyridinio group, a quinolinio group, an isoquinolinio group, an imidazolio group, etc. Preferred are a pyridinio group and an imidazolio group, and particularly preferred is a pyridinio group. The quaternary nitrogen-containing heterocyclic group may have an optional substituent. Preferred as the substituent in the case of the pyridinio group and the imidazolio group are alkyl groups, aryl groups, acylamino groups, a chlorine atom, alkoxycarbonyl groups and carbamoyl groups. Particularly preferred as the substituent in the case of the pyridinio group is a phenyl group.

The ethynyl group used as the adsorbable group means a —C≡CH group, in which the hydrogen atom may be substituted.

The adsorbable group may have an optional substituent.

Specific examples of the adsorbable group further include groups described in pages 4 to 7 of a specification of JP-A No. 11-95355.

Preferred as the adsorbable group used in the invention are mercapto-substituted, nitrogen-containing, heterocyclic groups such as a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzthiazole group and a 1,5-dimethyl-1,2,4-triazolium-3-thiolate group; and nitrogen-containing heterocyclic groups having a —NH— group that can form a silver imide (>NAg) as a moiety of the heterocycle, such as a benzotriazole group, a benzimidazole group and an indazole group. Particularly preferred are a 5-mercaptotetrazole group, a 3-mercapto-1,2,4-triazole group and a benzotriazole group, and the most preferred are a 3-mercapto-1,2,4-triazole group and a 5-mercaptotetrazole group.

Among these compounds, it is particularly preferred that the compound has two or more mercapto groups as a moiety. The mercapto group (—SH) may be converted into a thione group in the case where it can be tautomerized. The compound may have two or more adsorbent groups containing above-mentioned mercapto or thione group as a moiety, such as a cyclic thioamide group, an alkylmercapto group, an arylmercapto group and a heterocyclic mercapto group. Further, the compound may have one or more adsorbable group containing two or more mercapto or thione groups as a moiety, such as a dimercapto-substituted, nitrogen-containing, heterocyclic group.

Examples of the adsorbable group containing two or more mercapto group, such as a dimercapto-substituted, nitrogen-containing, heterocyclic group, include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, a 2,7-dimercapto-5-methyl-s-triazolo(1,5-A)-pyrimidine group, a 2,6,8-trimercaptopurine group, a 6,8-dimercaptopurine group, a 3,5,7-trimercapto-s-triazolotriazine group, a 4,6-dimercaptopyrazolo pyrimidine group, a 2,5-dimercapto-imidazole group, etc. Particularly preferred are a 2,4-dimercaptopyrimidine group, a 2,4-dimercaptotriazine group, and a 3,5-dimercapto-1,2,4-triazole group.

The adsorbable group may be connected to any position of the compound represented by each of the general formulae (A) to (F) and (1) to (3). Preferred portions, which the adsorbable group bonds to, are $RED_{11}$, $RED_{12}$, $RED_2$ and $RED_3$ in the general formulae (A) to (D), $RED_{41}$, $R_{41}$, $RED_{42}$, and $R_{46}$ to $R_{48}$ in the general formulae (E) and (F), and optional portions other than $R_1$, $R_2$, $R_{11}$, $R_{12}$, $R_{31}$, $L_1$, $L_{21}$ and $L_{31}$ in the general formulae (1) to (3) Further, more preferred portions are $RED_{11}$ to $RED_{42}$ in the general formulae (A) to (F).

The spectral sensitizing dye moiety is a group containing a spectral sensitizing dye chromophore, a residual group provided by removing an optional hydrogen atom or substituent from a spectral sensitizing dye compound. The spectral sensitizing dye moiety may be connected to any position of the compound represented by each of the general formulae (A) to (F) and (1) to (3) Preferred portion, which the spectral sensitizing dye moiety bonds to, are $RED_{11}$, $RED_{12}$, $RED_2$ and $RED_3$ in the general formulae (A) to (D), $RED_{41}$, $R_{41}$, $RED_{42}$, and $R_{46}$ to $R_{48}$ in the general formulae (E) and (F), and optional portions other than $R_1$, $R_2$, $R_{11}$, $R_{12}$, $R_{31}$, $L_1$, $L_{21}$ and $L_{31}$ in the general formulae (1) to (3). Further, more preferred portions are $RED_{11}$ to $RED_{42}$ in the general formulae (A) to (F). The spectral sensitizing dye is preferably such that typically used in color sensitizing techniques. Examples thereof include cyanine dyes, composite cyanine dyes, merocyanine dyes, composite merocyanine dyes, homopolar cyanine dyes, styryl dyes, and hemicyanine dyes. Typical spectral sensitizing dyes are disclosed in Research Disclosure, Item 36544, September 1994. The dyes can be synthesized by one skilled in the art according to procedures described in the above Research Disclosure and F. M. Hamer, *The Cyanine dyes and Related Compounds*, Interscience Publishers, New York, 1964. Further, dyes described in pages 4 to 7 of a specification of JP-A No. 11-95355 (U.S. Pat. No. 6,054,260) may be used in the invention.

The total number of carbon atoms in the compounds of Types 1 to 4 used in the invention is preferably 10 to 60, more preferably 15 to 50, furthermore preferably 18 to 40, particularly preferably 18 to 30.

When a silver halide photosensitive material using the compounds of Types 1 to 4 is exposed, the compound is one-electron-oxidized. After the subsequent reaction, the compound is further oxidized while releasing one or more electrons, or two or more electrons depending on Type. An oxidation potential in the first one-electron oxidation is preferably 1.4 V or less, more preferably 1.0 V or less. This oxidation potential is preferably 0 V or more, more preferably 0.3 V or more. Thus, the oxidation potential is preferably approximately 0 V to 1.4 V, more preferably approximately 0.3 V to 1.0 V.

The oxidation potential may be measured by a cyclic voltammetry technique. Specifically, a sample is dissolved in a solution of acetonitrile/water containing 0.1 M lithium perchlorate=80/20 (volume %), nitrogen gas is passed through the resultant solution for 10 minutes, and then the oxidation potential is measured at 25° C. at a potential scanning rate of 0.1 V/second by using a glassy carbon disk as a working electrode, using a platinum wire as a counter electrode, and using a calomel electrode (SCE) as a reference electrode. The oxidation potential per SCE is obtained at peak potential of cyclic voltammetric curve.

In the case where the compound of Types 1 to 4 is one-electron-oxidized and release further one electron after the subsequent reaction, an oxidation potential in the subsequent oxidation is preferably −0.5 V to −2 V, more preferably −0.7 V to −2 V, furthermore preferably −0.9 V to −1.6 V.

In the case where the compound of Types 1 to 4 is one-electron-oxidized and release further two or more electrons after the subsequent reaction, oxidation potentials in the subsequent oxidation are not particularly limited. The oxidation potentials in the subsequent oxidation often cannot be measured precisely, because an oxidation potential in releasing the second electron cannot be clearly differentiated from an oxidation potential in releasing the third electron.

Next, the compound of Type 5 will be described.

The compound of Type 5 is represented by X—Y, in which X represents a reducing group and Y represents a leaving group. The reducing group represented by X can be one-electron-oxidized to provide a one-electron oxidation product, which can be converted into an X radical by eliminating the leaving group of Y with a subsequent X—Y bond cleavage reaction. The X radical can release further one electron. The oxidation reaction of the compound of Type 5 may be represented by the following formula.

$$X{-}Y \xrightarrow{\text{oxidize } (-e^-)} (X{-}Y)^{+\bullet} \xrightarrow{\text{split}} X\bullet + Y^+ \xrightarrow{\text{one electron release } (-e^-)} X^+$$

The compound of Type 5 exhibits an oxidation potential of preferably 0 V to 1.4 V, more preferably 0.3 V to 1.0 V. The radical X• generated in the formula exhibits an oxidation potential of preferably −0.7 V to −2.0 V, more preferably −0.9 V to −1.6 V.

The compound of Type 5 is preferably represented by the following general formula (G).

General formula (G)

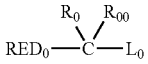

In the general formula (G), $RED_0$ represents a reducing group, $L_0$ represents a leaving group, and $R_0$ and $R_{00}$ each represent a hydrogen atom or a substituent. $RED_0$ and $R_0$, and $R_0$ and $R_{00}$ may be bond together to form a ring structure, respectively. $RED_0$ is the same as $RED_2$ in the general formula (C) with respect to the meanings and preferred embodiments. $R_0$ and $R_{00}$ are the same as $R_{21}$ and $R_{22}$ in the general formula (C) with respect to the meanings and preferred embodiments, respectively. Incidentally, $R_0$ and $R_{00}$ are not the same as the leaving group of $L_0$ respectively, except for a hydrogen atom. $RED_0$ and $R_0$ may bond together to form a ring structure with examples and preferred embodiments the same as those of the ring structure formed by bonding $RED_2$ and $R_{21}$ in the general formula (C). Examples of the ring structure formed by bonding $R_0$ and $R_{00}$ each other include a cyclopentane ring, a tetrahydrofuran ring, etc. In the general formula (G), $L_0$ is the same as $L_2$ in the general formula (C) with respect to the meanings and preferred embodiments.

The compound represented by the general formula (G) preferably has an adsorbable group to the silver halide or a spectrally sensitizing dye moiety. However, the compound does not have two or more adsorbable groups when $L_0$ is a group other than a silyl group. Incidentally, the compound may have two or more sulfide groups as the adsorbent groups, not depending on $L_0$.

The adsorbable group to the silver halide in the compound represented by the general formula (G) may be the same as those in the compounds of Types 1 to 4, and further may be the same as all of the compounds and preferred embodiments described as "an adsorbable group to the silver halide" in pages 4 to 7 of a specification of JP-A No. 11-95355.

The spectral sensitizing dye moiety in the compound represented by the general formula (G) is the same as in the compounds of Types 1 to 4, and may be the same as all of the compounds and preferred embodiments described as "photo-absorptive group" in pages 7 to 14 of a specification of JP-A No. 11-95355.

Specific examples of the compounds of Types 1 to 5 used in the invention are illustrated below without intention of restricting the scope of the invention.

1

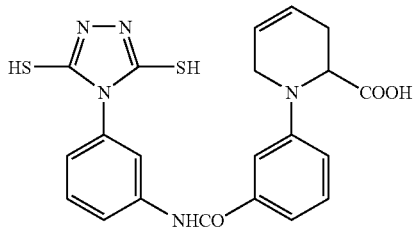

2

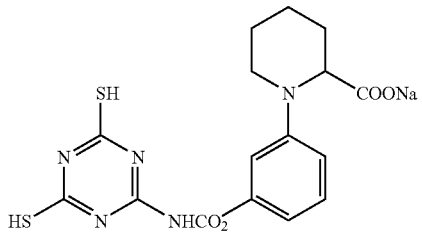

3

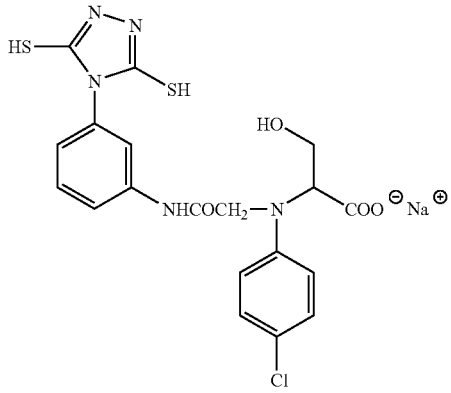

-continued
4
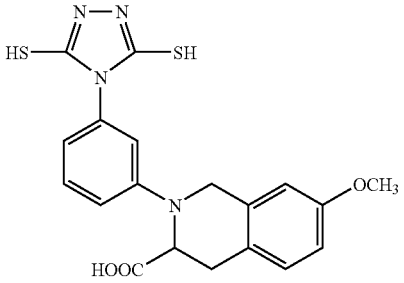
5
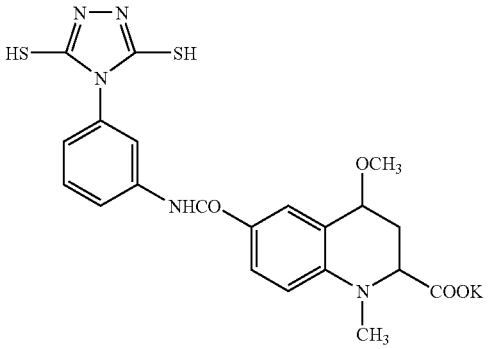
6
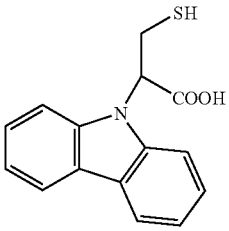
7
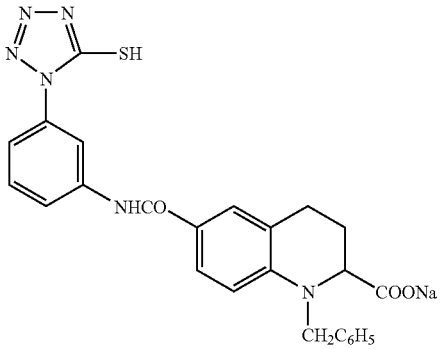
8
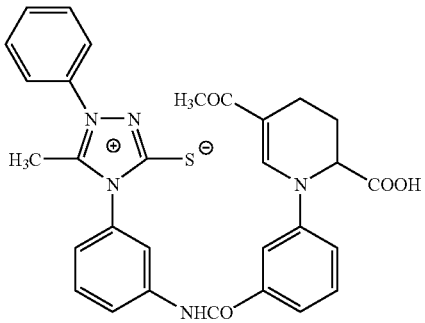
-continued
9
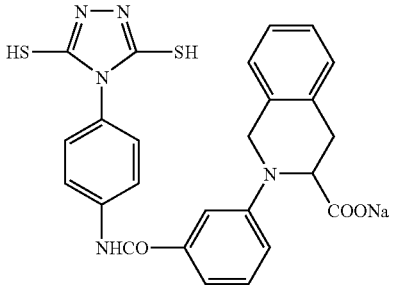
10
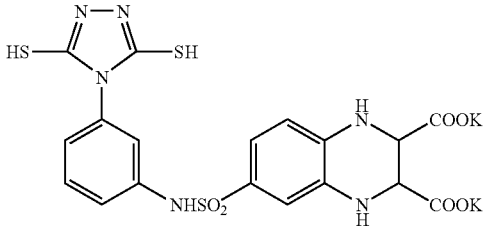
11
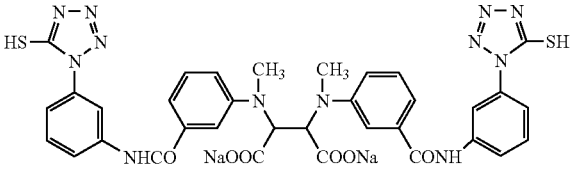
12
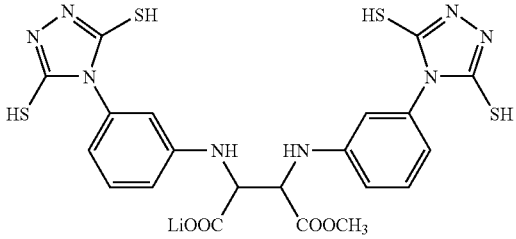
13
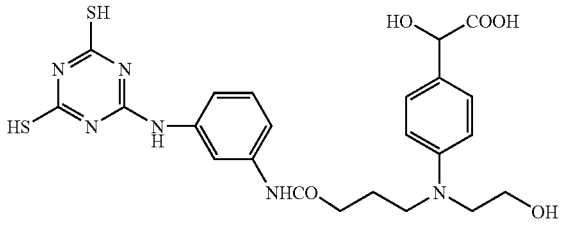
14
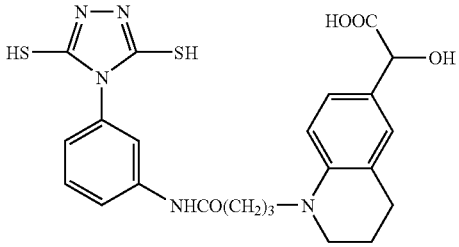

-continued
15
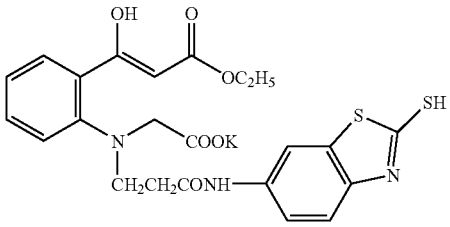
16
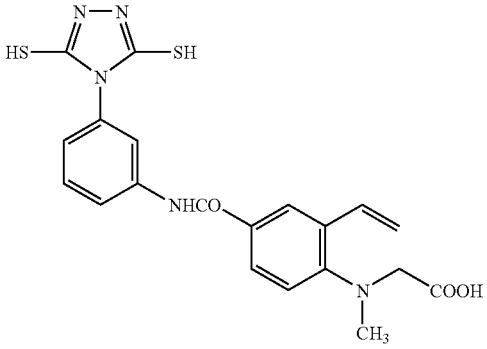
17
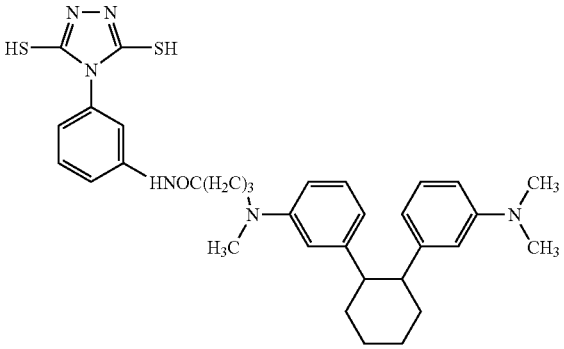
18
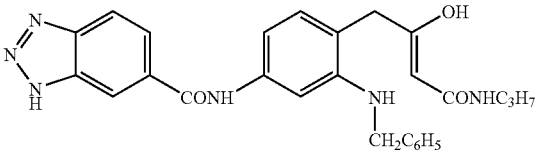
19
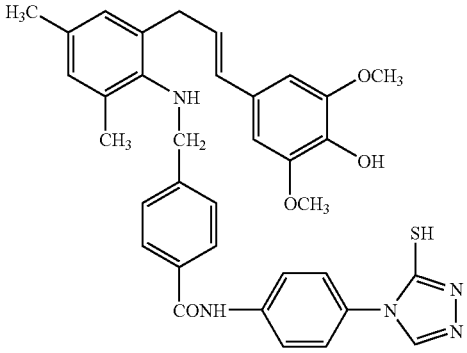
20
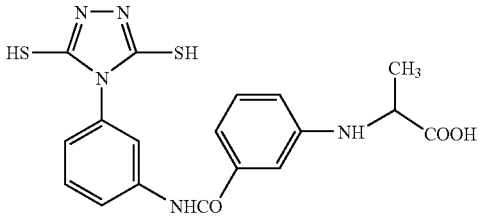
21
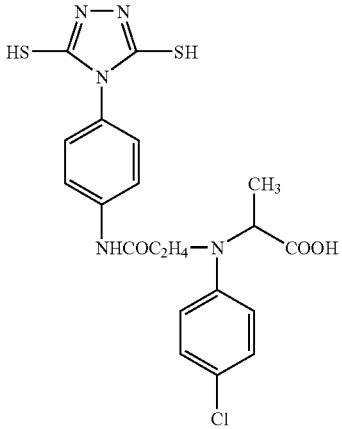
22
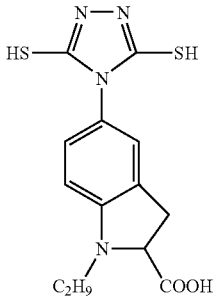
23
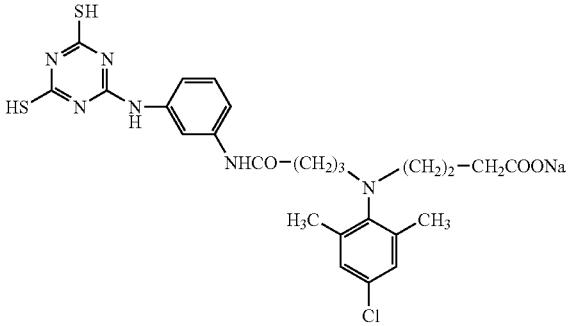

-continued
24
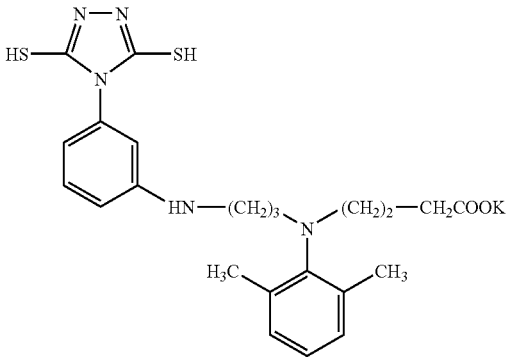
25
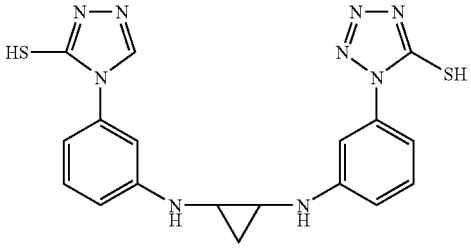
26
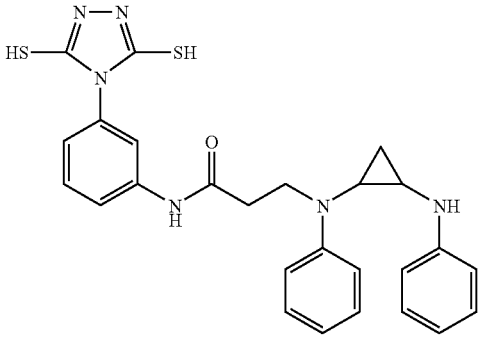
27
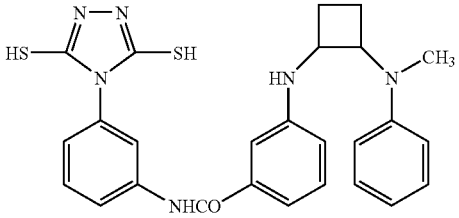
28
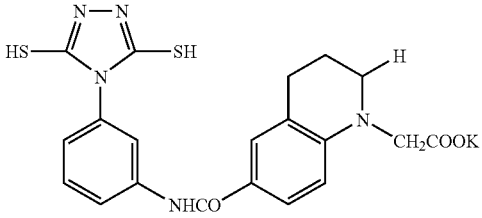
-continued
29
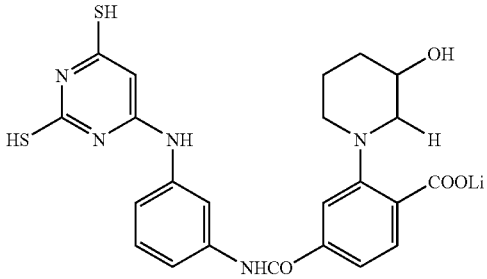
30
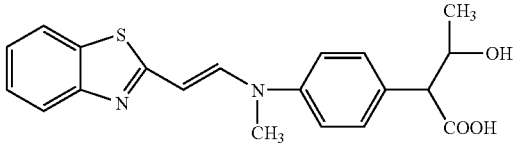
31
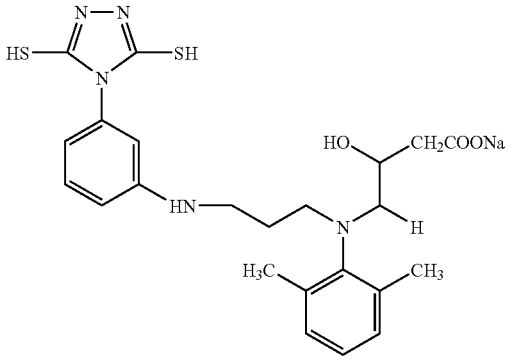
32
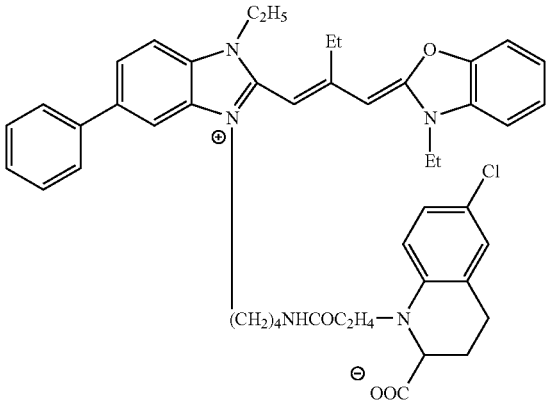

-continued

33

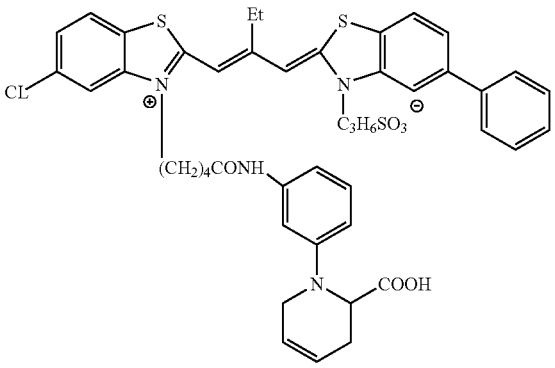

34

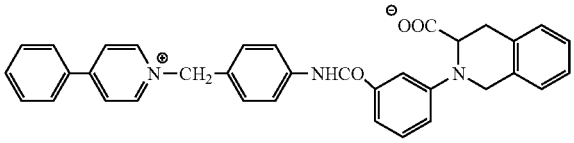

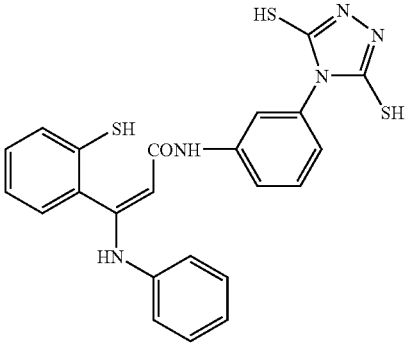

G-1

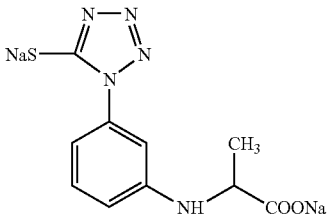

G-2

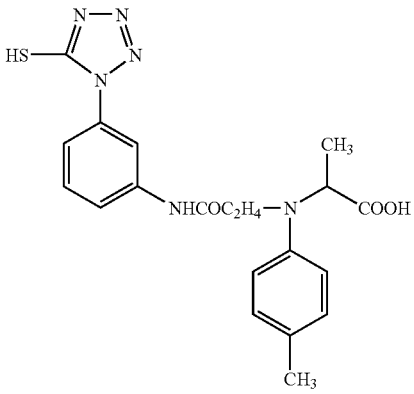

-continued

G-3

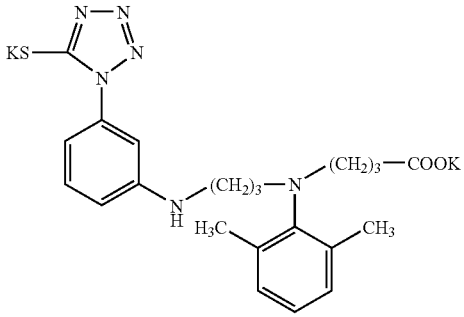

G-4

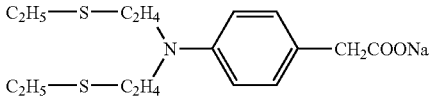

G-5

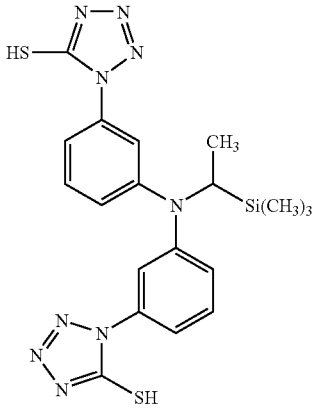

The compounds of Types 1 to 4 used in the invention are the same as compounds described in detail in Japanese Patent Application Nos. 2002-192373, 2002-188537, 2002-188536 and 2001-272137, respectively. The specific examples of the compounds of Types 1 to 4 used in the invention further include compound examples disclosed in the specifications. Synthesis examples of the compounds of Types 1 to 4 used in the invention may be the same as described in the specifications.

Specific examples of the compound represented by the general formula (G) further include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692 A1 (Compound INV 1 to 35); EP No. 893732 Al; U.S. Pat. Nos. 6,054,260 and 5,994,051; etc.

The compounds of Types 1 to 5 may be used at any time during preparation of the photosensitive silver halide emulsion and production of the photothermographic material. For example, the compound may be used, in a photosensitive silver halide grains-forming step, in a desalination step, in a chemical sensitization step, before application, etc. The compound may be added in numbers, in these steps. The compound is preferably added, after the photosensitive silver halide grains-forming step and before the desalination step; in the chemical sensitization step (just before the chemical sensitization to immediately after the chemical sensitization); or before the application. The compound is more preferably added, just before the chemical sensitization step to before mixing with the non-photosensitive organic silver salt.

It is preferred that the compound of Types 1 to 5 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Types 1 to 5 used in the invention is preferably added to the image forming layer comprising the photosensitive silver halide and the non-photosensitive organic silver salt. The compound may be added to a surface protective layer, an intermediate layer, as well as the image forming layer comprising the photosensitive silver halide and the non-photosensitive organic silver salt, to be diffused to the image forming layer in the application step. The compound may be added before or after addition of a sensitizing dye. A mol value of the compound per one mol of the silver halide is preferably $1\times10^{-9}$ mol to $5\times10^{-1}$ mol, more preferably $1\times10^{-8}$ mol to $5\times10^{-2}$ mol. in a layer comprising the photosensitive silver halide emulsion.

10) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. In the present invention, photothermographic materials are preferably spectrally sensitized by spectral sensitizers having maximum sensitivity in a wavelength from 600 nm to 900 nm and from 300 nm to 500 nm. The sensitizing dyes and the addition method are disclosed, for example, JP-A No. 11-65021 (paragraph Nos. 0103 to 0109), as a compound represented by the general formula (II) in JP-A No. 10-186572, dyes represented by the general formula (I) in JP-A No. 11-119374 (paragraph No. 0106) 6 dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination.

In the invention, the sensitizing dye may be added at any amount according to the property of photosensitivity and fogging, but it is preferably added from $1\times10^{-6}$ mol to 1 mol, and more preferably, from $1\times10^{-4}$ mol to $1\times10^{-1}$ mol per one mol of silver in each The photothermographic material of the invention may also contain super sensitizers in order to improve spectral sensitizing effect. The super sensitizers usable in the invention can include those compounds described in EP-A No. 587,338, U.S. Pat. Nos. 3,877,943 and 4,873,184 and JP-A Nos. 5-341432, 11-109547, and 10-111543.

11) Combined Use of a Plurality of Silver Halides

The photosensitive silver halide emulsion in the photosensitive material used in the invention may be used alone, or two or more kinds of them (for example, those of different average particle sizes, different halogen compositions, different crystal habits and of different conditions for chemical sensitization) may be used together. Gradation can be controlled by using a plural kinds of photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Mixing Silver Halide and Organic Silver Salt

The photosensitive silver halide in the invention is particularly preferably formed under the absence of the non-photosensitive organic silver salt and then mixed in the process for preparing the organic silver salt. This is because a sufficient sensitivity can not sometimes be attained by the method of forming the silver halide by adding a halogenating agent to the organic silver salt.

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above.

13) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai kongou gijutu" by N. Harnby and M. F. Edwards, translated by Kouji Takahashi (Nikkankougyou shinbunsya, 1989).

2. Non-Photosensitive Organic Silver Salt

The organic silver salt particle according to the invention is relatively stable to light but serves as to supply silver ions and forms silver images when heated to 80° C. or higher under the presence of an exposed photosensitive silver halide and a reducing agent. The organic silver salt may be any organic material containing a source capable of reducing silver ions. Such non-photosensitive organic silver salt is disclosed, for example, in JP-A Nos. 6-130543, 8-314078, 9-127643, 10-62899 (paragraph Nos. 0048 to 0049), 10-94074, and 10-94075, EP-A No. 0803764A1 (page 18, line 24 to page 19, line 37), EP-A Nos. 962812A1 and 1004930A2, JP-A Nos. 11-349591, 2000-7683, and 2000-72711, and the like. A silver salt of organic acid, particularly, a silver salt of long chained fatty acid carboxylic acid (number of carbon atoms having 10 to 30, preferably, 15 to 28) is preferable. Preferred examples of the silver salt of the organic acid can include, for example, silver behenate, silver arachidinic acid, silver stearate, silver oleate, silver laurate, silver capronate, silver myristate, silver palmitate and mixtures thereof. Among the organic silver salts, it is preferred to use an organic silver salt with the silver behenate content of 50 mol % or more, particularly preferably, 75 mol % to 98 mol %.

There is no particular restriction on the shape of the organic silver salt usable in the invention and it may needle-like, bar-like, plate-like or flaky shape.

In the invention, a flaky shaped organic silver salt is preferred. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average) ≧1.5 as an average value x is defined as a flaky shape. The relation is preferably: 30≧x (average) ≧1.5 and, more preferably, 15≧x (average) ≧1.5. By the way, needle-like is expressed as 1≦x (average) <1.5.

In the flaky shaped particle, a can be regarded as a thickness of a plate particle having a main plate with b and c being as the sides. a in average is preferably 0.01 μm to 0.3 μm and, more preferably, 0.1 μm to 0.23 μm. c/b in average preferably 1 to 6, more preferably, 1 to 4 and, further preferably, 1 to 3 and, most preferably, 1 to 2.

As the particle size distribution of the organic silver salt, mono-dispersion is preferred. In the mono-dispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the mono-dispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The mono-dispersion can be determined from particle size (volume weighted mean diameter) obtained, for example, by a measuring method of irradiating a laser beam to an organic silver salt dispersed in a liquid, and determining a self correlation function of the fluctuation of scattered light to the change of time.

Known methods and the like can -be applied to manufacturing methods and dispersing methods of an organic acid silver used in the invention. Description of the manufacturing and dispersing methods can be found as reference in the following patent related documents, for example, JP-A No. 10-62899; EP Nos. 0803763 A1, 0962812 A1; JP-A Nos. 11-349591, 2000-7683, 2000-72711, 2001-163827, 2001-163889, 2001-163890 and the like.

In the invention, it is possible to prepare a photosensitive material by mixing an organic silver salt aqueous dispersion and a photosensitive silver salt aqueous dispersion together. Mixing of two or more kinds of organic silver salt aqueous dispersions and two or more kinds of photosensitive silver salt aqueous dispersions together is a method preferably used for adjusting a photographic characteristic.

While an organic silver salt in the invention can be used in a desired amount, an amount of an organic silver salt is preferably in the range of from 0.1 g/m$^2$ to 5 g/m$^2$ in terms of Ag and more preferably in the range of from 1 g/m$^2$ to 3 g/m$^2$ in terms of Ag. An amount of an organic silver salt is particularly preferably in the range of from 1.2 g/m$^2$ to 2.5 g/m$^2$ in terms of Ag.

3. Reducing Agent

The photothermographic material of the invention contains a reducing agent for the organic silver salt. The reducing agent may be any substance (preferably, organic substance) capable of reducing silver ions into metallic silver. Examples of the reducing agent are described in JP-A No. 11-65021 (column Nos. 0043 to 0045) and EP-A 0803764 (p. 7, line 34 to p. 18, line 12).

In the invention, a so-called hindered phenolic reducing agent or a bisphenol agent having a substituent at the ortho-position to the phenolic hydroxyl group is preferred and the bisphenolic reducing agent is more preferred. Particularly, the compound represented by the following general formula (R) is preferred.

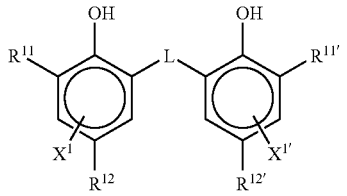

In the general formula (R), $R^{11}$ and $R^{11'}$ each independently represent an alkyl group having 1 to 20 carbon atoms. $R^{12}$ and $R^{12'}$ each independently represents a hydrogen atom or a group capable of substituting for a hydrogen atom on a benzene ring. L represents a —S— group or a —$CHR^{13}$— group. $R^{13}$ represents a hydrogen atom or an alkyl group having 1 to 20 carbon atoms. X and $X^1$ each independently represents a hydrogen atom or a group capable of substituting for a hydrogen atom on a benzene ring.

Each of the substituents is to be described specifically.

1) $R^{11}$ and $R^{11'}$ $R^{11}$ and $R^{11'}$ each independently represents a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, and halogen atom.

2) $R^{12}$ and $R^{12'}$, X and $X^1$ $R^{12}$ and $R^{12'}$ each independently represents a hydrogen atom or a group capable of substituting for a hydorgen atom on a benzene ring.

X and $X^1$ each independently represents a hydrogen atom or a group capable of substituting for a hydorgen atom on a benzene ring. Each of the groups capable of substituting for a hydrogen atom on the benzene ring can include, preferably, alkyl group, aryl group, halogen atom, alkoxy group, and acylamino group.

3) L

L represents a —S— group or a —$CHR^{13}$— group. $R^{13}$ represents a hydrogen atom or an alkyl group having 1 to 20 carbon atoms in which the alkyl group may have a substituent.

Specific examples of the non-substituted alkyl group for $R^{13}$ can include, for example, methyl group, ethyl group, propyl group, butyl group, heptyl group, undecyl group, isopropyl group, 1-ethylpentyl group, and 2,4,4-trimethylpentyl group.

Examples of the substituent for the alkyl group can include, like substituent $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, and sulfamoyl group.

4) Preferred Substituents $R^{11}$ and $R^{11'}$ are, preferably, a secondary or tertiary alkyl group having 3 to 15 carbon atoms and can include, specifically, isopropyl group, isobutyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ each represents, more preferably, tertiary alkyl group having 4 to 12 carbon atoms and, among them, t-butyl group, t-amyl group, 1-methylcyclohexyl group are further preferred, t-butyl group being most preferred.

$R^{12}$ and $R^{12'}$ are, preferably, alkyl groups having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferred are methyl group, ethyl group, propyl group, isopropyl group, and t-butyl group.

X and $X^1$ are, preferably, a hydrogen atom, halogen atom, or alkyl group, and more preferably, hydrogen atom.

L is preferably a group —$CHR^{13}$—.

$R^{13}$ is, preferably, a hydrogen atom or an alkyl group having 1 to 15 carbon atoms. The alkyl group is preferably methyl group, ethyl group, propyl group, isopropyl group and 2,4,4-trimethylpentyl group. Particularly preferred $R^{13}$ is a hydrogen atom, methyl group, propyl group or isopropyl group.

In a case where $R^{13}$ is a hydrogen atom, $R^{12}$ and $R^{12'}$ each represents, preferably, an alkyl group having 2 to 5 carbon atoms, ethyl group and propyl group being more preferred and ethyl group being most preferred.

In a case where $R^{13}$ is a primary or secondary alkyl group having 1 to 8 carbon atom, $R^{12}$ and $R^{12'}$ each represents preferably methyl group. As the primary or secondary alkyl group of 1 to 8 carbon atoms for $R^{13}$, methyl group, ethyl group, propyl group and isopropyl group are more preferred, and methyl group, ethyl group, and propyl group are further preferred.

In a case where each of $R^{11}$, $R^{11'}$ and $R^{12}$, $R^{12'}$ is methyl group, $R^{13}$ is preferably a secondary alkyl group. In this case, the secondary alkyl group for $R^{13}$ is preferably isopropyl group, isobutyl group and 1-ethylpentyl group, with isopropyl group being more preferred.

The reducing agent described above show various different thermo-developing performance depending on the combination of $R^{11}$, $R^{11'}$ and $R^{12}$, $R^{12'}$, as well as $R^{13}$. Since the thermal developing performances can be controlled by using two or more kinds of reducing agents at various mixing ratios, it is preferred to use two or more kinds of reducing agents in combination depending on the purpose.

Specific examples of the compounds represented by general formula (R) according to the invention are shown below but the invention is not restricted to them.

(R-1)

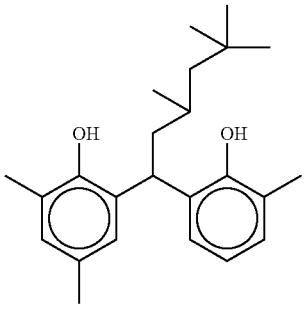

-continued (R-2)

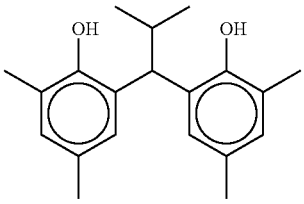

(R-3)

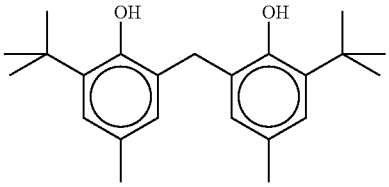

(R-4)

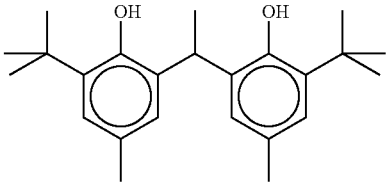

(R-5)

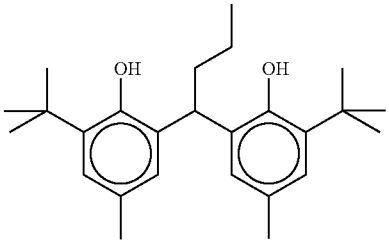

(R-6)

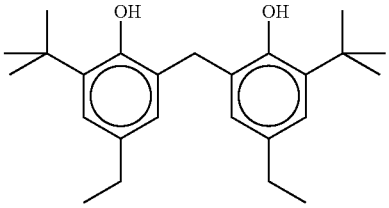

(R-7)

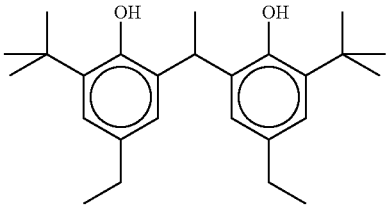

(R-8)

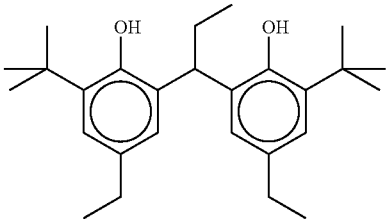

-continued (R-9)

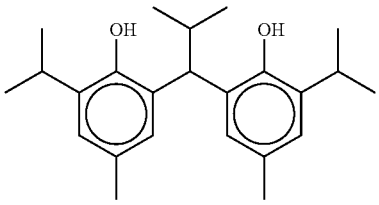

(R-10)

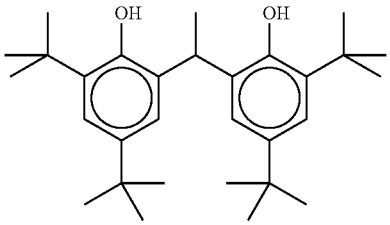

(R-11)

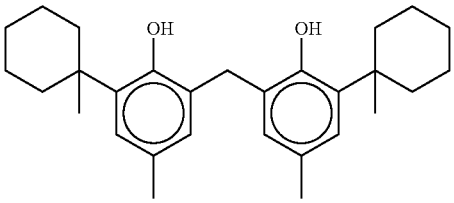

(R-12)

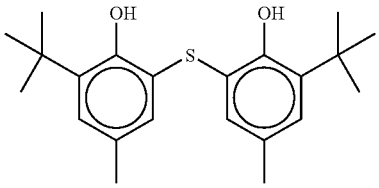

(R-13)

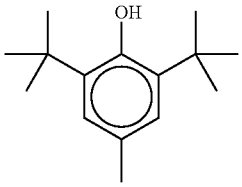

(R-14)

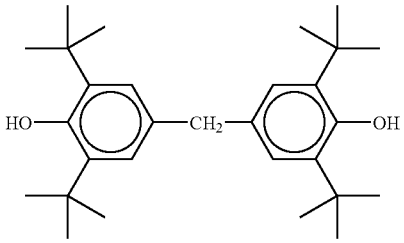

(R-15)

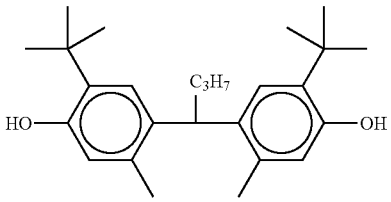

In the invention, the addition amount of the reducing agent is, preferably, from 0.1 g/m$^2$ to 5.0 g/m$^2$, more preferably, 0.1 g/m$^2$ to 3.0 g/m$^2$. It is, preferably, contained by 5 mol % to 50 mol %, further preferably, 10 mol % to 40 mol % per one mol of silver in the image forming layer.

Although the present reducing agent(s) can be added to an image forming layer containing organic silver salts and photosensitive silver halide or the layers adjacent thereto, it is preferable to add them to the image forming layer.

In the invention, the reducing agent may be incorporated into photosensitive material by being added into the coating solution, such as in the form of a solution, an emulsion dispersion, a solid particle dispersion, and the like.

As a well known emulsion dispersion method, there can be mentioned a method comprising dissolving the reducing agent in an auxiliary solvent such as oil, for instance, dibutyl phthalate, tricresyl phosphate, glyceryl triacetate, diethyl phthalate, and the like, as well as ethyl acetate, cyclohexanone, and the like; from which an emulsion dispersion is mechanically produced.

As solid particle dispersion method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. The dispersion method by means of sand mill is preferably used. In this case, there can also be used a protective colloid (such as polyvinyl alcohol), or a surface active agent (for instance, an anionic surface active agent such as sodium triisopropylnaphthalenesulfonate (a mixture of compounds having the isopropyl groups in different substitution sites)). Preferably, a preservative (for instance, sodium benzoisothiazolinone salt) is added in the water dispersion.

In the invention, furthermore, the reducing agent is preferably used as solid dispersion, and is added in the form of fine particles having average particle size from 0.01 μm to 10 μm, and more preferably, from 0.05 μm to 5 μm and, further preferably, from 0.1 μm to 1 μm. In the invention, other solid dispersions are preferably used with this particle size range.

4. Antifoggant

In a photothermographic material of the invention, a silver halide emulsion and an organic silver salt are further protected from additional formation of a fog by an antifoggant, a stabilizer and a stabilizer precursor, thereby enabling stabilization against reduction in sensitivity during stock storage. Proper antifoggants, proper stabilizers and proper stabilizer precursors that can be used alone or in combination are exemplified together with information on patent related document or documents in which an example compound or compounds are disclosed: thiazonium salts described in U.S. Pat. Nos. 2,131,038 and 2,694,716; azaidenes described in U.S. Pat. Nos. 2,886,487 and 2,444,605; compounds described in JP-A No. 9-329865 and U.S. Pat. No. 6,083,681; mercury salts described in U.S. Pat. No. 2,728,663; urazoles described in U.S. Pat. No. 3,287,135; sulfocathechols described in U.S. Pat. No. 3,235,652; oximes, nitrons and nitroindazoles described in BP No. 623448; polyvalent metal salts described in U.S. Pat. No. 2,893,405; thiuronium salts described in U.S. Pat. No. 3,220,839; salts of palladium, platinum and gold described in U.S. Pat. Nos. 2,566,263 and 2,597,915; halogen-substituted organic compounds described in U.S. Pat. Nos. 4,108,665 and 4,422,202; triazines described in U.S. Pat. Nos. 4,128,557, 4,137,079, 4,138,365 and 4,459,350; and phosphorus compounds described in U.S. Pat. No. 4,411,985.

An organic halide is preferable as an antifoggant, among which polyhalomethyl compound, particularly a trihalomethylsulfone compound, is preferable. Furthermore, an antifoggant is preferably a compound expressed by the following formula (PO):

$$Q\text{-}(Y)_n\text{—}C(Z_1)(Z_2)X \qquad \text{General formula (PO)}$$

In the formula, Q represents a heterocyclic group, Y represents a divalent linkage group, n represents 0 or 1, $Z_1$ and $Z_2$ represents a halogen atom, X represents a hydrogen atom or an electron-withdrawing group.

Q is preferably a nitrogen containing heterocyclic group having 1 to 3 nitrogen atoms and particularly preferably 2-pyridyl group and 2-quinolyl group.

X is preferably an electron-withdrawing group and more preferable examples thereof include a halogen atom, an aliphatic aryl or heterocyclic sulfonyl group, an aliphatic aryl or heterocyclic acyl group, an aliphatic aryl or heterocyclic oxycarbonyl group, a carbamoyl group, a sulfamoyl group, and particularly preferable is a halogen atom. Among halogen atoms, preferable are a chlorine atom, a bromine atom and an iodine atom, more preferable are a chlorine atom and a bromine atom and particularly preferable is a bromine atom.

Y preferably represents —C(=O)—, —SO— or —$SO_2$—, more preferably represents —C(=O)— or —$SO_2$— and particularly preferably represents —$SO_2$—. n represents 0 or 1 and preferably represents 1.

While there are shown below compounds expressed by the general formula (PO) in the invention, to which the invention is not limited.

(PO-1)

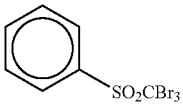

(PO-2)

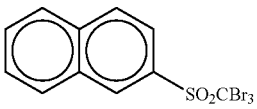

(PO-3)

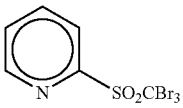

(PO-4)

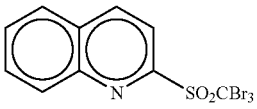

(PO-5)

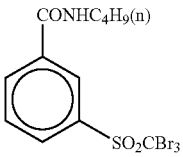

(PO-6)

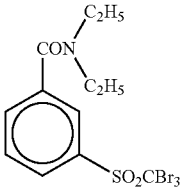

-continued (PO-7)

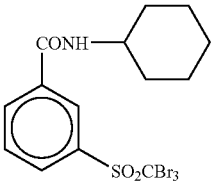

(PO-8)

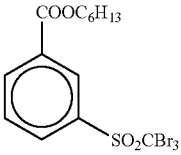

(PO-9)

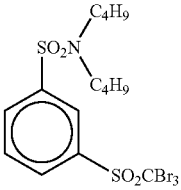

(PO-10)

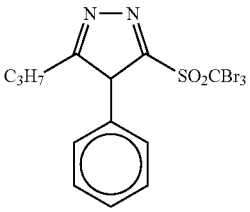

(PO-11)

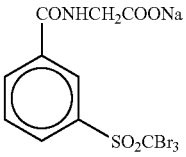

(PO-12)

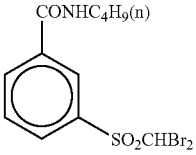

(PO-13)

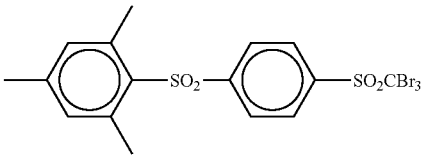

(PO-14)

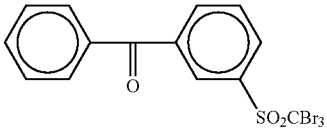

(PO-15)

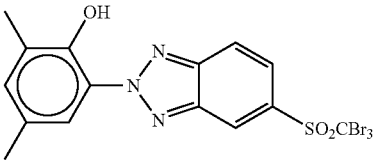

A compound expressed by the general formula (PO) in the invention is preferably used in the range of from $10^{-4}$ mol to 0.8 mol relative to one mole of a non-photosensitive silver salt in an image forming layer, more preferably used in the range of from $10^{-3}$ mol to 0.1 mol and still more preferably used in the range of from $5\times10^{-3}$ mol to 0.05 mol.

Particularly, in a case where a silver halide having a composition of a high silver iodide content, an amount of addition of a compound expressed by the general formula (PO) is important in order to obtain a sufficient anti-fogging effect and the compound is most preferably used in the range of from $5\times10^{-3}$ mol to 0.03 mol.

In the invention, a method of incorporating a compound expressed by the general formula (PO) into a photosensitive material is described in a method of incorporating a reducing agent described above.

A melting point of a compound expressed by the general formula (PO) is preferably 200° C. or lower and more preferably 170° C. or lower.

Examples of other organic polyhalides used in the invention are disclosed in paragraphs Nos. 0111 to 0112 of JP-A No. 11-65021. Preferable examples thereof are an organic halide expressed by the formula (P) described in JP-A No. 11-87297, an organic polyhalide expressed by the general formula (II) described in JP-A No. 10-339934 and an organic polyhalide described in JP-A No. 11-205330.

5. Development Accelerator

In the photothermographic material of the invention, sulfoneamide phenolic compounds represented by the general formula (A) described in the specification of JP-A No. 2000-267222, and specification of JP-A No. 2000-330234, hindered phenolic compound represented by the general formula (II) described in JP-A No. 2001-92075, hydrazine series compounds represented by general formula (I) described in the specification of JP-A No. 10-62895 and the specification of JP-A No. 11-15116, and phenolic or naphthalic compounds represented by general formula (2) described in the specification of Japanese Patent Application No. 2000-76240 are used preferably as a development accelerator. The development accelerator described above is used within a range from 0.1 mol % to 20 mol %, preferably, within a range from 0.5 mol % to 10 mol % and, more preferably, within a range from 1 mol % to 5 mol % with respect to the reducing agent. The introduction method to the photothermographic material can include, the same method as those for the reducing agent and, it is particularly preferred to add as a solid dispersion or an emulsion dispersion. In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use, among the development accelerators described above, hydrazine compounds represented by general formula (1) described in the specification of Japanese Patent Application No. 2001-074278, and phenolic or naphtholic compounds represented by general formula (2) described in the specification of Japanese Patent Application No. 2000-76240.

Preferred specific examples for the development accelerator of the invention are to be described below. The invention is not restricted to them.

(A-1)

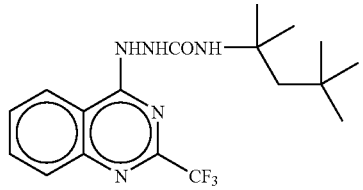

(A-2)

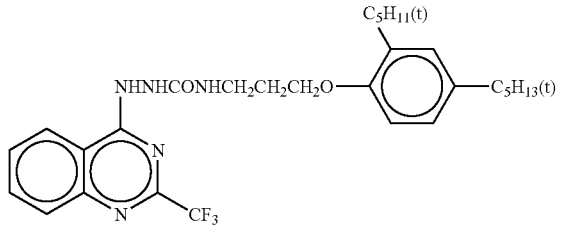

(A-3)

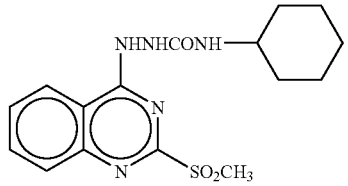

(A-4)

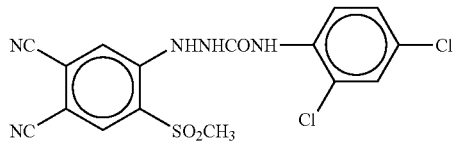

(A-5)

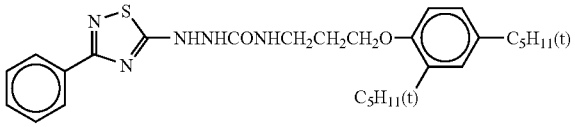

(A-6)

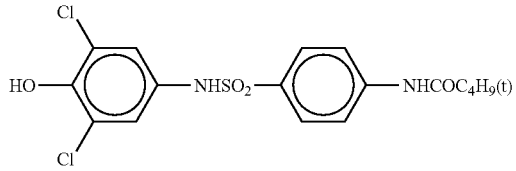

(A-7)

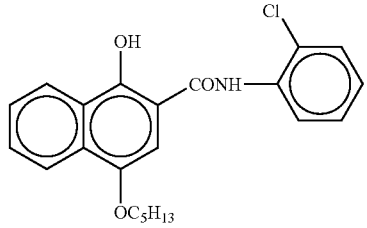

(A-8)

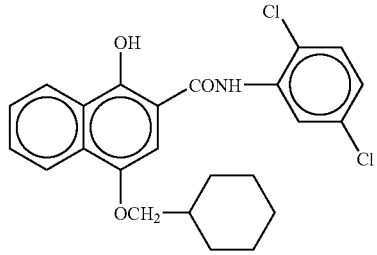

-continued (A-9)

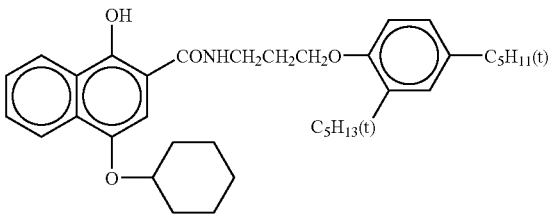

(A-10)

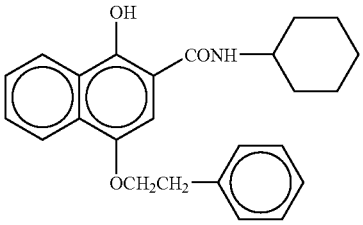

(A-11)

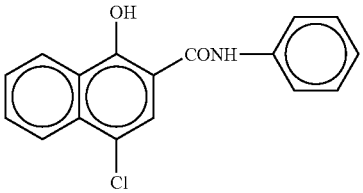

(A-12)

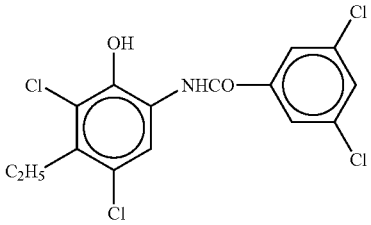

6. Hydrogen Bonding Compound

In the invention, it is preferred to use in combination, a non-reducing compound having a group capable of reacting with an aromatic hydroxyl group (—OH) of the reducing agent group, and that is also capable of forming a hydrogen bond therewith.

As a group forming a hydrogen bond with a hydroxyl groups, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Particularly preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferred as the hydrogen-bonding compound is the compound expressed by general formula (D) shown below.

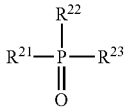

In general formula (D), $R^{21}$ to $R^{23}$ each independently represent an alkyl group, an aryl group, an alkoxy group, an aryloxy group, an amino group, or a heterocyclic group, which may be substituted or not substituted.

In the case $R^{21}$ to $R^{23}$ contain a substituent, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like.

As aryl groups, there can be mentioned phenyl group, cresyl group, xylyl group, naphthyl group, 4-t-butylphenyl group, 4-t-octylphenyl group, 4-anisidyl group, 3,5-dichlorophenyl group, and the like.

As alkoxyl groups, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like.

As aryloxy groups, there can be mentioned phenoxy group, cresyloxy group, isopropylphenoxy group, 4-t-butylphenoxy group, naphthoxy group, biphenyloxy group, and the like.

As amino groups, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by general formula (D) of the invention and others are shown below, but it should be understood that the invention is not limited thereto.

(D-1)

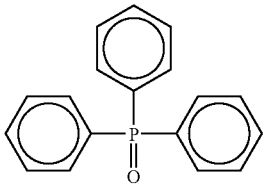

(D-2)

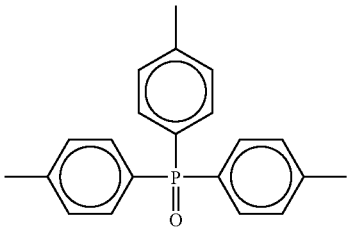

(D-3)

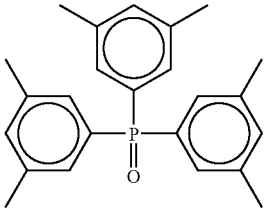

(D-4)

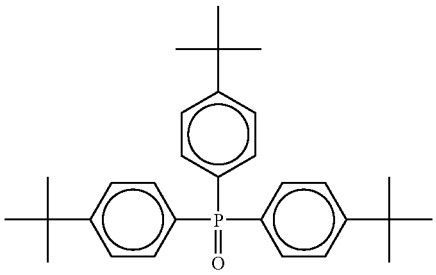

(D-5)

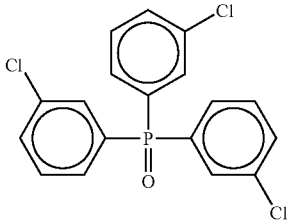

(D-6)

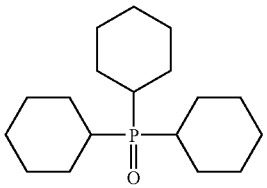

(D-7)

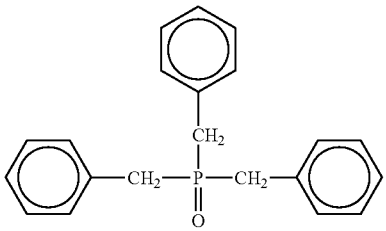

-continued (D-8)

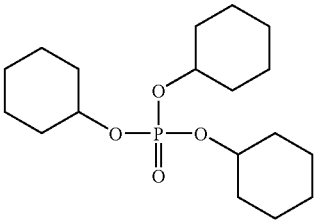

(D-9)

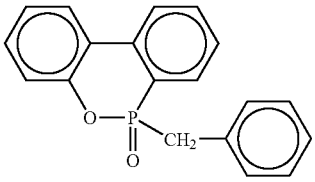

(D-10)

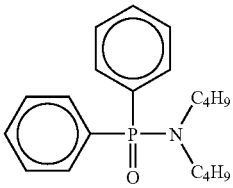

(D-11)

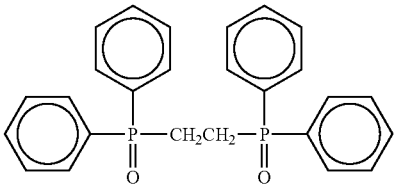

(D-12)

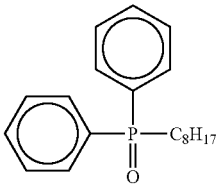

(D-13)

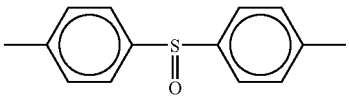

(D-14)

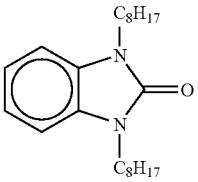

(D-15)

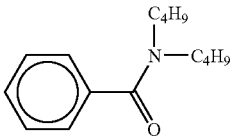

The hydrogen bonding compounds used in the invention can be used in the photothermographic material by being incorporated into the coating solution in the form of solution, emulsion dispersion, or similar to the case of reducing agent. In the solution, these compounds forms a hydrogen-bonded complex with a compound having a phenolic hydroxyl group, and can be isolated as a complex in crystalline state depending on the combination of the reducing agent and the compound expressed by general formula (D).

It is particularly preferred to use the crystal powder thus isolated in the form of solid-dispersed fine particle dispersion, because it provides stable performance. Further, it is also preferred to use a method of leading to form complex during dispersion by mixing the reducing agent and the hydrogen bonding compound of the invention in the form of powders and dispersing them with a proper dispersion solvent using sand grinder mill and the like.

The hydrogen bonding compound in the invention is preferably used in a range of from 1 mol % to 200 mol %, more preferably from 10 mol % to 150 mol %, and most preferably, from 30 mol % to 100 mol %, with respect to the reducing agent.

7. Binder

Any type of polymer may be used as the binder for the image forming layer in the photosensitive material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly(vinyl alcohol), hydroxyethyl cellulose, cellulose acetate, cellulose acetate butyrate, poly(vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly(vinyl acetal) (e.g., poly(vinyl formal) and poly(vinyl butyral)), poly(ester), poly(urethane), phenoxy resin, poly(vinylidene chloride), poly(epoxide), poly(carbonate), poly(vinyl acetate), poly(olefin), cellulose esters, and poly(amide). A binder may be used with water, an organic solvent or emulsion to form a coating solution.

In the invention, the Tg of the binder of the layer including organic silver salts is preferably from 10° C. to 80° C., more preferably, from 20° C. to 70° C., further preferably, from 23° C. to 65° C.

In the specification, Tg was calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The polymer used for the binder may be of one kind or if necessary, two or more kinds of polymers may be used. And, the polymer having Tg more than 20° C. and the polymer having Tg less than 20° C. can be used in combination. In a case that two types or more of polymers differing in Tg may be blended for use, it is preferred that the weight-average Tg is in the range mentioned above.

In the case the layer containing organic silver salt is formed by first applying a coating solution containing 30% by weight or more of water in the solvent and by then drying, and furthermore, in the case the binder of the layer containing organic silver salt is soluble or dispersible in an aqueous solvent (water solvent), the performance can be ameliorated particularly in the case a polymer latex having an equilibrium water content of 2% by weight or lower under 25° C. and 60% RH is used.

Most preferred embodiment is such prepared to yield an ion conductivity of 2.5 mS/cm or lower, and as such a preparation method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent.

As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term "equilibrium water content under 25° C. and 60% RH" as referred herein can be expressed as follows:

$$\text{Equilibrium water content under 25° C. and 60\% } RH = [(W1-W0)/W0]\times 100 \text{ (\% by weight)}$$

where, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are, particularly preferably, polymers capable of being dispersed in aqueous solvent. Examples of dispersed states may include a latex, in which water-insoluble fine particles of hydrophobic polymer are dispersed, or such in which polymer molecules are dispersed in molecular states or by forming micelles, and both are preferred. The average particle size of the dispersed particles is preferably in a range of from 1 nm to 50,000 nm, more preferably, 5 nm to 1000 nm. There is no particular limitation concerning particle size distribution of the dispersed particles, and may be widely distributed or may exhibit a monodisperse particle size distribution.

In the invention, preferred embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers; also usable are the so-called homopolymers in which single monomer is polymerized, or copolymers in which two or more types of monomers are polymerized. In the case of a copolymer, it may be a random copolymer or a block copolymer.

The molecular weight of these polymers is, in number average molecular weight, in a range of from 5,000 to 1000,000, preferably from 10,000 to 200,000. Those having too small molecular weight exhibit insufficient mechanical strength on forming the image forming layer, and those having too large molecular weight are also not preferred because the filming properties result poor.

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)—(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)—(crosslinking)

P-9; Latex of -St(70)-Bu(25)-DVB(2)-AA(3)—(crosslinking)

P-10; Latex of -VC(50)-MMA(20)-EA(20)-AN(5)-AA(5)—(molecular weight 80000)

P-11; Latex of -VDC(85)-MMA(5)-EA(5)-MAA(5)—(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)—(crosslinking, Tg 23° C.)

P-16; Latex of -St(69.5)-Bu(27.5)-AA(3)—(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly(urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latexes above may be used alone, or may be used by blending two types or more depending on needs.

Particularly preferred as the polymer latex for use in the invention is that of styrene-butadiene copolymer. The weight ratio of monomer unit for styrene to that of butadiene constituting the styrene-butadiene copolymer is preferably in a range of from 40:60 to 95:5. Further, the monomer unit of styrene and that of butadiene preferably accounts for 60% by weight to 99% by weight with respect to the copolymer. The preferred range of the molecular weight is the same as that described above.

As the latex of styrene-butadiene copolymer preferably used in the invention, there can be mentioned P-3 to P-8 and P-15, or commercially available LACSTAR-3307B, 7132C, Nipol Lx416, and the like.

In the layer containing organic silver salt of the photosensitive material according to the invention, if necessary, there can be added hydrophilic polymers such as gelatin, polyvinyl alcohol, methyl cellulose, hydroxypropyl cellulose, carboxymethyl cellulose, and the like.

The hydrophilic polymers above are added at an amount of 30% by weight or less, preferably 20% by weight or less, with respect to the total weight of the binder incorporated in the layer containing organic silver salt.

According to the invention, the layer containing organic silver salt (image forming layer) is preferably formed by using polymer latex for the binder. According to the amount of the binder for the layer containing organic silver salt, the weight ratio for total binder to organic silver salt (total binder/organic silver salt) is preferably in a range of 1/10 to 10/1, more preferably 1/5 to 4/1.

The layer containing organic silver salt is, in general, a photosensitive layer (image forming layer) containing a photosensitive silver halide, i.e., the photosensitive silver salt; in such a case, the weight ratio for total binder to silver halide (total binder/silver halide) is in a range of from 400 to 5, more preferably, from 200 to 10.

In the case water solvent is used for the preparation, the total binder content in the image forming layer is preferably in a range of from 0.2 $g/m^2$ to 30 $g/m^2$, more preferably from 1 $g/m^2$ to 15 $g/m^2$. In the image forming layer of the invention, there may be added a crosslinking agent for crosslinking, or a surface active agent and the like to improve coating properties.

In the invention, a solvent of a coating solution for a layer containing organic silver salt (,wherein a solvent and water are collectively as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or more and still more preferably 70% by weight or more.

Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

8. Surface Active Agent

A photothermographic material may contain a surface active agent for the purpose of improvement on coatability and a charging property. Examples of surface active agents may include a nonionic surface active agent, an anionic surface active agent, a cationic surface active agent and a fluorine containing surface active agent, any of which may be properly used. Concrete examples and patent related documents in which examples are described are as follows: fluorine containing polymer surface active agents described in JP-A No. 62-170950, U.S. Pat. No. 5,380,644 and the like; fluorine containing surface active agents described in JP-A Nos. 60-244945, 63-188135 and the like; polysiloxane based surface active agents described in U.S. Pat. No. 3,885,965 and the like; and polyalkylene oxides and anionic surface active agents described in JP-A 6-301140 and the like.

In the invention, preferably used are fluorocarbon surface active agents. Specific examples of fluorocarbon surface active agents can be found in those described in JP-A Nos. 10-197985, 2000-19680, and 2000-214554. Polymer fluorocarbon surface active agents described in JP-A 9-281636 can be also used preferably. For the photothermographic material in the invention, the fluorocarbon surface active agents described in JP-A Nos. 2002-82411, 2001-242357, and 2001-264110 are preferably used. Especially, the usage of the fluorocarbon surface active agents described in JP-A Nos. 2001-242357 and 2001-264110 in an aqueous coating solution is preferred viewed from the standpoint of capacity in static control, stability of the coating side state and sliding facility. The fluorocarbon surface active agent described in JP-A No. 2001-264110 is mostly preferred because of high capacity in static control and that it needs small amount to use.

According to the invention, the fluorocarbon surface active agent can be used on either side of image forming layer side or back layer side, but is preferred to use on the both sides. Further, it is particularly preferred to use in combination with electrically conductive layer including aforementioned metal oxides. In this case the amount of the fluorocarbon surface active agent on the side of the electrically conductive layer can be reduced or removed.

The amount of the fluorocarbon surface active agent used is preferably in the range of 0.1 $mg/m^2$ to 100 $mg/m^2$ on each side of image forming layer and back layer, more preferably 0.3 $mg/m^2$ to 30 $mg/m^2$, further preferably 1 $mg/m^2$ to 10 $mg/m^2$. Especially, the fluorocarbon surface active agent described in Japanese Patent Application No. 2001-264110 is effective, and used preferably in the range of 0.01 $mg/m^2$ to 10 $mg/m^2$, more preferably 0.01 $mg/m^2$ to 5 $mg/m^2$.

9. Toner

In the photothermographic material of the present invention, the addition of a toner is preferred. The description of the toner can be found in JP-A No.10-62899 (paragraph Nos. 0054 to 0055), EP-A No.0803764A1 (page 21, lines 23 to 48), JP-A Nos.2000-356317 and 2000-187298. Particularly preferred are phthalazinones (phthalazinone, phthalazinone derivatives and metal salts thereof, e.g.,4-(1-naphthyl)phthalazinone,6-chlorophthalazinone, 5,7-dimethoxyphthalazinone and 2,3-dihydro-1,4-phthalazinedione); combinations of phthalazinones and phthalic acids(e.g., phthalic acid, 4-methylphthalic acid, 4-nitrophthalic acid, diammonium phthalate, sodium phthalate, potassium phthalate and tetrachlorophthalic anhydride); phthalazines(phthalazine, phthalazine derivatives and metal salts thereof, e.g., 4-(1-naphthyl)phthalazine, 6-isopropylphthalazine, 6-ter-butylphthalazine, 6-chlorophthalazine, 5,7-dimethoxyphthalazine and 2,3-dihydrophthalazine). In the silver halide having a high silver iodide content, particularly preferred is a combination of phthalazines and phthalic acids.

Preferred addition amount of the phthalazines is in the range from 0.01 mol to 0.3 mol, more preferably in the range from 0.02 mol to 0.1 mol, per one mol of organic silver salt. This addition amount is important factor for the problem of development acceleration when using a silver halide emulsion having a high silver iodide content. By selecting appropriate addition amount, both of sufficient development performance and low fogging will be possible.

10. Other Additives

In the invention, mercapto compounds, disulfide compounds, and thione compounds may be added in order to control the development by suppressing or enhancing development, to improve spectral sensitization efficiency, or to improve storage properties before and after development. Descriptions can be found in paragraph Nos. 0067 to 0069 of JP-A No. 10-62899, a compound expressed by general formula (I) of JP-A No. 10-186572 and specific examples thereof shown in paragraph Nos. 0033 to 0052, and in lines 36 to 56 in page 20 of EP No. 0803764A1. Among them, mercapto-substituted heterocyclic aromatic compound described in JP-A Nos. 9-297367, 9-304875, and 2001-100358, and the like, are particularly preferred.

Plasticizers and lubricants usable in the photothermographic material of the invention are described in paragraph No. 0117 of JP-A No. 11-65021. Lubricants are described in paragraph Nos. 0061 to 0064 of JP-A No. 11-84573.

From the viewpoint of improving image tone, of preventing the generation of interference fringes and of preventing irradiation on laser exposure, various types of dyes and pigments (for instance, C.I. Pigment Blue 60, C.I. Pigment Blue 64, and C.I. Pigment Blue 15:6) may be used in the photosensitive layer of the invention. Detailed description can be found in WO No. 98/36322, JP-A Nos. 10-268465 and 11-338098, and the like.

In order to form ultra-high contrast image suitable for use in graphic arts, it is preferred to add an ultra-high contrast promoting agent into the image forming layer. Details on the ultra-high contrast promoting agents, method of their addition and addition amount can be found in paragraph No. 0118 of JP-A No. 11-65021 and in paragraph Nos. 0136 to 0193 of JP-A No. 11-223898; as an ultra-high contrast accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, preferably, 1 mmol or less per one mol of silver.

In the case of using an ultra-high contrast promoting agent in the photothermographic material of the invention, it is preferred to use an acid resulting from hydration of diphosphorus pentaoxide, or its salt in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The amount of usage of the acid obtained by hydration of diphoshorus pentaoxide or the salt thereof (i.e., the coverage per 1 $m^2$ of the photosensitive material) may be set as desired depending on the sensitivity and fogging, but preferred is an amount of 0.1 $mg/m^2$to 500 $mg/m^2$, and more preferably, of 0.5 $mg/m^2$ to 100 $mg/m^2$.

11. Layer Constitution and Other Constituting Components

The photothermographic material according to he invention may have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer provided to the side opposite to the image forming layer.

Furthermore, a layer that functions as an optical filter may be provided as (a) or (b) above. An antihalation layer may be provided as (c) or (d) to the photosensitive material.

1) Surface Protective Layer

The photothermographic material of the invention may further comprise a surface protective layer with an object to prevent adhesion of the image forming layer. The surface protective layer may be a single layer, or plural layers. Description on the surface protective layer may be found in paragraph Nos. 0119 to 0120 of JP-A No. 11-65021 and in JP-A No. 2000-171936.

A binder in a surface protective layer may be any of polymers. As examples of a binder, there are polyester, gelatin, polyvinyl alcohol, a cellulose derivative and the like, among which a cellulose derivative is preferable. Examples of cellulose derivatives are named below, on which no specific limitation is imposed. The Examples include cellulose acetate, cellulose acetate butylate, cellulose propionate, hydroxypropyl cellulose, hydroxypropylmethyl cellulose, methyl cellulose, hydroxylethyl cellulose, carboxymethyl cellulose and the like, and mixtures thereof. A thickness of a surface protective layer is preferably in the range of from 0.1 μm to 10 μm and particularly preferably in the range of 1 μm to 5 μm.

A surface protective layer may include any of attachment preventive materials. Examples thereof include wax, liquid paraffin, silica particles, styrene containing elastomer block polymer (for example, styrene-butadiene-styrene and styrene-isoprene-styrene), cellulose acetate, cellulose acetate butylate, cellulose propionate and mixtures thereof.

2) Antihalation Layer

The photothermographic material of the present invention may comprise an antihalation layer provided to the side farther from the light source with respect to the photosensitive layer. Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The amount of adding the thermal bleaching dye is determined depending on the usage of the dye. In general, it is used at an amount as such that the optical density (absorbance) exceeds 0.1 when measured at the desired wavelength. The optical density is preferably in a range of from 0.2 to 2. The usage of dyes to obtain optical density in the above range is generally from about 0.001 $g/m^2$ to 1 $g/m^2$.

By thermal bleaching the dye in such a manner, the optical density after thermal development can be lowered to 0.1 or lower. Two types or more of thermal bleaching dyes may be used in combination in a photothermographic material. Similarly, two types or more of base precursors may be used in combination.

In thermal bleaching process using such a thermal bleaching dye and a base precursor, preferred is to use a substance (for instance, diphenylsulfone, 4-chlorophenyl(phenyl)sulfone, and the like) as disclosed in JP-A No. 11-352626, as well as 2-naphthyl benzoate and the like, which is capable of lowering the melting point of a base precursor by 3° C. or more when mixed with a basic precursor from the viewpoint of thermal bleaching property or the like.

3) Back Layer

Back layers usable in the invention are described in paragraph Nos. 0128 to 0130 of JP-A No. 11-65021.

The binder in a back layer is transparent or translucent, and generally colorless. Examples thereof include natural polymer synthetic resin, polymer and copolymer, and other film forming media, for example: gelatins, gum arabic, poly(vinyl alcohols), hydroxyethylcelluloses, cellulose acetates, cellulose acetate butyrates, poly(vinylpyrrolidones), casein, starch, poly(acrylic acid), poly(methyl methacryaltes), poly (vinyl chlorides), poly(methacrylic acids), copoly(styrene-maleic anhydride), copoly(styrene-acrylonitrile), copoly(styrene-butadiene), poly(vinyl acetals) (for example, poly(vinyl formal) and poly(vinyl butyral)), poly(esters), poly(urethanes), phenoxy resins, poly(vinylidene chlorides), poly(epoxydes), poly(carbonates), poly(vinyl acetates), poly(olefins), cellulose esters, poly(amides). A binder may be used with water, an organic solvent or emulsion to form a coating solution.

In the invention, coloring matters having maximum absorption in the wavelength range of from 300 nm to 450 nm may be added in order to improve a color tone of developed images and a deterioration of the images during aging. Such coloring matters are described in, for example, JP-A Nos. 62-210458, 63-104046, 63-103235, 63-208846, 63-306436, 63-314535 and 01-61745, and the like. Such coloring matters are generally added in the range of from 0.1 $mg/m^2$ to 1 $g/m^2$, preferably to the back layer provided on the side opposite to the image forming layer.

4) Antistatic Layer

The photothermographic material of the invention may preferably contain an electrically conductive layer including metal oxides or electrically conductive polymers. The antistatic layer may serve as an undercoat layer, or a back surface protective layer, and the like, but can also be placed specially. The technique applicable to the antistatic layer in the invention is described in JP-A Nos. 11-65021, 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

5) Additives 5-1) Matting Agent

A matting agent may be preferably added to the photothermographic material of the invention in order to improve transportability. Description on the matting agent can be found in paragraphs Nos. 0126 to 0127 of JP-A No.11-65021.

The amount of adding the matting agents is preferably within the range from 1 mg/m$^2$ to 400 mg/m$^2$, more preferably, from 5 mg/m$^2$ to 300 mg/m$^2$, with respect to the coating amount per one m$^2$ of the photosensitive material.

The matness on the image forming layer surface is not restricted as far as star-dust trouble occurs, but the matness of 200 seconds to 10000 seconds is preferred, particularly preferred, 300 seconds to 8000 seconds as Beck's smoothness. Beck's smoothness can be calculated easily, by seeing Japan Industrial Standard (JIS) P8119 "The method of testing Beck's smoothness for papers and sheets using Beck's test apparatus", or TAPPI standard method T479.

The matt degree of the back layer in the invention is preferably in a range of 250 seconds or less and 10 seconds or more; more preferably, 180 seconds or less and 50 seconds or more, as expressed by Beck smoothness.

In the invention, the matting agent is incorporated preferably in the outermost surface layer on the photosensitive layer plane or a layer functioning as the outermost surface layer, or a layer near to the outer surface, and a layer that functions as the so-called protective layer.

The matting agent which can be used in the invention is an organic or inorganic fine particle insoluble in an application solvent. Those well known in the art can be used such, for example, organic matting agents described in U.S. Pat. Nos. 1,939,213, 2,701,245, 2,322,037, 3,262,782, 3,539,344 and 3,767,448; inorganic matting agents described in U.S. Pat. Nos. 1,260,772, 2,192,241, 3,257,206, 3,370,951, 3,523,022 and 3,769,020. Specific examples of organic compounds which can be preferably used as a matting agent include water-dispersible vinyl compounds such as polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate, polytetrafluoroethylene and the like, cellulose derivatives such as methylcllulose, cellulose acetate, cellulose acetate propionate, starch derivatives such as carboxy starch, carboxynitrophenyl starch, urea-formaldehyde-starch reaction product and the like, gelatin hardened with a known hardener and hardened gelatin in the form of fine capsule hollow particle obtained by coacervate-hardening, and the like. As examples of the inorganic compound, silicon dioxide, titanium dioxide, magnesium dioxide, aluminum oxide, barium sulfate, calcium carbonate, silver chloride de-sensitized by a known method as well as silver bromide, glass, diatomaceous earth, and the like can be preferably used. As the above-mentioned matting agent, different kinds of substances can be used in admixture, if necessary.

The size and form of the matting agent are not particularly restricted, and those of any particle size can be used. In practice of the invention, it is preferable to use those having a particle size of 0.1 μm to 30 μm. The particle size distribution of the matting agent may be narrow or wide. On the other hand, since the matting agent exerts a significant influence on the haze and surface gloss of a photosensitive material, it is preferable the particle size, form and particle size distribution are made into necessary conditions in production of the matting agent or by mixing a plurality of matting agents.

5-2) Hardener

A hardener can be used in each of image forming layer, protective layer, back layer, and the like.

As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048. Especially, vinyl sulfone based compound is preferred, and non-diffusion vinyl sulfone based compound is more preferred to use for the hardener in the invention.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing.

As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbun, 1989), and the like.

5-3) Other Additives

Furthermore, antioxidant, stabilizing agent, plasticizer, UV absorbent, or a coating aid may be added to the photothermographic material. Each of the additives is added to either of the photosensitive layer or the non-photosensitive layer. Reference can be made to WO No. 98/36322, EP-A No. 803764A1, JP-A Nos. 10-186567 and 10-18568, and the like.

6) Surface pH

The surface pH of the photothermographic material according to the invention preferably yields a pH of 7.0 or lower, more preferably, 6.6 or lower, before thermal development treatment. Although there is no particular restriction concerning the lower limit, the pH value is about 3, and the most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Support

As a support, listed are polyester films, primed polyester films, poly(ethylene terephthalate) films, polyethylene naphthalate films, cellulose nitrate films, cellulose ester films, poly(vinyl acetal) films, polycarbonate films and relevant or resinous materials, and glass, paper, metals and the like. Further, it is also possible to use flexible substrates, particularly, a paper substrate coated with partially acetylated cellulose, or a paper substrate coated or laminated by baryta and/or α-olefin polymer, particularly, polyethylene, polypropylene (α-olefin/polymer having 2 to 10 carbon atoms such as ethylene-butene copolymer and the like). The support may be transparent or translucent, and preferably transparent.

As the transparent support, favorably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development.

In the case of a photothermographic material for medical use, the transparent support may be colored with a blue dye (for instance, dye-1 described in the example of JP-A No. 8-240877), or may be uncolored. Examples for the support are described in paragraph No.0134 in JP-A No.11-65021.

As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and in paragraph Nos. 0063 to 0080 of Japanese Patent Application No. 11-106881, and the like.

8) Application Method

The photothermographic material in the invention may be applied by any method. Specifically, extrusion coating, slide coating, curtain coating, immersion coating, knife coating, flow coating, or various coating operations including various hopper coatings described in U.S. Pat. No. 2,681,294, are used, and extrusion coating or slide coating described in Stephen F. Kistler, Petert M. Schweizer, "LIQUID FILM COATING" (CHAPMAN & HALL, 1997), pp. 399 to 536, is preferably used, and extrusion coating is particularly preferably used.

9) Wrapping Material

In order to suppress fluctuation from occurring on the photographic performance during a preservation of the photosensitive material of the invention before thermal development, or in order to improve curling or winding tendencies, it is preferred that a wrapping material having low oxygen transmittance and/or vapor transmittance is used. Preferably, oxygen transmittance is 50 mL/atm·m$^2$·day or lower at 25° C., more preferably, 10 mL/atm·m$^2$·day or lower, and most preferably, 1.0 mL/atm·m$^2$·day or lower. Preferably, vapor transmittance is 10 g/atm·m$^2$·day or lower, more preferably, 5 g/atm·m$^2$·day or lower, and most preferably, 1 g/atm·m$^2$·day or lower. As specific examples of a wrapping material having low oxygen transmittance and/or vapor transmittance, reference can be made to, for instance, the wrapping material described in JP-A Nos.8-254793 and 2000-206653.

10) Other Applicable Techniques

Techniques which can be used for the photothermographic material of the invention also include those in EP803764A1, EP883022A1, WO98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420.

11) Multi-Color Photothermographic Material

Constitution of the multi-color photothermographic material may include a combination of these two layers for each color. Alternatively, all ingredients may be included into a single layer as described in U.S. Pat. No. 4,708,928.

In instances of multi-color photothermographic materials, each photosensitive layer is in general, held distinctively each other by using a functional or nonfunctional barrier layer between each photosensitive layer as described in U.S. Pat. No. 4,460,681.

14. Image Forming Method

1) Exposure

Although the photosensitive material of the invention may be subjected to exposure by any methods, laser beam is preferred as an exposure light source. Particularly, silver halide emulsion of high content of silver iodide had a problem having low photosensitivity, but this problem was solved with the use of high illuminance like laser beam. And it made clear that it needs small amount of energy to record an image. Using thus strong light in a short time made it possible to achieve photosensitivity to the purpose.

Especially, for giving the exposure intensity to provide maximum density (Dmax), the light intensity on the surface of the photographic material is preferably in the range of 0.1 W/mm$^2$ to 100 W/mm$^2$, more preferably 0.5 W/mm$^2$ to 50 W/mm$^2$, most preferably 1 W/mm$^2$ to 50 W/mm$^2$.

As Laser beam according to the invention, preferably used are gas laser ($Ar^+$, He—Ne, He—Cd), YAG laser, pigment laser, laser diode. Laser diode and second harmonics generator element can also be used. Preferred laser is determined corresponding to the peak absorption wavelength of spectral sensitizer and the like, but preferred is He—Ne laser of red through infrared emission, red laser diode, or $Ar^+$, He—Ne, He—Cd laser of blue through green emission, blue laser diode. Meanwhile, modules having SHG (Second Hermonic Generator) chip and laser diode which are integrated, or blue laser diode have been espcially developed recently, and thus laser output devices for short wavelength region have attracted the attention. Blue laser diode has been expected as a light source with increasing demand hereafter because image recording with high definition is possible, and increased recording density, as well as stable output with longer operating life are enabled. The peak wavelength of laser beam is 300 nm to 500 nm, preferably 400 nm to 500 nm, for blue; and 600 nm to 900 nm, preferably 620 nm to 850 nm, for red to near infrared.

Laser beam which oscillates in a longitudinal multiple modulation by a method such as high frequency superposition is also preferably employed.

2) Thermal Development

Although the development of the photothermographic material of the invention is usually performed by elevating the temperature of the photothermographic material exposed imagewise, any method may be used for this thermal development process. The temperature for the development is preferably 80° C. to 250° C., preferably 100° C. to 140° C., and more preferably 110° C. to 130° C. Time period for the development is preferably 1 second to 60 seconds, more preferably 3 seconds to 30 seconds, particularly preferably 5 seconds to 25 seconds, and most preferably 7 seconds to 15 seconds.

In the process for the thermal development, either drum type heaters or plate type heaters may be used. However, plate type heater processes are more preferred. Preferable process for the thermal development by a plate type heater may be a process described in JP-A NO. 11-133572, which discloses a thermal developing device in which a visible image is obtained by bringing a photothermographic material with a formed latent image into contact with a heating means at a thermal development region, wherein the heating means comprises a plate heater, and plurality of retainer rollers are oppositely provided along one surface of the plate heater, the thermal developing device is characterized in that thermal development is performed by passing the photothermographic material between the retainer rollers and the plate heater. It is preferred that the plate heater is divided into 2 to 6 portions, with the leading end having the lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

—Time from Exposure till Thermal Development—

A photothermographic material of the invention is desirably thermal developed within 60 sec after exposure. The photothermographic material is thermal developed more preferably within 30 sec after the exposure and still more preferably within 15 sec after the exposure. In order to obtain a high sensitivity, it is desirable to start thermal development within the shortest possible time after exposure.

The term "a time from exposure till the start of thermal development" means an average of times from exposure of individual portions in one sheet of a photothermographic material till thermal development is started on the same individual portions.

In order to reduce a time from exposure till thermal development, there is available a method increasing a transport speed. While a preferable transport speed is 23 mm/sec or higher, such a high-speed transport put a photothermographic material into a state where the photothermographic material easily vibrates. If a photothermographic material vibrates, no uniform exposure is realized, leading to density unevenness. Therefore, necessity has been arisen for a photothermographic material hard to be affected by exposure unevenness due to vibration.

In order to reduce a time from exposure till thermal development, it is possible to decrease a distance between an exposing portion and a developing portion.

By locating the exposing portion and the developing portion closer to each other, a state is established where a part of a photothermographic material in a sheet-like shape is exposed and in parallel with the exposure, development is started on a part of the sheet having been already exposed. In an image forming method in which a part of the photothermographic material is exposed and in parallel with the exposure, a part thereof is developed, a vibration of the photothermographic due to unevenness in transport speed in a thermal developing portion directly causes exposure unevenness. Therefore, in this case as well, a necessity has arisen for a photothermographic material hard to be affected by exposure unevenness due to the vibration.

In order to reduce an influence acted on a photothermographic material due to vibration on the apparatus side, a method has been available in which the photothermographic material is bent between an developing portion and an exposing portion to thereby absorb unevenness in transport speed in the thermal developing portion. With this method applied, since a transport speed of the transport portion is not affected by transport unevenness due to a difference in speed; therefore, no image defect occurs during scanning exposure, thereby enabling stable scanning exposure with a simple structure.

Figure 2:
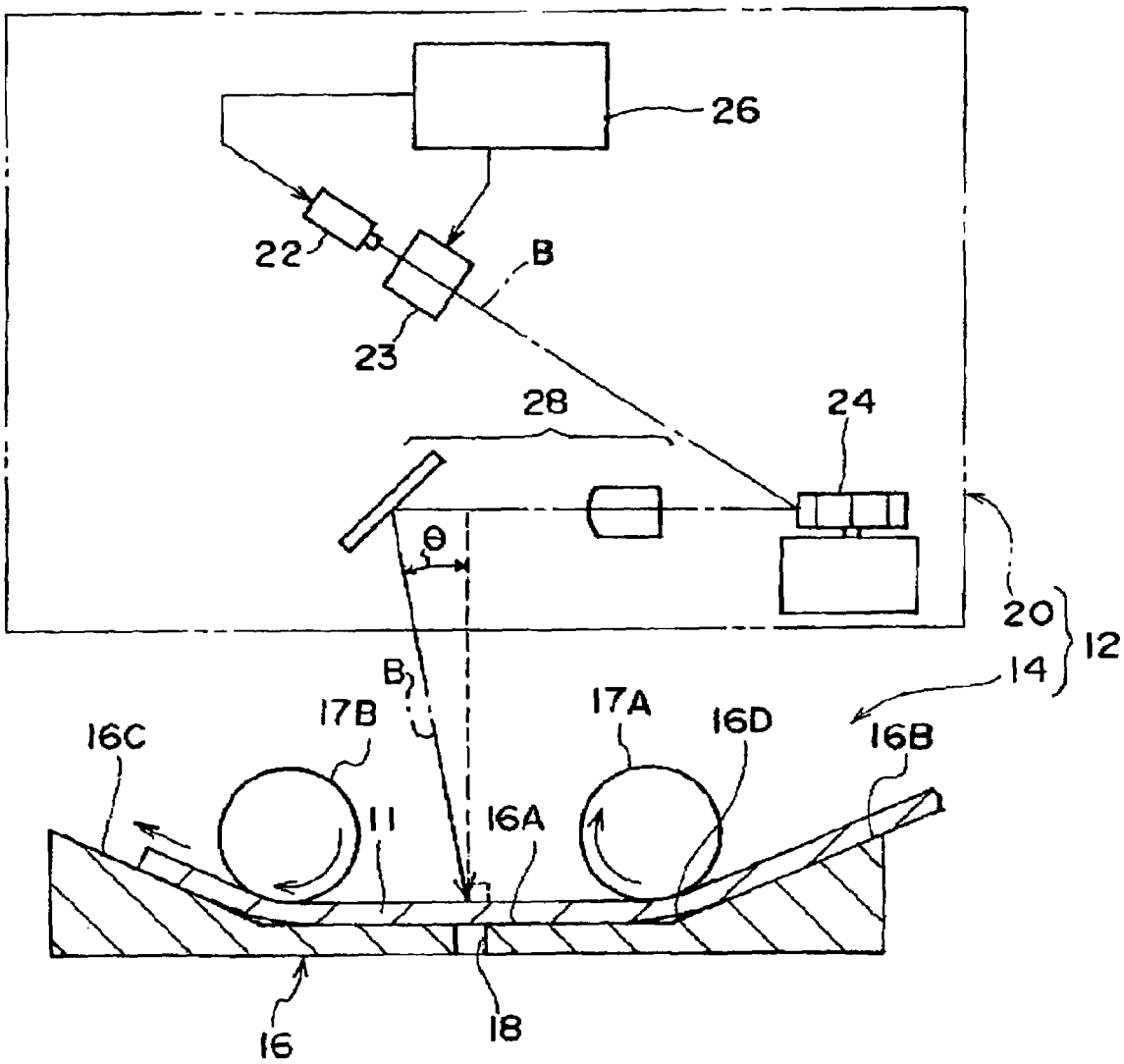
FIG. 2 is a schematic view of a transport portion and a scanning portion of the image recording apparatus according to the present invention.

More definite description will be given of an image forming method of the invention showing a concrete image recording apparatus. In FIGS. 1 and 2, there is shown one example of an image recording apparatus of the invention.

First of all, description will be given of symbols used in FIGS. 1 and 2 below.

10 image recording apparatus
11 photothermographic material in a sheet-like shape
11A recording surface of photothermographic material in a sheet-like shape
12 exposing portion
14 transport portion
16 guide plate
16A horizontal plane of guide plate
16B slope on upstream side in transport direction of guide plate
16C slope on downstream side in transport direction of guide plate
16D bending portion of guide plate
17A driving roller
17B driving roller
18 through groove
20 scanning portion (laser irradiation portion)
22 laser diode
23 modulating portion
24 polygon mirror
26 control portion
28 optical members
30 heat insulating material
32 guide plate
32A top guide plate
32B bottom guide plate
32C expanding portion
34 thermal developing portion
36 casing
38 development unit
40 heating plate
40A heating surface
42 roller
B laser beam
θ laser beam incidence angle An image recording apparatus 10, as shown in FIG. 1, has an exposure portion 12. A photothermographic material 11 as a recording material is fed into the exposure portion 12, one sheet at a time, from a photothermographic material stocker not shown. The exposure portion 12 includes a transport portion 14 transporting the photothermographic material 11 and a scanning portion 20 as laser irradiation portion irradiating laser beam modulated based on image data.

In FIG. 2, there are shown the transport portion 14 for transporting a photothermographic material 11 and the scanning portion 20 (detailed later) in the exposure portion 12.

The transport portion 14 includes a guide plate 16 supporting the photothermographic material 11 in a sheet-like shape. Not that in this embodiment, a non-recording surface of the photothermographic material 11 in a sheet-like shape faces the guide plate 16.

The guide plate 16 is positioned so that the central portion thereof is an almost horizontal plane 16A in a transport direction of the photothermographic material 11 in a sheet-like shape and the end portion thereof on the upstream side in transport direction is bent to form a slope 16B. The guide plate 16 has a slope 16C in the same shape as the slope 16B on the downstream side thereof in the transport direction of the photothermographic material 11 in a sheet-like shape.

The photothermographic material 11 in a sheet-like shape enters in a way such that it slides down on the slope 16B and takes a transport route passing through the horizontal plane 16A, wherein a driving roller 17A provided facing the guide 16 imparts this transport force.

A driving roller 17A receives a driving force of driving means such as a motor not shown by way of transmission means such as a gear, a belt and rotates in a clockwise direction of FIG. 2. A driving roller 17B with the same construction as the driving roller 17A is provided at a boundary position between the slope 16C and the horizontal plane 16A for discharging of the photothermographic material 11 in a sheet-like shape. Description will be given of the driving roller 17A taking up it as an example with description of a driving roller 17B omitted.

The driving roller 17A is arranged so as to face a bending portion at a boundary between the horizontal plane 16A and the slope 16B.

In the above construction, the photothermographic material 11 in a sheet-like shape enters at the distal end of the slope 16B and advances into between the guide plate 16 and the driving roller 17A. At this time, since the guide plate 16 are bent between the horizontal plane 16A and the slope 16B, the photothermographic material 11 in a sheet-like shape is bent along the guide plate 16 to thus generate an elastic repulsive force of the photothermographic material 11 in a sheet-like shape itself. A predetermined frictional force is generated between the driving roller 17A and the photothermographic material 11 in a sheet-like shape by the elastic repulsive force to transport the photothermographic material 11 in a sheet-like shape by rotation of the driving roller 17A.

A scanning portion 20 is provided above the central portion of the guide plate 16 in a transport direction of the photothermographic material 11 in a sheet-like shape. The scanning portion 20 has a laser diode 22, controlled by a control portion 26, and irradiating laser beam. Furthermore, a modulating portion 23 modulating laser beam emitted from the laser diode 22 according to an image signal from the control portion 26. The laser beam B is modulated by the modulating portion 23 based on image data. The laser beam B outputted from the modulating portion 23 impinges on a reflecting face of a polygon mirror 24 rotating at high speed to thereby direct a reflecting light of the laser beam B in directions and to guide the reflecting light onto the photothermographic material 11 in a sheet-like shape on the guide plate 16 at a predetermined angle θ with optical members 28 such as a fθ lens, a cylindrical mirror. For this reason, the photothermographic material 11 in a sheet-like shape is scanned with laser beam B in a direction perpendicular to the transport direction (main scanning) and in addition, transportation (sub-scanning) is performed by the transport portion 14, thereby performing imagewise exposure.

A thermal development portion 34 is, as shown in FIG. 1, provided on the downstream side of the exposure portion 12. The thermal developing portion 34 is of a dry development type in which the photothermographic material 11 in a sheet-like shape is heated to thereby develop an image, all of the thermal development portion 34 is covered by a casing 36 and a insertion portion for the photothermographic material 11 in a sheet-like shape is provided at one end of the casing. A guide portion 32 (detailed later) is provided between the insertion portion and the last stage of the exposure portion 12 (the end portion on the downstream side of the guide plate 16 in the transport direction).

As a result, the leading end of the photothermographic material 11 in a sheet-like shape during scanning exposure in the exposure portion 12 advances into the thermal developing portion 34 by way of the guide portion 32.

Three blocks of developing units 38 are provided in an arc arrangement in the casing 36 of the thermal developing portion 34. The developing units 38 each include a heating plate 40 having an arc-shaped heating surface 40A on one surface thereof (a surface facing the photothermographic material 11 in a sheet-like shape) and plural rollers 42 holding the photothermographic material 11 in a sheet-like shape by pressing on both sides thereof with the help of the heating surface 40A.

The heating plate 40 is heated at predetermined temperatures by a heat source not shown and a control temperature can be altered, if necessary, in each block unit. A heat distribution even in a block can be adjusted.

The plural rollers 42 receive driving forces from respective driving means (not shown) to rotate at equal speeds. Herein, a transport speed in the thermal developing portion 34 is set to the same as or somewhat slightly lower than in the transport portion 14.

With such a construction and workings thereof adopted, the photothermographic material 11 in a sheet-like shape inserted from the insertion portion of the developing units 38 is transported at a predetermined speed and simultaneously heated to receive a heat necessary for development till the photothermographic material 11 in a sheet-like shape is discharged, thereby performing thermal development thereof.

The guide portion 32 provided between the transport portion 14 and the thermal developing portion 34 has, as shown FIG. 1, a bottom guide plate 32B supporting the photothermographic material 11 in a sheet-like shape. The bottom guide plate 32B is of an almost flat plate. A top guide plate 32A is provided above the bottom guide plate 32B facing it. A portion closer to the thermal developing portion 34 of the top guide plate 32A is positioned so as to be in parallel with the bottom guide plate 32B, the top guide plate 32A expands toward the transport portion 14 side from the central portion thereof in a direction moving away from the bottom guide plate 32B and a portion of the top guide plate 32A on the inner side is of an almost arc shape with a large curvature. A portion expanding in the direction moving away from the bottom guide plate 32B is formed, as an expanding portion 32C, so as not to be brought into contact with the recording surface 11A as a surface on which an image has been written of the photothermographic material 11 in a sheet-like shape when the photothermographic material 11 in a sheet-like shape is bent.

With such a construction adopted, a flection of the photothermographic material 11 in a sheet-like shape caused by a different between a transport speed in the transport portion 14 and that in the thermal developing portion 34 is allowed on the inner side of the top guide plate 32A. The photothermographic material 11 in a sheet-like shape is bent in the guide portion 32 to thereby absorb transport unevenness on the thermal developing portion side 34 generated by a difference in speed. Therefore, since a transport speed in the transport portion 14 is not affected by transport unevenness caused by a difference in speed, there occurs no image defect during scanning exposure due to transport unevenness. With the expanding portion 32C provided, the recording surface 11A of the photothermographic material 11 in a sheet-like shape can be avoided from a damage to be caused by rubbing between the recording surface 11A of the photothermographic material 11 in a sheet-like shape and the inner side of the top guide plate 32A in contact with each other.

If a transport speed in the transport portion 14 is V1 and a transport speed in the thermal developing portion 34 is V2 by definition, it is preferable to establish a relation of the order of $0.7<V2/V1\leqq 1.0$ and more preferable to establish a relation of the order of $0.97<V2/V1<0.99$. With the range adopted, a flection amount of the photothermographic material 11 in a sheet-like shape can be set in a proper range. Note that why the ratio is not more than 1.0 is to prevent generation of image defect in writing due to pulling of the photothermographic material 11 in a sheet-like shape to the thermal developing portion 34 side.

In such a way, the image recording apparatus 10 conducts exposure and thermal development simultaneously on one sheet of the photothermographic material 11 in a sheet-like shape, while a difference between a transport speed in the transport portion 14 and the transport speed in the thermal developing portion 34 is allowed in a predetermined range; thereby enabling a printing time to be reduced in stable workings.

3) Photographic Characteristic Curve

In the present invention, a photographic characteristic curve is a D-log E curve representing a relationship between the common logarithm (log E) of a light exposure, i.e., the exposure energy, and the optical density (D), i.e., a scattered light photographic density, by plotting the former on the abscissa and the latter on the ordinate. A gamma (γ) value represents a tangent angle when the optical density D on the photographic characteristic curve is 1.2 (i.e., γ value equals to tan θ when the angle between the tangent and the abscissa is θ).

The preferred photographic characteristic curve has a maximum optical density of 3.0 or more, and at the same time has a gamma value of 0.8 to 1.8 at an optical density of 0.5 and a gamma value of 2.2 to 3.8 at an optical density of 1.0. More preferably, a gamma value is 1.0 to 1.5 at an optical density of 0.5 and 2.5 to 3.5 at an optical density of 1.0.

The characteristic curve in the present invention can be shifted by various methods as mentioned above, such as by changing the amount of silver halide to be added, by changing the average grain size, by employing another method for chemical sensitization, by changing the degrees of ripening, or by changing the type or the amount of a spectral sensitizing dye adsorbing to the silver halides.

15. System

Examples of a medical laser imager equipped with a light exposing part and a thermal developing part include Fuji Medical Dry Laser Imager FM-DP L. In connection with FM-DPL, description is found in Fuji Medical Review No. 8, pages 39 to 55. It goes without mentioning that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

16. Application of the Invention

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

(Preparation of PET Support)

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C. Thereafter, the mixture was extruded from a T-die and rapidly cooled to form a non-tentered film having such a thickness that the thickness should become 175 μm after tentered and thermal fixation.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part were slit off, and both edges of the film were knurled. Then the film was rolled up at the tension of 4 kg/cm$^2$ to obtain a roll having the thickness of 175 μm.

(Surface Corona Discharge Treatment)

Both surfaces of the support were treated at room temperature at 20 m/minute using Solid State Corona Discharge Treatment Machine Model 6KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

(Preparation of Undercoated Support)

(1)Preparation of Coating Solution for Undercoat Layer

Formula (1) (for undercoat layer on the image forming layer side)

| | |
|---|---|
| Pesresin A-520 manufactured by Takamatsu Oil & Fat Co., Ltd. (30% by weight solution) | 59 g |
| polyethyleneglycol monononylphenylether (average ethylene oxide number = 8.5) 10% by weight solution | 5.4 g |
| MP-1000 manufactured by Soken Chemical & Engineering Co., Ltd. (polymer fine particle, mean particle diameter of 0.4 μm) | 0.91 g |
| distilled water | 935 mL |

Formula (2) (for first layer on the back surface)

| | |
|---|---|
| Styrene-butadiene copolymer latex (solid content of 40% by weight, styrene/butadiene weight ratio = 68/32) | 158 g |
| 8% by weight aqueous solution of 2,4-dichloro-6-hydroxy-S-triazine sodium salt | 20 g |
| 1% by weight aqueous solution of sodium laurylbenzenesulfonate | 10 mL |
| distilled water | 854 mL |

Formula (3) (for second layer on the back surface)

| | |
|---|---|
| $SnO_2$/SbO (9/1 weight ratio, mean particle diameter of 0.038 μm, 17% by weight dispersion) | 84 g |

-continued

| | |
|---|---|
| gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| distilled water | 805 mL |

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse face (back surface) with a wire bar so that the amount of wet coating became 5.7 mL/m$^2$, and dried at 180° C. for 5 minutes. Furthermore, the aforementioned formula (3) of the coating solution for the undercoat was coated on the reverse face (back surface) with a wire bar so that the amount of wet coating became 7.7 mL/m$^2$, and dried at 180° C. for 6 minutes. Thus, an undercoated support was produced.

(Preparation of Coating Solution for Back Layer)

<<Preparation of Coating Solution for Antihalation Layer>>

60 g of gelatin, 24.5 g of polyacrylamide, 2.2 g of a 1 mol/L aqueous sodium hydroxide solution, 2.4 g of monodispersed polymethyl methacrylate fine particles (mean particle size of 8 μm, standard deviation of particle diameter of 0.4), 0.08 g of benzoisothiazolinone, 0.3 g of sodium polystyrenesulfonate, 0.21 g of blue dye-1, 0.15 g of yellow dye-1, and 8.3 g of acrylic acid/ethyl acrylate copolymer latex (copolymerization rate 5/95) were mixed. Then, water was added to give the total volume of 818 mL to prepare a coating solution for the antihalation layer.

<<Preparation of Coating Solution for Back Surface Protective Layer>>

A vessel was kept at 40° C., and thereto were added 40 g of gelatin, liquid paraffin emulsion at 1.5 g equivalent to liquid paraffin, 35 mg of benzoisothiazolinone, 6.8 g of a 1 mol/L aqueous sodium hydroxide solution, 0.5 g of sodium t-octylphenoxyethoxyethanesufonate, 0.27 g of sodium polystyrenesulfonate, 5.4 mL of a 2% by weight solution of a fluorocarbon surface active agent (FF-1), 6.0 g of acrylic acid/ethyl acrylate copolymer latex (copolymer weight ratio of 5/95), and 2.0 g of N,N'-ethylene-bis(vinylsufoneacetamide) were admixed. Then water was added to give the volume of 1000 mL to prepare a coating solution for the back surface protective layer.

(Preparation of Silver Halide Emulsion)

<<Preparation of Silver Halide Emulsion-1>>

To 1420 mL of distilled water was added 4.3 mL of a 1% by weight potassium iodide solution. Further, a liquid added with 3.5 mL of 0.5 mol/L sulfuric acid and 36.7 g of phthalated gelatin was kept at 42° C. while stirring in a stainless steel reaction pot, and thereto were added total amount of: solution A prepared through diluting 22.22 g of silver nitrate by adding distilled water to give the volume of 195.6 mL; and solution B prepared through diluting 21.8 g of potassium iodide with distilled water to give the volume of 218 mL, over 9 minutes at a constant flow rate. Thereafter, 10 mL of a 3.5% by weight aqueous solution of hydrogen peroxide was added thereto, and 10.8 mL of a 10% by weight aqueous solution of benzimidazole was further added.

Moreover, a solution C prepared through diluting 51.86 g of silver nitrate by adding distilled water to give the volume of 317.5 mL and a solution D prepared through diluting 60 g of potassium iodide with distilled water to give the volume of 600 mL were added. A controlled double jet method was executed through adding total amount of the solution C at a constant flow rate over 120 minutes, accompanied by adding the solution D while maintaining the pAg at 8.1. Hexachloroiridium (III) potassium salt was added to give $1\times10^{-4}$ mol per one mol of silver at 10 minutes post initiation of the addition of the solution C and the solution D in its entirety. Moreover, at 5 seconds after completing the addition of the solution C, a potassium iron (II) hexacyanide aqueous solution was added at a total amount of $3\times10^{-4}$ mol per one mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-mentioned silver halide dispersion was kept at 38° C. with stirring, and thereto was added 5 mL of a 0.34% by weight methanol solution of 1,2-benzoisothiazoline-3-one, followed by elevating the temperature to 47° C. At 20 minutes after elevating the temperature, sodium benzene thiosulfonate in a methanol solution was added at $7.6\times10^{-5}$ mol per one mol of silver. At additional 5 minutes later, a tellurium sensitizer C in a methanol solution was added at $2.9\times10^{-4}$ mol per one mol of silver and subjected to aging for 91 minutes.

Thereto was added 1.3 mL of a 0.8% by weight N,N'-dihydroxy-N",N"-diethylmelamine in methanol, and at additional 4 minutes thereafter, 5-methyl-2-mercaptobenzimidazole in a methanol solution at $4.8\times10^{-3}$ mol per one mol of silver, 1-phenyl-2-heptyl-5-mercapto-1,3,4-triazole in a methanol solution at $5.4\times10^{-3}$ mol per one mol of silver were added to produce a silver halide emulsion-1.

Grains in thus prepared silver halide emulsion were pure silver iodide grains having a mean sphere equivalent diameter of 0.040 μm, a variation coefficient of 18%. Grain size and the like were determined from the average of 1000 grains using an electron microscope.

<<Preparation of Silver Halide Emulsion-2>>

Preparation of silver halide emulsion-2 was conducted in a similar manner to the process in the preparation of the silver halide emulsion-1 except that: the temperature of the reaction solution was altered to 65° C., and 5mL of a 5% by weight 2,2'-(ethylenedithio)diethanol in methanol was added after adding the solutions A and B. Grains in thus prepared silver halide emulsion were pure silver iodide grains having a mean sphere equivalent diameter of 0.075 μm, a variation coefficient of 23%. Grain size and the like were determined from the average of 1000 grains using an electron microscope.

<<Preparation of Silver Halide Emulsion-3>>

Preparation of silver halide emulsion-3 was conducted in a similar manner to the process in the preparation of the silver halide emulsion-1 except that the temperature of the reaction solution was altered to 27° C. Grains in thus prepared silver halide emulsion were pure silver iodide grains having a mean sphere equivalent diameter of 0.022 μm, a variation coefficient of 17%. Grain size and the like were determined from the average of 1000 grains using an electron microscope.

<<Preparation of Silver Halide Emulsion-1 for Coating Solution>>

The silver halide emulsion-1 was dissolved, and thereto was added benzothiazolium iodide at $7\times10^{-3}$ mol per one mol of silver with a 1% by weight aqueous solution. Further, water was added thereto to give the content of silver of 38.2 g per one kg of the emulsion for a coating solution, and 1-(3-methylureidophenyl)-5-mercaptotetrazole was added to give 0.34 g per 1 kg of the emulsion for a coating solution.

Further, as "a compound that can be one-electron-oxidized to provide a one-electron oxidation product, which releases one or more electrons", the compounds Nos.2, 20 and 26 were added respectively in the amount of $2\times10^{-3}$ mol per one mol of silver halide.

<<Preparations of Silver Halide Emulsion-2 and -3 for Coating Solution>>

Preparations of silver halide emulsion-2 and -3 for coating solution were conducted in the similar manner to the preparation of silver halide emulsion-1 for coating solution except that using silver halide emulsion-2 or -3 instead of using silver halide emulsion-1.

<<Preparation of Mixed Emulsion A for Coating Solution>>

The silver halide emulsion-1 and the silver halide emulsion-2 at the rate of (silver halide emulsion-1 silver halide emulsion-2=) 8:2 by mol of silver were dissolved, and thereto was added benzothiazolium iodide at $7\times10^{-3}$ mol per one mol of silver with a 1% by weight aqueous solution. Further, water was added thereto to give the content of silver of 38.2 g per one kg of the mixed emulsion for a coating solution, and 1-(3-methylureidophenyl)-5-mercaptotetrazole was added to give 0.34 g per 1 kg of the mixed emulsion for a coating solution.

Further, as "a compound that can be one-electron-oxidized to provide a one-electron oxidation product, which release one or more electrons", the compounds Nos.2, 20 and 26 were added in the amount of $2\times10^{-3}$ mol per one mol of silver halide respectively.

<<Preparations of Mixed Emulsion B to E for Coating Solution>>

Preparations of mixed emulsion B to E for coating solution were conducted in the similar manner to the preparation of mixed emulsion A for coating solution except that changing kinds and rates of silver halide emulsions as shown in Table 3 instead of using silver halide emulsion-1 and silver halide emulsion-2.

(Preparation of Dispersion of Silver Salt of Fatty Acid A)

87.6 kg of behenic acid (Henkel Co., trade name: Edenor C22-85R), 423 L of distilled water, 49.2 L of an aqueous sodium hydroxide solution at the concentration of 5 mol/L, 120 L of t-butyl alcohol were admixed, and subjected to a reaction with stirring at 75° C. for one hour to give a solution A of a sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution A of a sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution A of a sodium behenate was thereafter started, and during 14 minutes and 15 seconds following the completion of adding the aqueous silver nitrate solution, the added material was restricted to the solution A of a sodium behenate alone. The temperature inside of the reaction vessel was then set to be 30° C., and the temperature outside was controlled so that the liquid temperature could be kept constant. In addition, the temperature of a pipeline for the addition system of the solution A of a sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution A of a sodium behenate was added and the position at which the aqueous silver nitrate solution was added were arranged symmetrically with a shaft for stirring located at a center. Moreover, both of the positions were adjusted to avoid contact with the reaction liquid.

After completing the addition of the solution A of a sodium behenate, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of the fatty acids was thus obtained. The resulting solid matters were stored as a wet cake without drying.

When the shape of the resulting particles of the silver behenate was evaluated by an electron micrography, a flake crystal was revealed having a=0.14 μm, b=0.4 μm and c=0.6 μm on the average value, with a mean aspect ratio of 5.2, a mean sphere equivalent diameter of 0.52 μm and a variation coefficient of 15% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1260 kg/cm$^2$ to give a dispersion of the silver behenate. For the cooling manipulation, coiled heat exchangers were equipped fore and aft of the interaction chamber respectively, and accordingly, the temperature for the dispersion was set to be 18° C. by regulating the temperature of the cooling medium.

(Preparation of Reducing Agent Dispersion)

<<Preparation of Reducing Agent-1 Dispersion>>

To 10 kg of a reducing agent-1 (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to thermal treatment at 60° C. for 5 hours to obtain a reducing agent-1 dispersion. Particles of the reducing agent included in thus resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of a reducing agent-2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent thermal treatment at 80° C. for one hour to obtain a reducing agent-2 dispersion. Particles of the reducing agent included in thus resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

(Preparation of Hydrogen Bonding Compound-1 Dispersion)

To 10 kg of a hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent thermal treatment at 80° C. for one hour to obtain a hydrogen bonding compound dispersion. Particles of the hydrogen bonding compound included in thus resulting hydrogen bonding compound-I dispersion had a median diameter of 0.45 μm, and a maximum particle diameter of 1.3 μm or less. The resultant hydrogen bonding compound-1 dispersion was subjected to filtration with a polypropylene filter having a pore size of 3.0 μm to remove foreign substances such as dust, and stored.

(Preparation of Development Accelerator-1 Dispersion)

To 10 kg of a development accelerator-1 and 20 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minuets. Thereafter, 0.2 g of a benzoisothiazolinone sodium salt and water were added thereto, thereby adjusting the concentration of the development accelerating agent to be 20% by weight. Accordingly, a development accelerator-1 dispersion was obtained. Particles of the development accelerator included in thus resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of a development accelerator-2 and a color-tone-adjusting agent-1, dispersion was executed in a similar manner to the development accelerator-1, and thus dispersions of 20% by weight and 15% by weight were respectively obtained.

(Preparation of Polyhalogen Compound Dispersion)

<<Preparation of Organic Polyhalogen Compound-1 Dispersion>>

An organic polyhalogen compound-1 (tribromomethane sulfonylbenzene) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. Accordingly, an organic polyhalogen compound-1 dispersion was obtained. Particles of the organic polyhalogen compound included in thus resulting polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

An organic polyhalogen compound-2 (N-butyl-3-tribromomethane sulfonylbenzoamide) in an amount of 10 kg, 20 kg of a 10% by weight aqueous solution of modified polyvinyl alcohol (manufactured by Kuraray Co., Ltd., Poval MP203) and 0.4 kg of a 20% by weight aqueous solution of sodium triisopropylnaphthalenesulfonate were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain an organic polyhalogen compound-2 dispersion. Particles of the organic polyhalogen compound included in thus resulting polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

(Preparation of Phthalazine Compound-1 Solution)

Modified polyvinyl alcohol MP203 manufactured by Kuraray Co., Ltd., in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of a phthalazine compound-1 (6-isopropyl phthalazine) to prepare a 5% by weight phthalazine compound-1 solution.

(Preparation of Mercapto Compound)

<<Preparation of an Aqueous Solution of Mercapto Compound-1>>

A mercapto compound-1 (1-(3-sulfophenyl)-5-mercaptotetrazole sodium salt) in an amount of 7 g was dissolved in 993 g of water to give a 0.7% by weight aqueous solution.

<<Preparation of an Aqueous Solution of Mercapto Compound-2>>

A mercapto compound-2 (1-(3-methylureidophenyl)-5-mercaptotetrazole) in an amount of 20 g was dissolved in 980 g of water to give a 2.0% by weight aqueous solution.

(Preparation of Pigment-1 Dispersion)

C.I. Pigment Blue 60 in an amount of 64 g and 6.4 g of DEMOL N manufactured by Kao Corporation were added to 250 g water and thoroughly mixed to give slurry. Zirconia beads having the mean particle diameter of 0.5 mm were provided in an amount of 800 g, and charged in a vessel with the slurry. Dispersion was performed with a dispersing machine (¼G sand grinder mill: manufactured by IMEX Co., Ltd.) for 25 hours. Thereto was added water to adjust so that the concentration of the pigment became 5% by weight to obtain a pigment-1 dispersion. Particles of the pigment included in thus resulting pigment dispersion had a mean particle diameter of 0.21 μm.

(Preparation of SBR Latex Solution)

SBR latex was prepared as described below.

To a polymerization tank of a gas monomer reaction apparatus (manufactured by Taiatsu Techno Corporation, TAS-2J type), were charged 287 g of distilled water, 7.73 g of a surface active agent (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Tereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ration of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had the mean particle diameter of 90 nm, Tg of 17° C., solid matter concentration of 44% by weight, the equilibrium moisture content at 25° C., 60% RH of 0.6% by weight, ionic conductance of 4.80 mS/cm (measurement of the ionic conductance performed using a conductivity meter CM-30S manufactured by Toa Electronics Ltd. for the latex stock solution (44% by weight) at 25° C.) and pH of 8.4.

(Preparation of Coating Solutions)

<<Preparation of Coating Solution for Image Forming Layer-1>>

To the dispersion A of the silver behenate obtained as described above in an amount of 1000 g and 276 mL of water were serially added the pigment-1 dispersion, the organic polyhalogen compound-1 dispersion, the organic polyhalogen compound-2 dispersion, the phthalazine compound-i solution, the SBR latex (Tg: 17° C.) solution, the reducing agent-1 dispersion, the reducing agent-2 dispersion, the hydrogen bonding compound-1 dispersion, the development accelerator-1 dispersion, the development accelerator-2 dispersion, the color-tone-adjusting agent-1 dispersion, the mercapto compound-i aqueous solution and the mercapto compound-2 aqueous solution. The coating solution for the image forming layer prepared by adding the silver halide emulsion-i for coating solution thereto followed by thorough mixing just prior to the coating was fed directly to a coating die, and was coated.

<<Preparations of Coating Solution for Image Forming Layer-2 to -8>>

Preparations of coating solution for image forming layer-2 to -8 were conducted in the similar manner to the preparation of coating solution for image forming layer-1, except that using one of the silver halide emulsion-2 and -3 for coating solution and the mixed emulsion A to F for coating solution, instead of using the silver halide emulsion-1 for coating solution.

Viscosity of the coating solution for the image forming layer was measured with a B type viscometer from Tokyo Keiki, and was revealed to be 25 [mPa·s] at 40° C. (No. 1 rotor, 60 rpm).

Viscosity of the coating solution at 25° C. when it was measured using RFS fluid spectrometer manufactured by Rheometrix Far-East Co. Ltd. was 242, 65, 48, 26, and 20 [mPa·s], respectively, at the shearing rate of 0.1, 1, 10, 100, 1000 [1/second].

The amount of zirconium in the coating solution was 0.52 mg per one g of silver.

(Preparation of Coating Solution for Intermediate Layer)

To 1000 g of polyvinyl alcohol PVA-205 (manufactured by Kuraray Co., Ltd.), 272 g of the pigment-1 dispersion, and 4200 mL of a 19% by weight solution of methyl methacrylate/styrene/butyl acrylate/hydroxyethyl methacrylate/acrylic acid copolymer (weight ratio of the copolymerization of 64/9/20/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with sodium hydroxide to give the pH of 7.5. Accordingly, the coating solution for the intermediate layer was prepared, and was fed to a coating die to provide 9.1 mL/$m^2$.

Viscosity of the coating solution was 58 [mPa·s] which was measured with a B type viscometer at 40° C. (No. 1 rotor, 60 rpm).

(Preparation of Coating Solution for First Layer of Surface Protective Layers)

In water was dissolved 64 g of inert gelatin, and thereto were added 112 g of a 19% by weight solution of methyl methacrylate/styrene/butyl acrylate/hydroxyethyl methacrylate/acrylic acid copolymer (weight ratio of the copolymerization of 64/9/20/5/2) latex, 30 mL of a 15% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT (manufactured by American Cyanamid Co.), 0.5 g of phenoxyethyl alcohol, and 0.1 g of benzoisothiazolinone. Water was added to give total amount of 750 g. Immediately before coating, 26 mL of a 4% by weight chrome alum which had been mixed with a static mixer was fed to a coating die so that the amount of the coating solution became 18.6 mL/m$^2$.

Viscosity of the coating solution was 20 [mPa·s] which was measured with a B type viscometer at 40° C. (No. 1 rotor, 60 rpm).

(Preparation of Coating Solution for Second Layer of Surface Protective Layers)

In 800 mL of water were dissolved 80 g of inert gelatin and thereto were added 102 g of a 27.5% by weight solution of methyl methacrylate/styrene/butyl acrylate/hydroxyethyl methacrylate/acrylic acid copolymer (weight ratio of the copolymerization of 64/9/20/5/2) latex, 5.4 mL of a 2% by weight solution of a fluorocarbon surface active agent (F-1), 5.4 mL of a 2% by weight aqueous solution of a fluorocarbon surface active agent (F-2), 23 mL of a 5% by weight aqueous solution of aerosol OT (manufactured by American Cyanamid Co.), 4 g of polymethyl methacrylate fine particles (mean particle diameter of 0.7 μm) and 21 g of polymethyl methacrylate fine particles (mean particle diameter of 4.5 μm), 1.6 g of 4-methyl phthalic acid, 44 mL of 0.5 mol/L sulfuric acid, and 10 mg of benzoisothiazolinone. Water was added to give total amount of 650 g. Immediately before coating, 445 mL of a aqueous solution containing 4% by weight chrome alum and 0.67% by weight phthalic acid was mixed to give a coating solution for the second surface protective layer, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

<<Coating of Photothermographic Material-1>>

The back surface side of the undercoated support was subjected to simultaneous double coating so that the coating solution for the antihalation layer gives the coating amount of gelatin of 0.88 g/m$^2$, and so that the coating solution for the back surface protective layer gives the coating amount of gelatin of 1.2 g/m$^2$, followed by drying to produce a back layer.

Reverse surface of the back surface was subjected to simultaneous overlaying coating by a slide bead coating method in order of the image forming layer, intermediate layer, first layer of the surface protective layer and second layer of the surface protective layer starting from the undercoated face, and thus a sample of the photothermographic material was produced. In this method, the temperature of the coating solution was adjusted to 31° C. for the image forming layer and intermediate layer, to 36° C. for the first layer of the surface protective layer, and to 37° C. for the second layer of the surface protective layer.

The coating amount of each compound for the image forming layer (g/m$^2$) is as follows.

| | |
|---|---|
| Silver salt of fatty acid | 5.27 |
| Pigment (C.I. Pigment Blue 60) | 0.036 |
| Polyhalogen compound-1 | 0.09 |
| Polyhalogen compound-2 | 0.14 |
| Phthalazine compound-1 | 0.18 |
| SBR latex | 9.43 |
| Reducing agent-1 | 0.55 |
| Reducing agent-2 | 0.22 |
| Hydrogen bonding compound-1 | 0.28 |
| Development accelerator-1 | 0.025 |
| Development accelerator-2 | 0.020 |

-continued

| | |
|---|---|
| Color-tone-adjusting agent-1 | 0.008 |
| Mercapto compound-1 | 0.002 |
| Mercapto compound-2 | 0.006 |
| Siiver halide (on the basis of Ag content) | 0.046 |

Conditions for coating and drying are as follows.

The support was decharged by ionic wind, and coating was performed at the speed of 160 m/min.

The clearance between the leading end of the coating die and the support being 0.10 mm to 0.30 mm, and with the pressure in the vacuum chamber set to be lower than atmospheric pressure by 196 Pa to 882 Pa. In the subsequent cooling zone, the coating solution was cooled by wind having the dry-bulb temperature of 10° C. to 20° C. Thereafter, transportation with no contact was carried out, and the coated support was dried with an air of the dry-bulb of 23° C. to 45° C. and the wet-bulb of 15° C. to 21° C. in a helical type contactless drying apparatus. After drying, moisture conditioning was performed at 25° C. in the humidity of 40% RH to 60% RH. Then, the film surface was heated to be 70° C. to 90° C. After heating, the film surface was cooled to 25° C.

Thus prepared photothermographic material had the matness of 550 seconds on the image forming layer side surface, and 130 seconds on the back surface as Beck's smoothness. In addition, measurement of the pH of the film surface on the image forming layer side surface gave the result of 6.0.

Chemical structures of the compounds used in Examples of the invention are shown below.

Blue dye-1

Bue dye-1

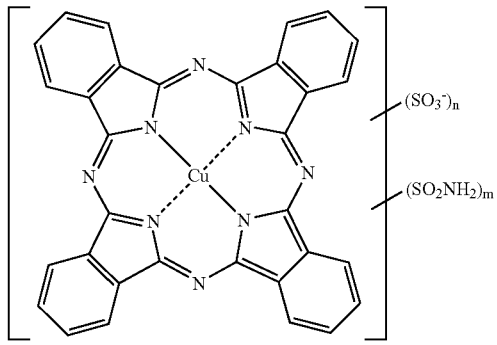

n = 1~3
m = 1~3

Yellow dye-1

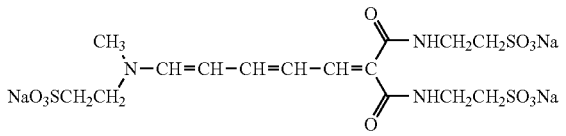

(Reducing agent-1)

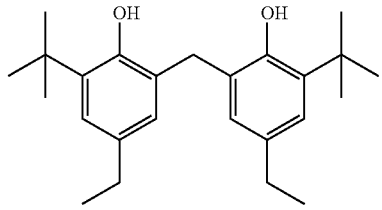

-continued (Reducing agent-2)

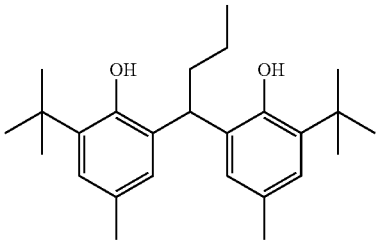

(Hydrogen bonding compound-1)

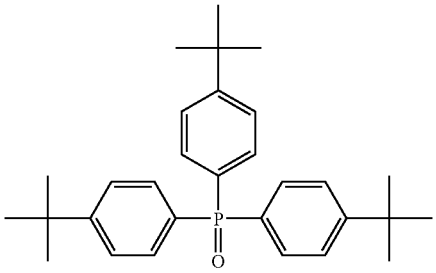

Pokyhalogen compound-1

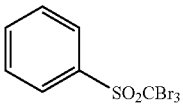

Polyhalogen compound-2

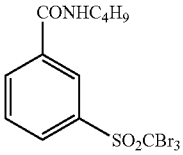

(Phthalazine compound-1)

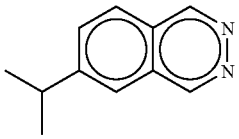

(Development accelerator-1)

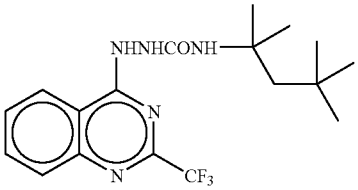

(Development accelerator-2)

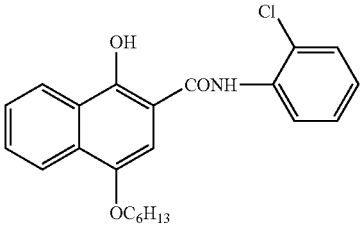

-continued (Color-tone-adjusting agent-1)

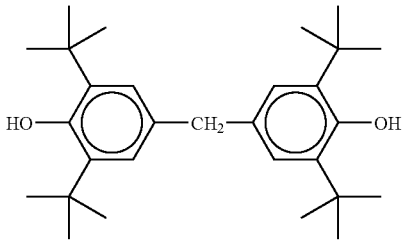

(F-1)

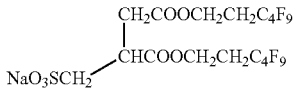

(F-2)

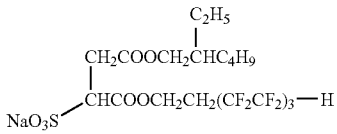

(FF-1)

$C_8F_{17}SO_3K$ (Evaluation of Photographic Performances)

<<Preparation>>

The resulting sample was cut into a half-cut size (43 cm in length×35 cm in width), and was wrapped with the following packaging material under an environment of 25° C. and 50% RH, and stored for 2 weeks at an ambient temperature.

<<Packaging Material>>

PET 10 μm/PE 12 μm/aluminum foil 9 μm/Ny 15 μm/polyethylene 50 μm containing carbon at 3% by weight, oxygen permeability: 0.02 mL/atm·$m^2$·25° C. day, vapor permeability: 0.10 g/atm·$m^2$·25° C. day.

<<Exposure and Thermal Development>>

Exposure was performed on specimens using a Fuji medical dry laser imager FM-DP L in which a NLHV 3000E laser diode fabricated by Nichia Corporation as a laser diode beam source was mounted in an exposure portion thereof and a beam diameter thereof was adjusted to about 100 μm. Other exposure conditions were as follows: exposure of a photothermographic material was performed for $10^{-6}$ sec with a photothermographic material surface illuminance at 0 mW/$mm^2$ and at various values from 1 mW/$mm^2$ to 1000 mW/$mm^2$. A light-emission wavelength of laser beam was 405 nm. Thermal development was performed in conditions that 4 panel heaters were set to be 112° C.-118° C.-120° C.-120° C., and a total thermal development time was set to 14 sec at an increased transport speed. Evaluation on an image obtained was performed with a densitometer.

<<Evaluation of Fog>>

Evaluation of the unexposed part of photosensitive material was carried out with Macbeth TD904 densitometer (visible density). Results of the measurement were evaluated for the minimal density, Dmin (fog).

<<Evaluation of Sensitivity>>

Sensitivity was measured and expressed by the common logarithm of exposure value which gives the blackening density of 0.3. Evaluation was carried out by calculating difference (Δ log E) between the value of the photothermographic material-1 (log $E_1$) and the value of a sample (log $E_2$). That is, Δ log E was calculated according to the following equation.

$$\Delta \log E = \log E_2 - \log E_1$$

<<Calculating a Gamma Value>>

An optical density of the developed photothermographic materials was measured, and a gamma value was calculated through a characterisitic curve. A photographic characterisitic curve is a D-log E curve, where the vertical axis is an optical density (a photographic diffuse density D), and the horizontal axis is a logarithmic value of an exposure amount which is an exposure energy.

In the present examples, gamma values are obtained by calculating gradients of tangents at optical densities of D=0.5 and D=1.0 in a photographic characterisitic curve, that is a tan θ where is θ an angle between a tangent and a horizontal axis.

TABLE 1

| Photothermographic material | Silver halide emulsion No. | Particle size (nm) | Mixing ratio by Ag mol | Sensitivity Dmin | ⊿logE | Dmax | γ value D = 0.5 | D = 1.0 |
|---|---|---|---|---|---|---|---|---|
| 1 | 1 | 40 | 100 | 0.15 | 0 | 4.1 | 2.2 | 4.0 |
| 2 | 2 | 75 | 100 | 0.16 | 0.62 | 2.8 | 2.0 | 3.9 |
| 3 | 3 | 22 | 100 | 0.14 | −0.28 | 4.9 | 2.4 | 4.5 |
| 4 | 1 | 40 | 80 | 0.16 | 0.27 | 3.9 | 1.6 | 3.0 |
| | 2 | 75 | 20 | | | | | |
| 5 | 3 | 22 | 80 | 0.16 | 0.15 | 4.4 | 1.0 | 3.2 |
| | 2 | 75 | 20 | | | | | |
| 6 | 3 | 22 | 30 | 0.15 | 0.21 | 4.0 | 1.5 | 2.9 |
| | 1 | 40 | 50 | | | | | |
| | 2 | 75 | 20 | | | | | |
| 7 | 1 | 40 | 70 | 0.16 | 0.29 | 3.8 | 1.2 | 2.9 |
| | 2 | 75 | 30 | | | | | |
| 8 | 1 | 40 | 90 | 0.16 | 0.10 | 4.2 | 1.7 | 3.3 |
| | 2 | 75 | 10 | | | | | |

<<Results>>

As shown in Table 1, photothermographic materials using two or more kinds of silver halide emulsion-1 to -3 which show different sensitivities for light of the same wavelength, that are photothermographic materials-4 to -8, have small gamma value at optical densities 0.5 and 1.0 even using silver halide having high content of silver iodide, and excellent performances presenting soft gradation were obtained.

Example 2

<<Preparations of Photothermographic Material-9 to -13>>

Preparations of photothermographic material-9 to -13 were conducted in the similar manner to the preparation of photothermographic material-1, except that two or more image forming layers was set as shown in Table 2, while a sample of the photothermographic material was produced by subjecting reverse surface of the back surface to simultaneous overlaying coating by a slide bead coating method in order of the image forming layer, intermediate layer, first layer of the surface protective layer and second layer of the surface protective layer starting from the undercoated face.

Other preparations and evaluations were executed in the similar manner to Example 1. Results are shown in Table 2. In the table, the layers are called from near side of the support; lower layer, middle layer and upper layer.

TABLE 2

| Photothermographic material | Silver halide emulsion No. | Particle size (nm) | Mixing ratio by Ag mol | Sensitivity Dmin | ⊿logE | Dmax | γ value D = 0.5 | D = 1.0 |
|---|---|---|---|---|---|---|---|---|
| 9 | upper layer | 75 | 20 | 0.15 | 0.26 | 3.9 | 1.6 | 3.0 |
| | lower layer | 40 | 80 | | | | | |
| 10 | upper layer | 75 | 20 | 0.15 | 0.14 | 4.3 | 1.1 | 3.3 |
| | lower layer | 22 | 80 | | | | | |
| 11 | upper layer | 75 | 20 | 0.15 | 0.20 | 4.1 | 1.4 | 3.2 |
| | middle layer | 40 | 50 | | | | | |
| | lower layer | 22 | 30 | | | | | |
| 12 | upper layer | 75 | 30 | 0.16 | 0.28 | 3.8 | 1.0 | 3.0 |
| | lower layer | 40 | 70 | | | | | |
| 13 | upper layer | 75 | 10 | 0.15 | 0.09 | 4.2 | 1.7 | 3.4 |
| | lower layer | 40 | 90 | | | | | |

As shown in Table 2, photothermographic materials using two or more kinds of silver halide emulsion-1 to -3 which show different sensitivities for light of the same wavelength in different layers have small gamma value at optical densities 0.5 and 1.0 even using silver halide having high content of silver iodide, and excellent performances presenting soft gradation were obtained.

Example 3

(Preparation of Silver Halide Emulsion-4)

To 1420 mL of distilled water was added 4.3 mL of a 1% by weight potassium iodide solution, further, added 3.5 mL of 0.5 mol/L sulfuric acid and 36.7 g of phthalated gelatin, and the resulted solution was kept at 42° C., while stirring in a stainless reaction bottle, and solution A prepared by diluting 22.22 g of silver nitrate in distilled water to give a volume of 95.4 mL and solution B prepared by diluting 11.1 g of potassium bromide and 6.6 g of potassium iodide in distilled water to give a volume of 103 mL, were added in their entireties to the solution, over 3 minutes. Then, 10 mL of a 3.5% by weight hydrogen peroxide aqueous solution was added, further, 10.8 mL of a 10% by weight benzimidazole aqueous solution was added. Further, solution C prepared by adding distilled water to 51.86 g of silver nitrate for dilution to 317.5 mL was added at constant flow rate in its entirety over 50 minutes and solution D prepared by diluting 32.04 g of potassium bromide and 19.16 g of potassium iodide in distilled water to give a volume of 400 mL was added by a controlled double jet method while maintaining pAg at 9.1. Then, solution E prepared by diluting 10 g of potassium iodide with distilled water to give a volume of 400 mL was added at constant flow rate in its entirety over 5 minutes. A potassium iridiate (III) hexachloride was added in its entirety 10 minutes after initiation of addition of solution C and solution D so as to give a concentration of $1\times10^{-4}$ per mol of silver. Further, a potassium iron (II) hexacyanide aqueous solution was added in its entirety at a concentration of $3\times10^{-4}$ mol per mol of silver 5 seconds after completion of addition of solution E. PH was controlled to 3.8 using 0.5 mol/L sulfuric acid, and stirring was stopped, and precipitation/de-salting/water-washing process were conducted. pH was controlled to 5.9 using 1 mol/L sodium hydroxide, and pAg was controlled to 9.6 using 10% by weight aqueous solution of potassium bromide to produce a silver halide dispersion.

The above-mentioned silver halide dispersion was maintained at 38° C. while stirring, and to this was added 5 mL of a 0.34% by weight methanol solution of 1,2-benzoisothiazolin-3-one and after 40 minutes was added methanol solution of spectral sensitizer A and sensitizer B (spectral sensitizer A/sensitizer B=1/1 by mol) in the amount of $1.2\times10^{-3}$ mol in total of sensitizers A and B per one mol of silver, and the mixture was heated up to 47° C. after one minutes. 20 minutes after heating, sodium benzenethiosulfonate was added as a methanol solution in a proportion of $7.6\times10^{-5}$ mol per one mol of silver, then, 5 minutes after, tellurium sensitizer C was added as a methanol solution in a proportion of $2.9\times10^{-4}$ mol per one mol of silver and the mixture was aged for 91 minutes. Then, 1.3 mL of a 0.8% by weight methanol solution of N,N'-dihydroxyl-N",N"-diethylmelamine was added, further 4 minutes after, 5-methyl-2-mercaptobenzimidazole was added as a methanol solution in a proportion of $4.8\times10^{-3}$ mol per one mol of silver and 1-phenyl-2-heptyl-5-mercapto-1,3,4-triazole was added in a proportion of $5.4\times10^{-3}$ mol per one mol of silver, to produced a silver halide emulsion-4.

Grains in thus prepared silver halide emulsion were silver iodobromide grains containing 44 mol % silver iodide in average having a mean sphere equivalent diameter of 0.040 μm, a variation coefficient of 18%. Grain size and the like were determined from the average of 1000 grains using an electron microscope.

(Preparation of Silver Halide Emulsion-5)

Preparation of silver halide emulsion-5 was conducted in a similar manner to the process in the preparation of the silver halide emulsion-4 except that: the temperature of the reaction solution was altered to 65° C., and 5mL of a 5% by weight 2,2'-(ethylenedithio)diethanol in a methanol was added after adding the solutions A and B.

Grains in thus prepared silver halide emulsion were silver iodobromide grains containing 44 mol % silver iodide in average having a mean sphere equivalent diameter of 0.075 μm, a variation coefficient of 18%. Grain size and the like were determined from the average of 1000 grains using an electron microscope.

(Preparation of Silver Halide Emulsion-6)

Preparation of silver halide emulsion-6 was conducted in a similar manner to the process in the preparation of the silver halide emulsion-4 except that the temperature of the reaction solution was altered to 27° C.

Grains in thus prepared silver halide emulsion were silver iodobromide grains containing 44 mol % silver iodide in average having a mean sphere equivalent diameter of 0.022 μm, a variation coefficient of 18%. Grain size and the like were determined from the average of 1000 grains using an electron microscope.

Chemical structures of the compounds used in Examples of the invention are shown below.

Spectral sensitizer A

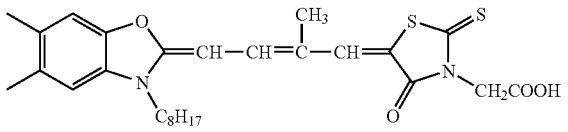

Spectral sensitizer B

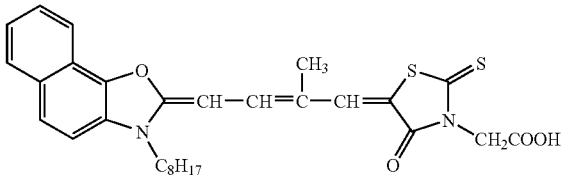

Tellurium sensitizer C

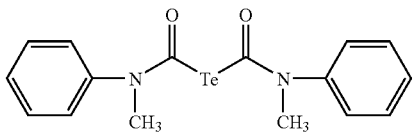

Photothermographic materials were prepared in the similar manner to Example 1 except that using above-mentioned silver halide emulsion-4 to -6. Further, evaluations were conducted similar to Example 1. Results are shown in Table 3.

As shown in Table 3, results were similar to Example 1 even using silver iodobromide grains containing 44 mol % silver iodide in average. That is, photothermographic materials using two or more kinds of silver halide emulsion-4 to -6 which show different sensitivities for a light of the same wavelength have small gamma value at optical densities 0.5 and 1.0, and excellent performances presenting soft gradation were obtained.

TABLE 3

| Photothermographic material | Silver halide emulsion No. | Particle size (nm) | Mixing ratio by Ag mol | Sensitivity Dmin | ⊿logE | Dmax | γ value D = 0.5 | D = 1.0 |
|---|---|---|---|---|---|---|---|---|
| 14 | 4 | 40 | 100 | 0.16 | 0.08 | 4.0 | 2.0 | 4.0 |
| 15 | 5 | 75 | 100 | 0.16 | 0.68 | 2.6 | 1.9 | 3.9 |
| 16 | 6 | 22 | 100 | 0.16 | −0.15 | 4.6 | 2.2 | 4.3 |
| 17 | 4 | 40 | 80 | 0.16 | 0.28 | 3.8 | 1.5 | 3.0 |
| | 5 | 75 | 20 | 0.16 | | | | |
| 18 | 6 | 22 | 80 | 0.16 | 0.16 | 4.2 | 0.9 | 3.1 |
| | 5 | 75 | 20 | | | | | |
| 19 | 6 | 22 | 30 | 0.16 | 0.23 | 3.9 | 1.4 | 2.9 |
| | 4 | 40 | 50 | | | | | |
| | 5 | 75 | 20 | | | | | |
| 20 | 4 | 40 | 70 | 0.17 | 0.32 | 3.7 | 1.1 | 2.9 |
| | 5 | 75 | 30 | | | | | |
| 21 | 4 | 40 | 90 | 0.16 | 0.12 | 4.1 | 1.5 | 3.2 |
| | 5 | 75 | 10 | | | | | |

Example 4

—Dependency on Time from Exposure till Thermal Development—

The photothermographic material-6 of Example 1 was evaluated on dependency on time from exposure till thermal development at the timing simultaneous with exposure, and other timings of thermal development of 5 sec, 15 sec, 30 sec, 60 sec and 90 sec from exposure set by optimally locating the exposure unit and the thermal development unit of FM-DP L.

A sensitivity was, similar to Example 1, obtained using a common logarithm of an exposure value giving a blackening density of 0.3. Evaluation was conducted with a difference (Δ log E) between a sensitivity at the timing of development of 5 sec from exposure and each of a sensitivity at the timing simultaneous with exposure, and other timings of development ○ 15 sec, 30 sec, 60 sec and 90 sec from exposure.

Similar to Example 1, a γ value was obtained. An image quality was evaluated according to the following way.

<<Evaluation on Image Quality>>

The minimum density Dmin was obtained by measuring an image of the each photothermographic materials with Macbeth densitometer TD 904 (a visual density), and the uniform image was developed at the exposure value to give the optical density of Dmin+1.2, so that the uniformity of the density and the color tone of the silver images was evaluated and ranked to 4 levels:

A; the excellent images with a high uniformity and the best color toned,

B; better images having a slight irregularity in a density and an image color tone, C; images observed an irregularity in a density and an image color tone, which may be allowable to be used practically in a market, D; images having an actual irregularity in a density and an image color tone, which may be troubled to be used practically in a market.

Results are shown in Table 4.

TABLE 4

| | | Sensitivity (time from exposure to thermal development) 90 sec. | 60 sec. | 30 sec. | 15 sec. | 5 sec. | simultaneous with exposure |
|---|---|---|---|---|---|---|---|
| Sensitivity | ⊿logE | −0.071 | −0.048 | −0.009 | −0.004 | 0 | 0.021 |
| γ value | D = 0.5 | 2.0 | 1.7 | 1.5 | 1.5 | 1.4 | 1.3 |
| | D = 1.0 | 3.9 | 3.2 | 2.9 | 2.8 | 2.7 | 2.6 |
| Image quality | | C | B | B | B | A | A |

As shown in Table 4, in an image forming method of a photothermographic material of the invention, the shorter a time from exposure till thermal development, a sensitivity is higher. This is because stability of a latent image after exposure is comparatively not good in a photothermographic material with a high silver iodide content, which shows that the shorter a time till thermal development after exposure, a higher sensitivity performance is achieved. It is found that in an image forming method of a photothermographic material of the invention, the shorter a time from exposure till development, a softer gradation is achieved to obtain an image more excellent in quality without unevenness in image density or silver tone. This is because stability of a latent image described above is different according to an emulsion and since a higher sensitivity emulsion is more unstable, an image is rendered to be harder (of higher contrast) with a longer time from exposure till thermal development. It is shown that an excellent image quality is, however, obtained according to an image forming method of the invention.

Example 5

Exposure was performed on the photothermographic material-6 of the invention using a dry laser imager DRYPIX 7000 fabricated by Fuji Film Medical Co., Ltd., in which a NLHV 3000E laser diode fabricated by Nichia Corporation as a laser diode beam source was mounted in an exposure portion thereof and a beam diameter thereof was adjusted to about 100 μm. Other exposure conditions are as follows: exposure of a photothermographic material was performed for $10^{-6}$ sec with a photothermographic material surface illuminance at 0 $mW/mm^2$ and at values from 1 $mW/mm^2$ to 1000 $mW/mm^2$. A light-emission wavelength of laser beam was 405 nm. Thermal development was performed in conditions that 3 panel heaters were set to be 107° C.-121° C.-121° C. and a total thermal development time was set to 14 sec.

DRYPIX 7000 corresponds to a construction of the image forming apparatus related to the invention shown in FIGS. 1 and 2. A time consumed till an exposed portion was thermal developed was 7 sec. Images obtained were of a high sensitivity in FMDP L described above, and of an excellent quality without unevenness in density and silver tone.

What is claimed is:

1. An image forming method comprising: imagewise exposing and thermal developing a sheet of photothermographic material using an image recording apparatus, wherein the image recording apparatus has at least the following portions (A) to (D):

(A) a laser irradiation portion that scans the photothermographic material with a laser beam based on image data to expose the photothermographic material;

(B) a transport portion that transports the photothermographic material in the laser irradiation portion;

(C) a thermal developing portion, disposed on the side downstream from the transport portion, and in which a part of one sheet of the photothermographic material is imagewise exposed by the laser irradiation portion and simultaneously a part of the sheet having been already imagewise exposed is developed by heating; and (D) a guide portion, provided between the transport portion and the thermal developing portion, and allowing a flexion of the photothermographic material generated by a difference between a transport speed in the transport portion and a transport speed in the thermal developing portion:

wherein the photothermographic material comprises at least a photosensitive silver halide, a non-photosensitive organic silver salt, a reducing agent represented by following formula (R) and a binder on at least one surface of a support;

formula (R):

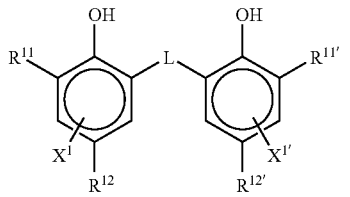

wherein $R^{11}$ and $R^{11'}$ each independently represents an alkyl group having 1 to 20 carbon atoms, $R^{12}$ and $R^{12'}$ each independently represents a hydrogen atom or a group capable of substituting for a hydrogen atom on a benzene ring, L represents a —S— group or a —$CHR^{13}$— group, $R^{13}$ represents a hydrogen atom or an alkyl group having 1 to 20 carbon atoms, and X and $X^1$ each independently represents a hydrogen atom or a group capable of substituting for a hydrogen atom on a benzene ring; and wherein the photosensitive silver halide contains at least two preformed photosensitive silver halides having respective sensitivities different from each other for a light with the same exposure wavelength and a silver iodide content of the photosensitive silver halide is 40% by mole or more.

2. The image forming method according to claim 1, wherein the thermal development is started on the sheet within 60 sec after the imagewise exposure.

3. The image forming method according to claim 1, wherein the thermal development is started on the sheet within 15 sec after the imagewise exposure.

4. The image forming method according to claim 1, wherein V1 is a transport speed in the transport portion and V2 is a transport speed in the thermal developing portion, and V1 and V2 satisfy the following relationship: $0.7<V2/V1 \leqq 1.0$.

5. The image forming method according to claim 1, wherein a difference in sensitivity between the at least two preformed photosensitive silver halides is 0.3 to 1.0 in terms of log E.

6. The image forming method according to claim 1, wherein the maximum density of a photographic characteristic curve obtained by imagewise exposure and thermal development of the photothermographic material is 3.0 or more, and a y value at a density of 0.5 is 0.8 to 1.8 and a γ value at a density of 1.0 is 2.2 to 3.8.

7. The image forming method according to claim 1, wherein the at least two preformed photosensitive silver halides have respective average grain sizes, which are different from each other.

8. The image forming method according to claim 7, wherein the average grain sizes of the preformed photosensitivesilver halides are 5 nm to 100 nm.

9. The image forming method according to claim 7, wherein a difference in average grain size between the at least two preformed photosensitive silver halides is 20 nm to 95 nm.

10. The image forming method according to claim 1, wherein the photothermographic material further comprises a compound that can be one-electron-oxidized to provide a one-electron oxidation product, which releases one or more electrons.

11. The image forming method according to claim 1, wherein at least one of the preformed photosensitive silver halide is chemically sensitized.

12. The image forming method according to claim 1, wherein the photothermographic material further comprises a compound expressed by the following formula (PO):

$$Q—(Y)_n—C(Z_1)(Z_2)X \qquad \text{formula (PO)}$$

wherein Q represents a heterocyclic group, Y represents a divalent linkage group, n represents 0 or 1, $Z_1$ and $Z_2$ each independently represents a halogen atom, and X represents a hydrogen atom or an electron-withdrawing group.

13. The image forming method according to claim 1, wherein the binder is a polymer latex.

14. The image forming method according to claim 1, wherein the photothermographic material further comprises a developing accelerator.

15. The image forming method according to claim 1, wherein the photothermographic material further comprises a hydrogen bonding compound.

* * * * *